US006984123B2

(12) United States Patent
Adams et al.

(10) Patent No.: US 6,984,123 B2
(45) Date of Patent: Jan. 10, 2006

(54) MULTI-MODE LIGHTER

(75) Inventors: Paul Adams, Monroe, CT (US); Anthony Sgroi, Jr., Wallingford, CT (US); Jeffrey F. Ukleja, West Haven, CT (US)

(73) Assignee: Bic Corporation, Milford, CT (US)

( * ) Notice: Subject to any disclaimer, the term of this patent is extended or adjusted under 35 U.S.C. 154(b) by 0 days.

(21) Appl. No.: 10/833,827

(22) Filed: Apr. 27, 2004

(65) Prior Publication Data

US 2004/0202976 A1 Oct. 14, 2004

Related U.S. Application Data

(60) Division of application No. 10/085,045, filed on Mar. 1, 2002, now Pat. No. 6,726,469, which is a continuation-in-part of application No. 09/817,278, filed on Mar. 27, 2001, and a continuation-in-part of application No. 09/819,021, filed on Mar. 27, 2001, now Pat. No. 6,488,492, which is a continuation-in-part of application No. 09/704,689, filed on Nov. 3, 2000, now Pat. No. 6,491,515.

(51) Int. Cl.
*F23D 11/36* (2006.01)

(52) U.S. Cl. ..... 431/153; 431/254

(58) Field of Classification Search ..... 431/153, 431/254, 255

See application file for complete search history.

(56) References Cited

U.S. PATENT DOCUMENTS

| | | | |
|---|---|---|---|
| 2,498,377 | A | 2/1950 | Nissen |
| 3,758,820 | A | 9/1973 | Lohberg |
| 4,022,566 | A | 5/1977 | Goto |
| 4,259,059 | A | 3/1981 | Roosa et al. |
| 4,462,791 | A | 7/1984 | Hayden |
| 4,870,314 | A | 9/1989 | Hefling |
| 4,921,420 | A | 5/1990 | Johnston |
| 5,145,358 | A | 9/1992 | Shike et al. |
| 5,199,865 | A | 4/1993 | Liang |
| 5,262,697 | A | 11/1993 | Meury |
| 5,334,011 | A | 8/1994 | Frigiere |
| 5,496,169 | A | 3/1996 | Chen |
| 5,520,197 | A | 5/1996 | McDonough et al. |
| 5,531,591 | A | 7/1996 | Yamazaki |
| 5,645,414 | A | 7/1997 | Wang |
| 5,697,775 | A | 12/1997 | Saito et al. |
| 5,854,530 | A | 12/1998 | LaForest et al. |
| 5,897,308 | A | 4/1999 | Saito et al. |
| 5,934,895 | A | 8/1999 | McDonough et al. |
| 5,971,751 | A | 10/1999 | Lee |
| 6,022,212 | A | 2/2000 | Saito et al. |
| 6,042,367 | A | 3/2000 | Saito et al. |

(Continued)

OTHER PUBLICATIONS

Aim Flame 2 advertising sheets © 1999, 2 photos of lighter from sheets.

*Primary Examiner*—Alfred Basichas
(74) *Attorney, Agent, or Firm*—Jones Day

(57) ABSTRACT

The present invention relates to a lighter. The lighter includes a housing having a supply of fuel, an actuating member movably associated with the housing to selectively ignite the fuel, and a latch moveable between a first latch position and a second latch position to vary the amount of force required to move the actuating member to ignite the fuel. When a user attempts to move the latch before moving the actuating member, a first latch force is required to move the latch from the first latch position to the second latch position. When a user attempts to move the actuating member before moving the latch, a second latch force is required to move the latch from the first latch position to the second latch position. The second latch force is different that the first latch force, and is preferably greater than the first latch force. Various other features that improve the functioning of the lighter may be provided separately or in combination.

17 Claims, 39 Drawing Sheets

U.S. PATENT DOCUMENTS

| | | | | |
|---|---|---|---|---|
| 6,065,958 | A | | 5/2000 | Adams et al. |
| 6,077,071 | A | | 6/2000 | Yeh |
| 6,086,360 | A | | 7/2000 | McDonough et al. |
| 6,093,017 | A | | 7/2000 | Saito et al. |
| 6,168,420 | B1 | | 1/2001 | Sung |
| 6,213,759 | B1 | | 4/2001 | Sung |
| 6,224,368 | B1 | | 5/2001 | Chung |
| 6,267,582 | B1 | | 7/2001 | Lin |
| 6,488,492 | B2 | | 12/2002 | Adams et al. |
| 6,491,515 | B1 | | 12/2002 | Tubby et al. |
| 6,527,546 | B1 | | 3/2003 | Laforest et al. |
| 6,726,469 | B2 | * | 4/2004 | Adams et al. ..... 431/153 |
| 2002/0055076 | A1 | * | 5/2002 | Adams et al. ..... 431/153 |
| 2004/0023178 | A1 | * | 2/2004 | Sgroi et al. ..... 431/153 |
| 2004/0081931 | A1 | * | 4/2004 | Sgroi et al. ..... 431/153 |
| 2004/0166453 | A1 | * | 8/2004 | Adams et al. ..... 431/153 |

* cited by examiner

MULTI-MODE LIGHTER

CROSS-REFERENCE TO RELATED APPLICATIONS

The present application is a divisional of U.S. patent application Ser. No. 10/085,045, filed on Mar. 1, 2002 now U.S. Pat. No. 6,726,469, which is a continuation-in-part of U.S. patent application Ser. No. 09/817,278, filed Mar. 27, 2001, and a continuation-in-part of U.S. patent application Ser. No. 09/819,021 now U.S. Pat. No. 6,488,492, also filed Mar. 27, 2001, both of which are continuations-in-part of U.S. patent application Ser. No. 09/704,689 now U.S. Pat. No. 6,491,515 filed Nov. 3, 2000. The contents of these three applications are expressly incorporated herein by reference thereto.

TECHNICAL FIELD

The present invention generally relates to lighters such as pocket lighters used to light cigarettes and cigars, or utility lighters used to ignite candles, barbecue grills, fireplaces and campfires, and more particularly to such lighters which resist inadvertent operation or undesirable operation by unintended users.

BACKGROUND OF THE INVENTION

Lighters used for igniting tobacco products, such as cigars, cigarettes, and pipes, have developed over a number of years. Typically, these lighters use either a rotary friction element or a piezoelectric element to generate a spark near a nozzle which emits fuel from a fuel container. Piezoelectric mechanisms have gained universal acceptance because they are simple to use. U.S. Pat. No. 5,262,697 ("the '697 patent") to Meury discloses one such piezoelectric mechanism, the disclosure in the '697 patent is incorporated by reference herein in its entirety.

Lighters have also evolved from small cigarette or pocket lighters to several forms of extended or utility lighters. These utility lighters are more useful for general purposes, such as lighting candles, barbecue grills, fireplaces and campfires. Earlier attempts at such designs relied simply on extended actuating handles to house a typical pocket lighter at the end. U.S. Pat. Nos. 4,259,059 and 4,462,791 contain examples of this concept.

Many pocket and utility lighters have had some mechanism for resisting undesired operation of the lighter by young children. Often, these mechanisms are on/off switches which may shut off the fuel source or may prevent movement of an actuator, such as a push-button, on the lighter. On/off switches which a user positively moves between "on" and "off" positions can be problematic. For example, an adult user may forget to move the switch back to the "off" position after use and thereby render the feature ineffective.

Other pocket and utility lighters include a spring-biased blocking latch which arrests or prevents movement of the actuator or push-button. U.S. Pat. No. 5,697,775 to Saito and U.S. Pat. No. 5,145,358 to Shike, et al., disclose examples of such lighters.

There remains a need for lighters which resist inadvertent operation or undesirable operation by unintended users, but which provide each intended user with a consumer-friendly method of operating the lighters so that the lighters appeal to a variety of intended users.

SUMMARY OF THE INVENTION

The present invention relates to a lighter, such as a pocket lighter or a utility lighter. The lighter includes a housing having a supply of fuel, an actuating member movably associated with the housing to selectively ignite the fuel, and a latch moveable between a first latch position and a second latch position to vary the amount of force required to move the actuating member to ignite the fuel. When a user attempts to move the latch before moving the actuating member, a first latch force is required to move the latch from the first latch position to the second latch position. When a user moves the actuating member a predetermined distance before moving the latch, a second latch force is required to move the latch from the first latch position to the second latch position. The second latch force is different than the first latch force.

When the latch is positioned in the first latch position (e.g., the "high-force mode"), the user applies a first actuating force to the actuating member to ignite the fuel, and when the latch is positioned in the second latch position (e.g., the "low-force mode"), the user applies a second actuating force to the actuating member to ignite the fuel. The first actuating force is different than the second actuating force. Preferably, the first actuating force is greater than the second actuating force.

According to one embodiment, the second latch force may be greater than the first latch force. Alternatively, when a user moves the actuating member a predetermined distance before attempting to move the latch, the latch may be substantially prevented from movement from the first latch position to the second latch position.

The lighter may include a first engagement surface associated with the latch, and a second engagement surface associated with the actuating member, and upon movement of the actuating member a predetermined distance before movement of the latch, the first engagement surface may engage the second engagement surface. Furthermore, upon movement of the latch before movement of the actuating member, the first engagement surface may be substantially disengaged from the second engagement surface. The lighter may further include a plunger member associated with the latch, and the first engagement surface may be formed on the plunger member. The actuating member may be a trigger, and the second engagement surface may be formed on the trigger.

The first engagement surface may be inclined or angled, and the second engagement surface may also be inclined or angled, for example to match the first engagement surface. Alternatively, the first and second engagement surfaces may be overlapping horizontal surfaces that abut one another upon movement of the actuating member before movement of the latch, however, one of ordinary skill in the art will recognize that any number of configurations of the first and second engagement surfaces are possible and contemplated by the present invention.

BRIEF DESCRIPTION OF THE DRAWINGS

Preferred features of the present invention are disclosed in the accompanying drawings, wherein similar reference characters denote similar elements throughout the several views, and wherein.

DETAILED DESCRIPTION OF THE PREFERRED EMBODIMENTS

Figure 1:
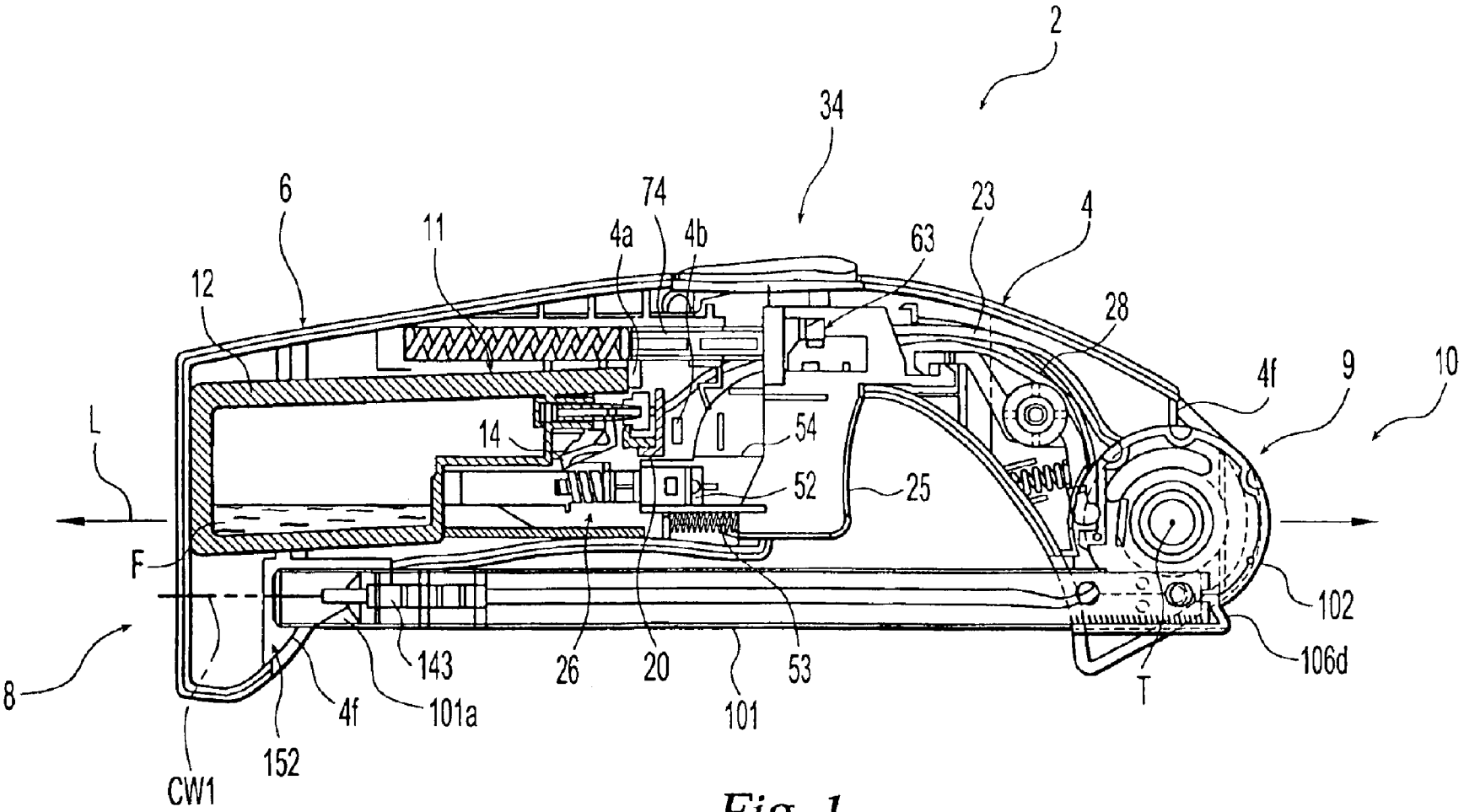
FIG. 1 is a cut-away, side view of a utility lighter of one embodiment with various components removed for clarity and better illustrating various inner details, wherein the lighter is in an initial state, a wand assembly is in a closed position, and a trigger and latch member are in initial states, and a plunger member is in a high-actuation-force position.

Turning to FIG. 1, an embodiment of a utility lighter 2 constructed in accordance with the present invention is shown with the understanding that those of ordinary skill in the art will recognize many modifications and substitutions which may be made to various elements. While the invention will be described with reference to a utility lighter, one of ordinary skill in the art could readily adapt the teaching to conventional pocket lighters and the like.

Lighter 2 generally includes a housing 4 which may be formed primarily of molded-rigid-polymer or plastic materials such as acrylonitrile butadiene styrene terpolymer or the like. The housing 4 may also be formed of two-parts that are joined together by techniques known by those of ordinary skill in the art, such as ultrasonic welding.

Housing 4 includes various support members, such as support member 4*a* discussed below. Further support members are provided in the lighter 2 for various purposes, such as supporting components or directing the travel path of components. The housing 4 further includes a handle 6, which forms a first end 8 and a second end 9 of the housing. A wand assembly 10, as discussed in detail below, is pivotally connected to the second end 9 of the housing.

Figure 1A:
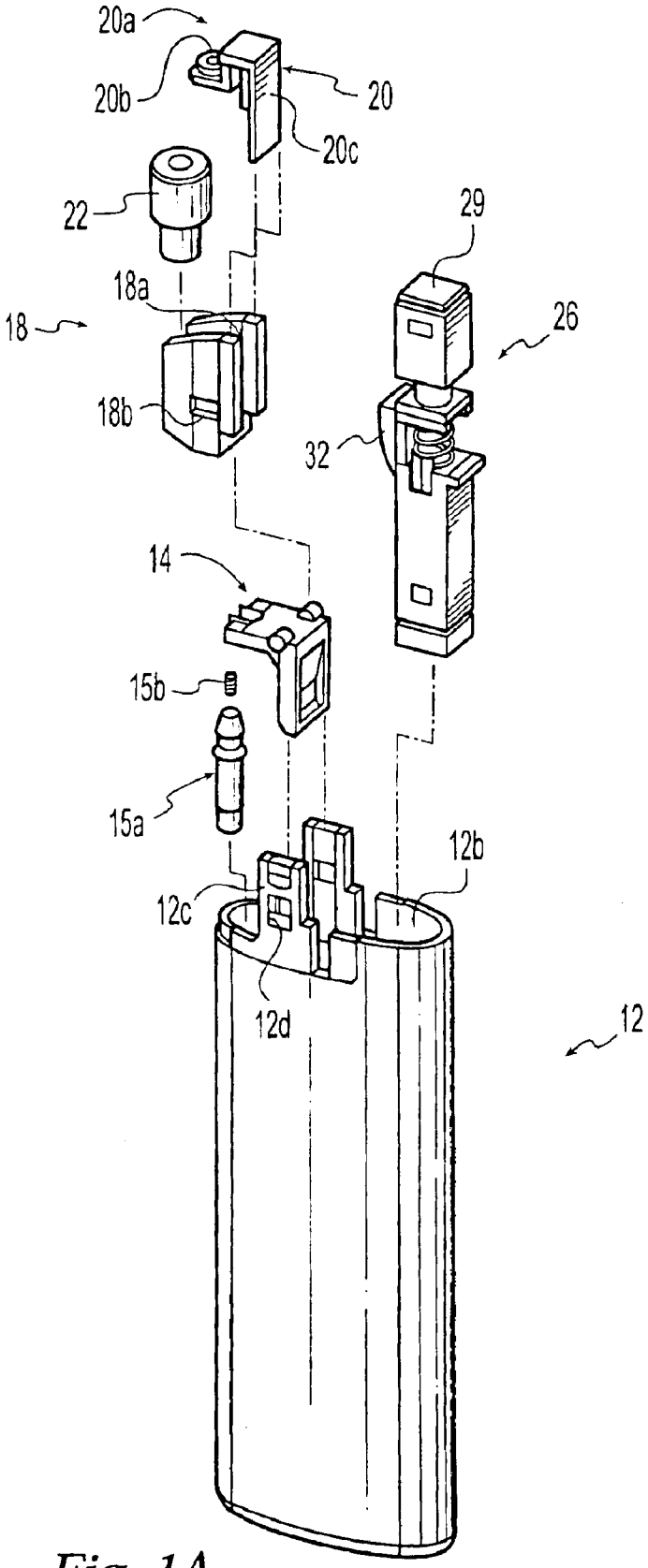
FIG. 1A is an enlarged, exploded, perspective view of several components of a fuel supply unit for use in the lighter of FIG. 1.
Figure 1B:
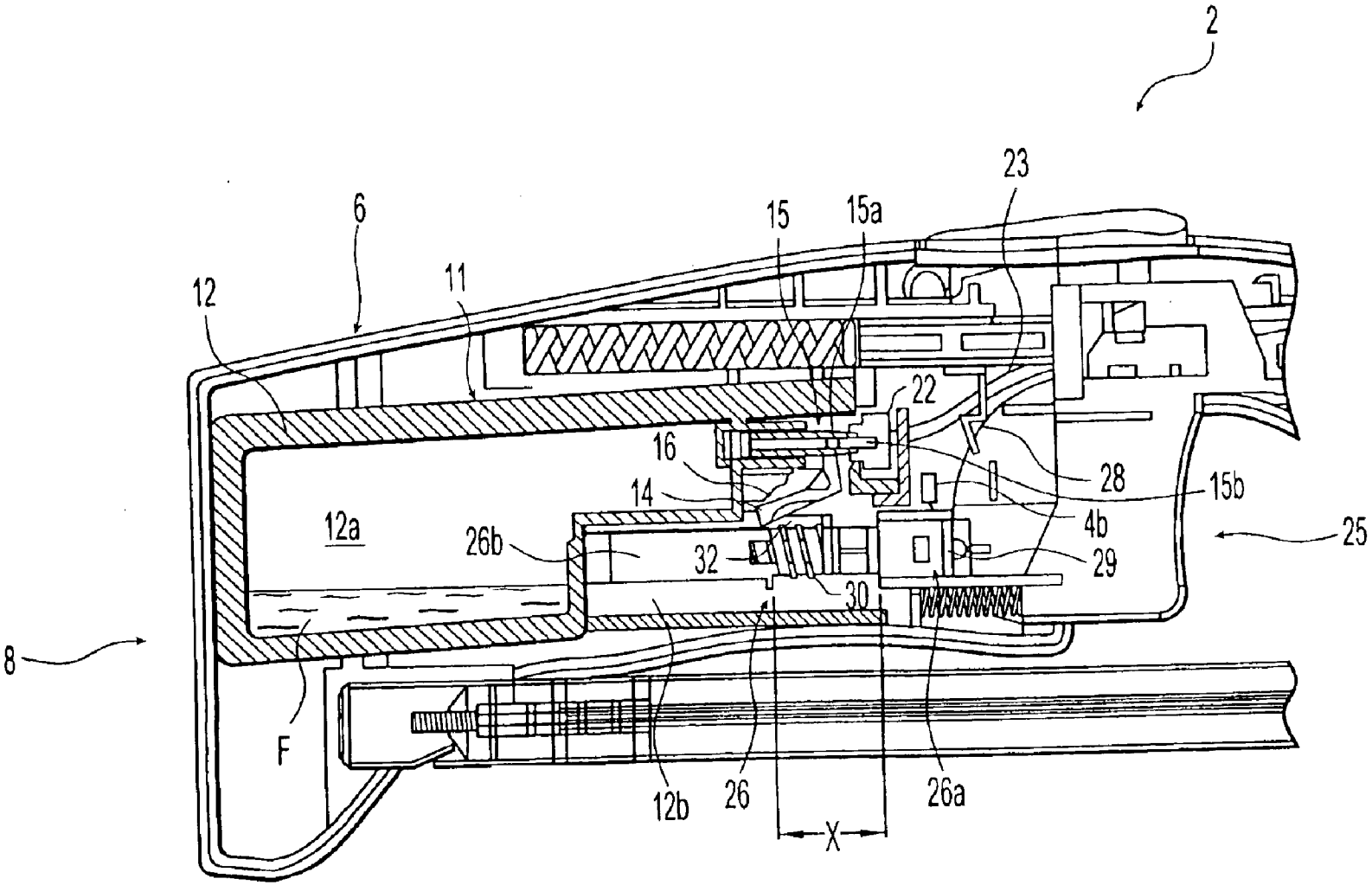
FIG. 1B is an enlarged, cut-away, side view of a rear portion of the utility lighter of FIG. 1.

Referring to FIGS. 1, 1A, and 1B, handle 6 preferably contains a fuel supply unit 11 that includes a fuel supply container or main body 12, a valve actuator 14, a jet and valve assembly 15, a spring 16, a guide 18, and a retainer 20. The container 12 supports the other components of the fuel supply unit 11 and defines a fuel compartment 12*a* and a chamber 12*b*, and further includes a pair of spaced support members 12*c* extending upward from the top edge thereof. The support members 12*c* define openings 12*d*. The fuel compartment 12*a* contains fuel F, which may be compressed hydrocarbon gas, such as butane or a propane and butane mixture, or the like.

Referring to FIGS. 1A and 1B, the a valve actuator 14 is rotatably supported on the compartment 12 below the support members 12*c*. The valve actuator 14 is connected to a jet and valve assembly 15 that includes a jet or valve stem 15*a* and an electrode 15*b*. The electrode 15*b* is optional. The jet and valve assembly 15 is a normally open valve design, and closed by the pressure of a spring member 16 on valve actuator 14. Alternatively, a jet and valve assembly with a normally closed valve design can also be used.

A suitable fuel supply unit 11 is disclosed in U.S. Pat. No. 5,934,895 ("the '895 patent"), the disclosure of which is incorporated herein by reference in its entirety. An alternative arrangement for the fuel supply unit 11 that can be used is disclosed in U.S. Pat. No. 5,520,197 ("the '197 patent") or U.S. Pat. No. 5,435,719 ("the '719 patent"), the disclosures of which are incorporated by reference in their entirety. The fuel supply units disclosed in the above patents can be used with all of the disclosed components or with various components removed, such as windshields, latch springs, latches, and the like, as desired by one of ordinary skill in the art. Alternative arrangements of the fuel supply unit can be used.

Referring to FIG. 1A, the guide 18 with walls to define a slot 18*a* and projections 18*b*. When the lighter is assembled, the guide 18 is disposed between the support members 12*c*, and the support members 12*c* flex outward to accommodate the guide 18. Once the projections 18*b* are aligned with the openings 12*d*, the support members 12*c* may return to their vertical, initial positions. The interaction between the projections 18*b* and the openings 12*d* allow the guide 18 to be retained within the main body 12.

Referring to FIGS. 1A and 1B, the retainer 20 includes a front portion 20*a* that defines a bore 20*b* and a L-shaped rearward portion 20*c*. A fuel connector 22 is disposed on the top of jet 15*a* and receives a fuel conduit 23 therein. The connector 22, however, is optional and if not used the conduit 23 can be disposed on the jet 15*a* directly.

The retainer 20 properly positions fuel conduit 23 with respect to the jet and valve assembly 15 by receiving conduit 23 through the bore 20*b* so that the conduit 23 is within the connector 22. Details of the conduit 23 will be discussed below. The rearward portion 20*c* of the retainer 20 is disposed within the slot 18*a* of the guide 18. The retainer 20 and guide 18 may be configured so that these components snap-fit together so that the conduit 23 is properly positioned with respect to the jet and valve assembly 15. The guide 18 and retainer 20 are optional and the housing 4 or other components of the lighter can be used to support and position the connector 22 and the conduit 23. In addition, the guide and retainer 20 may be configured differently so long as they function to locate connector 22 and conduit 23 to jet 15*a*.

The container 12, guide 18, retainer 20, and connector 22 may be made with plastic material. However, the valve actuator 14, valve stem 15*a*, and electrode 15*b* are preferably formed of electrically conductive materials. The fuel supply unit 11 can be a preassembled unit that may include the fuel supply container 12, the jet and valve assembly 15, and the biased valve actuator 14. When the fuel supply unit 11 is disposed within the lighter, the housing support member 4*a* aids in locating and maintaining the position of the unit 11, as shown in FIG. 1. The housing support member 4*b* aids in positioning the retainer 20.

Referring again to FIG. 1, lighter 2 also includes an actuating member 25 which facilitates movement of the valve actuator 14 to selectively release fuel F. In this embodiment, the actuating member also selectively activates an ignition assembly 26 for igniting the fuel. Alternatively, the actuating member may perform either the fuel release or ignition function, and another mechanism or assembly may perform the other function. Actuating member 25 in the illustrated embodiment comprises a trigger. In an alternative embodiment, as discussed below, the actuating member can be part of an actuating assembly.

Referring to FIG. 1B, although not necessary for all aspects of this invention, an electric ignition assembly such as a piezoelectric mechanism is the preferred ignition assembly 26. The ignition assembly may alternatively include other electronic ignition components, such as shown in U.S. Pat. Nos. 3,758,820 and 5,496,169, a spark wheel and flint assembly or other well-known mechanisms in the art for generating a spark or igniting fuel. The ignition assembly may alternatively include a battery having, for example, a coil connected across its terminals. The piezoelectric mechanism may be the type disclosed in the '697 patent. Piezoelectric mechanism 26 has been illustrated in FIG. 1B schematically and particularly described in the '697 patent.

The piezoelectric unit 26 includes an upper portion 26*a* and a lower portion 26*b* that slide with respect to each other along a common axis. A coil spring or return spring 30 is positioned between the upper and lower portions 26*a*, 26*b* of piezoelectric unit. The return spring 30 serves to resist the compression of piezoelectric unit, and when positioned in the actuating member 25 resists the depression of actuating member 25. The lower portion 26*b* of piezoelectric unit is received in cooperating chamber 12*b* in fuel supply unit 11.

The piezoelectric unit 26 further includes an electrical contact or cam member 32 fixedly connected to the upper portion 26*a*. In the initial position, the portions 26*a*, *b* are separated by a gap X. The cam member 32 is formed of a conductive material. The upper portion 26*a* is coupled to actuating member 25. Spark conductor or wire 28 is partially insulated and may be electrically connected with the electrical contact 29 of the piezoelectric unit in any known manner.

Figure 2:
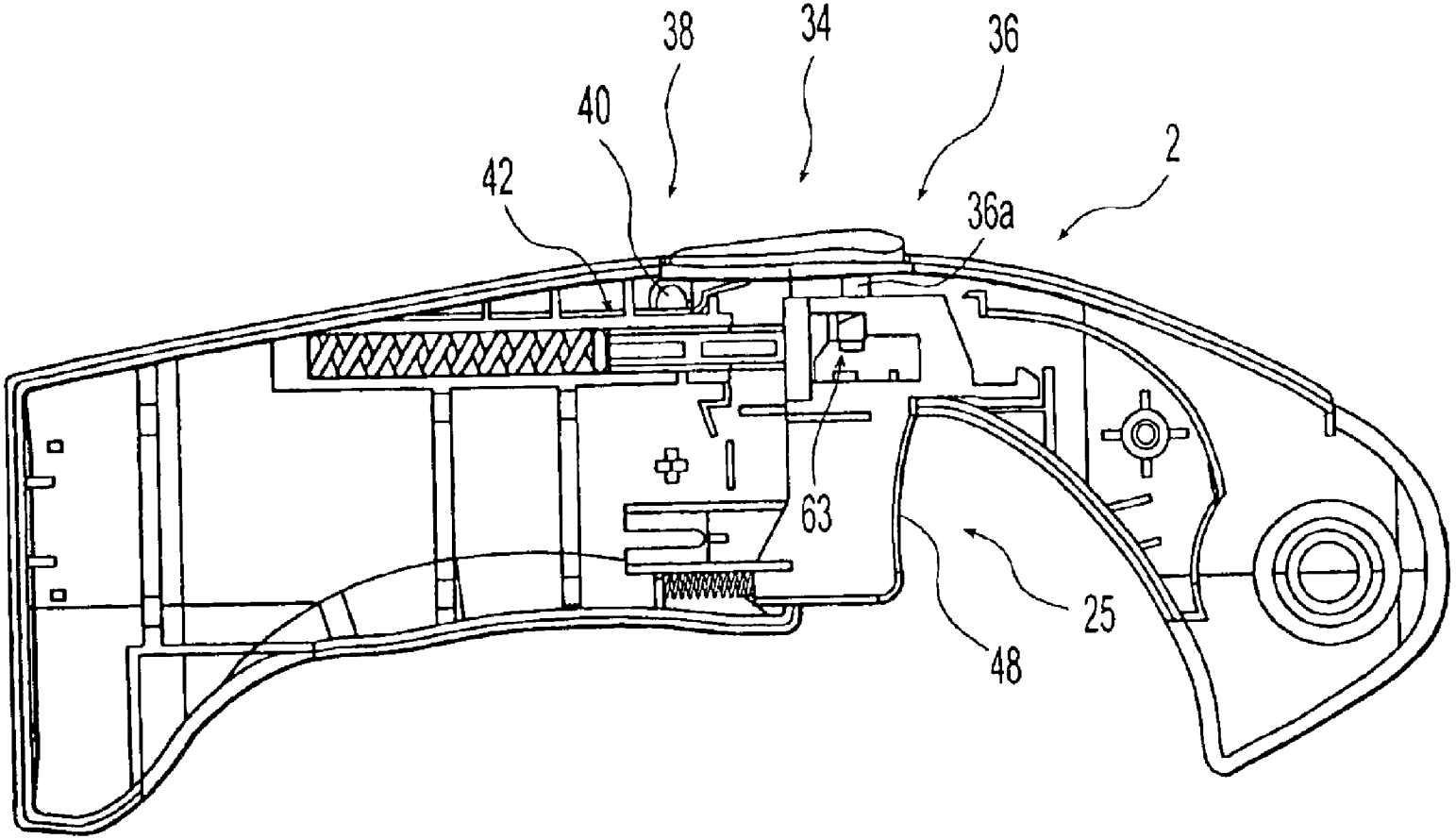
FIG. 2 is a partial, side view of the lighter of FIG. 1 with various components removed for clarity and better illustrating various inner details such as a latch member, a plunger member and a biasing member, wherein the trigger and latch member are in initial states, and the plunger member is in a high-actuation-force position.
Figure 3:
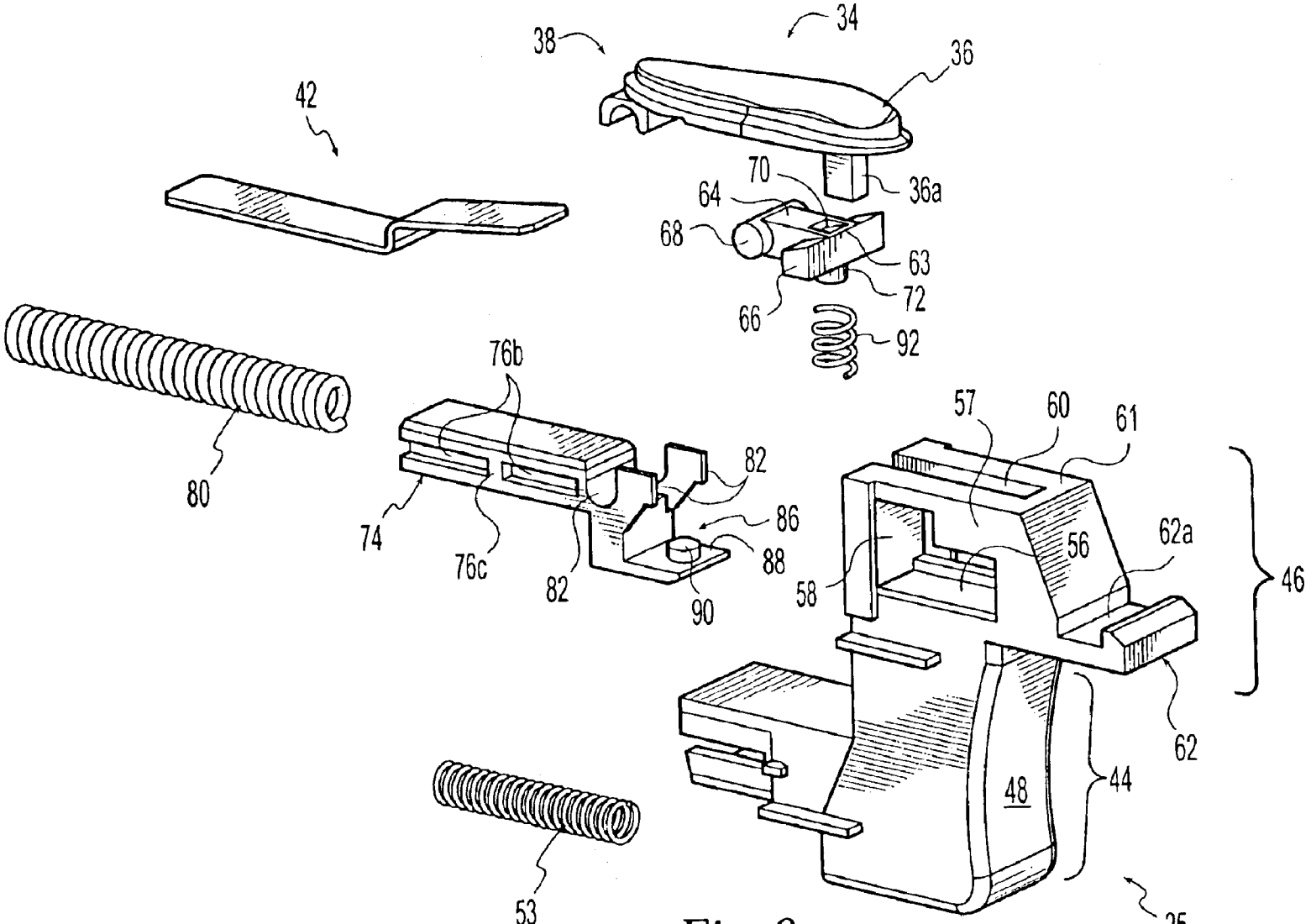
FIG. 3 is an enlarged, exploded, perspective view of various components of the lighter of FIG. 1 without a housing.
Figure 4:
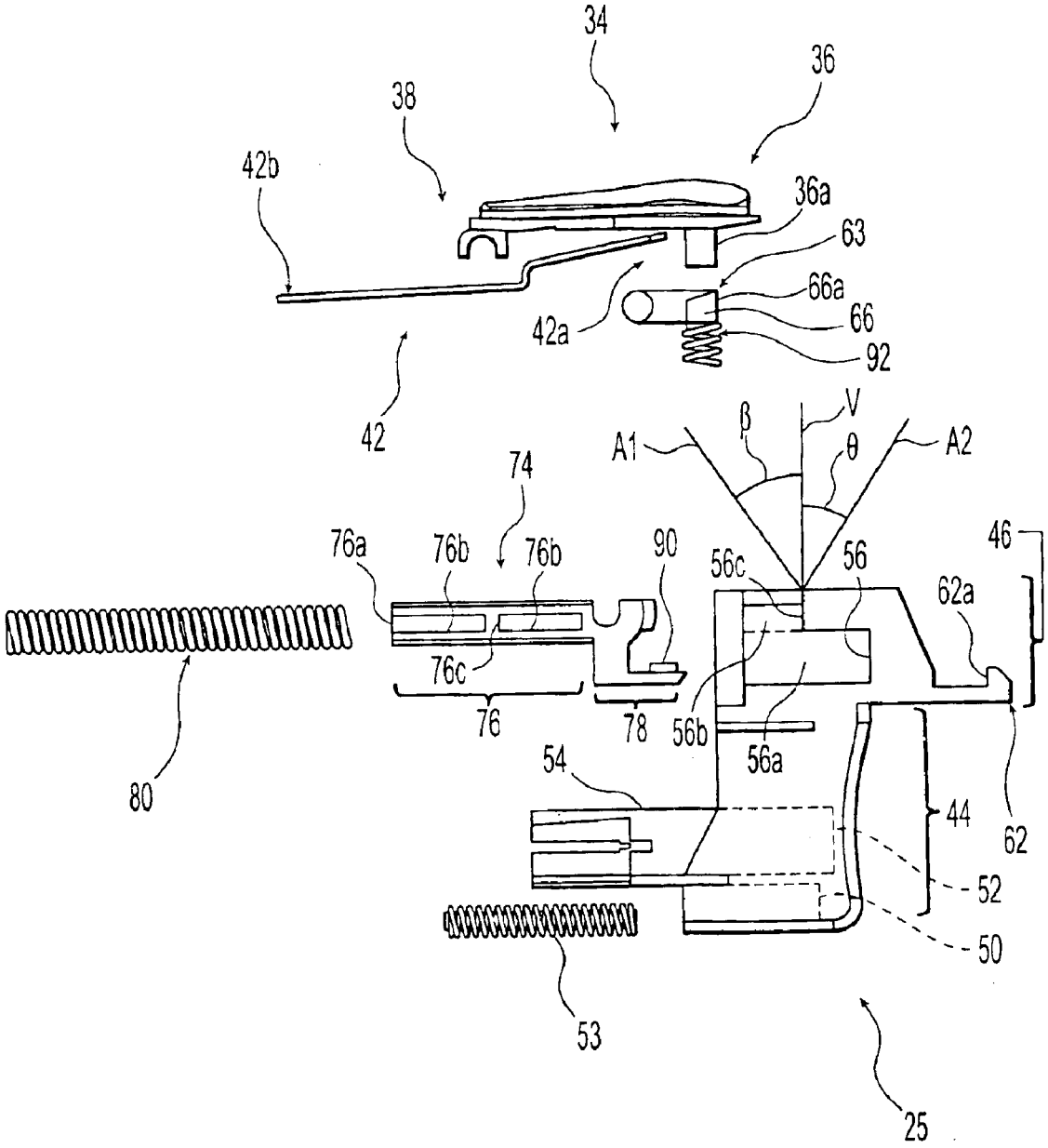
FIG. 4 is an enlarged, side view of the components of FIG. 3.

As shown in FIG. 1, latch member 34 is on the top side of the handle 6 and the actuating member 25 is opposite the latch member 34 near the bottom side of the handle 6. Referring to FIGS. 2–4, the latch member 34 generally includes an unsupported, movable, front end 36 which includes a downwardly extending boss 36*a* and a rear end 38 pivotally fixed to a hinge 40 of the housing 4. One of ordinary skill in the art can readily appreciate that latch member 34 also may be coupled to the housing in another manner such as in a cantilevered fashion, slidably or rotatably. When the latch member 34 is slidable a cam may be used therewith.

Referring to FIGS. 3 and 4, a leaf spring 42 includes a front end 42*a* and a rear end 42*b*. The leaf spring 42 is bent, as best seen in FIG. 4, so that the front end 42*a* is spaced above the rear end 42*b*. The shape of the leaf spring can be modified such as being planar depending on the arrangement of the components in the lighter and the necessary space considerations. Alternatively, the leaf spring may be disposed in front of latch member 34. In addition, the leaf spring may be replaced with a coil spring, a cantilever spring or any other biasing member suitable for biasing the latch member 34.

Figure 5:
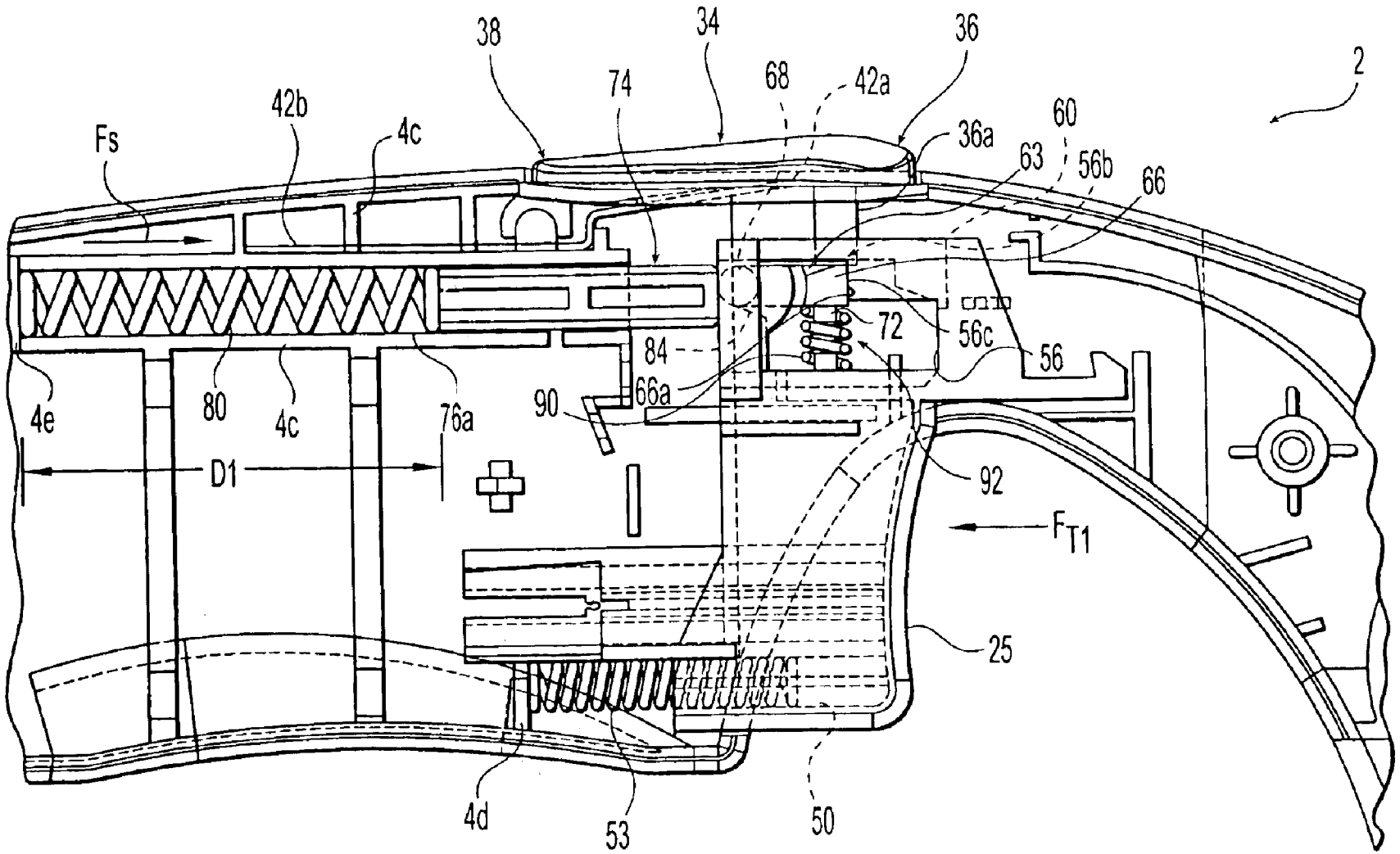
FIG. 5 is an enlarged, partial, side view of the lighter of FIG. 1, where the plunger member is in the high-actuation-force position and the trigger is in an initial position.

Referring to FIG. 5, the rear end 42*b* of the leaf spring 42 is disposed within the housing 4 between support members 4*c* such that end 42*b* is coupled to the housing 4 such that spring 42 operates substantially like a cantilevered member. Due to the configuration, dimensions, and material of the spring 42, the front end 42*a* is free to move and is biased upward to return the latch member front end 36 to its initial position, as shown in FIG. 5. Thus, unsupported front end 36 of latch member 34 may be moved downwardly along with the front end 42*a* of spring 42.

Latch member 34 is preferably formed of plastic, while leaf spring 42 is preferably manufactured from a metal having resilient properties, such as spring steel, stainless steel, or from other types of materials. It should be noted that while leaf spring 42 is shown mounted to housing 4 it may alternatively be coupled to other components of the lighter.

Referring to FIG. 1, further details of the actuating member or trigger 25, will now be discussed. Trigger 25 is preferably slidably coupled to housing 4. The trigger 25 and housing 4 may be configured and dimensioned so that movement of the trigger forward or rearward is limited. One of ordinary skill in the art can appreciate that the trigger can alternatively be coupled or connected to the housing in another manner, such as in a pivotal, rotatable or cantilevered fashion. For example, the trigger can be a linkage system or formed of two pieces, where one piece is slidably coupled to the housing and the other piece pivots.

Turning again to FIG. 3, the trigger 25 includes a lower portion 44 and an upper portion 46. Referring to FIGS. 3–4, the lower portion 44 includes a forward finger actuation surface 48, a first chamber 50 (shown in phantom), and a second chamber 52 (shown in phantom). When the trigger 25 is disposed within the housing 4, the finger actuation surface 48 extends from the housing so that it is accessible by a user's finger (not shown).

In this embodiment, the trigger 25 lower and upper portions are formed as a single piece. Alternatively, the upper and lower portions can be two, separate pieces coupled together or the trigger can be part of a multiple piece unit.

Referring to FIGS. 4 and 5, the first and second chambers 50 and 52 of the trigger 25 are horizontally disposed. The first chamber 50 is below the second chamber 52, and the first chamber 50 is configured to receive a trigger return spring 53. The spring 53 is disposed between the trigger 25 and a first spring stop portion or support member 4*d* of the housing 4. Referring to FIG. 4, the trigger 25 further includes an extension 54 extending rearwardly from the lower portion 44. The second chamber 52 extends into the extension 54. The second chamber 52 is configured to receive the ignition assembly 26 (as shown in FIG. 1).

Referring to FIGS. 3 and 4, the upper portion 46 of the trigger 25 includes two L-shaped guides. In this embodiment the guides are side cutouts, represented by cutout 56, in side wall 57. The cutout 56 includes a first portion 56*a* and a second portion 56*b* in communication with the first portion 56*a*. The second portion 56*b* includes a wall 56*c* substantially parallel to vertical axis V. Vertical axis V is perpendicular to longitudinal axis L and transverse axis T (shown in FIG. 1). In this embodiment, the guides are cutouts but in another embodiment the trigger can have solid side walls and the guides can be formed on the inner surface of the side walls.

Referring to FIG. 3, the upper portion 46 of the trigger also includes a rear cutout 58 and slot 60 in an upper wall 61 of the trigger. The upper portion 46 further includes a forwardly extending engaging portion 62 with an engaging surface 62*a*. The function of the engaging portion 62 will be discussed in detail below.

Referring to FIGS. 1 and 3, in this embodiment the upper portion 46 of the trigger 25 and the guides 56 form a portion of a dual-mode assembly. The dual-mode assembly also includes a plunger member 63 and a piston member 74. In this embodiment, the lower and upper portions 44 and 46 of the trigger are formed as a single piece. In another embodiment, the lower and upper portions 44 and 46 can be formed as separate pieces and operatively connected together.

The plunger member 63 when installed in the lighter is disposed below the latch member 34. The plunger member 63 is substantially T-shaped with a longitudinally extending body portion 64 and transversely extending head portions 66. As best seen in FIG. 4, the head portions 66 have a planar, front surface 66*a*. Surface 66*a* is generally parallel to vertical axis V, when plunger member 63 is installed within trigger 25.

Referring again to FIG. 3, the body portion 64 includes two transversely extending pins 68 at the rear end, a recess 70 on the upper surface, and a vertically extending projection 72 that extends from the bottom surface of the body portion 64. Recess 70 is optional.

Referring to FIGS. 3 and 4, in alternative embodiments, the wall 56*c* of the trigger 25 and the wall 66*a* of the plunger member 63 can be configured differently. For example, walls may alternatively be angled with respect to vertical axis V. For example, walls 66*a* and 56*c* may be angled to be substantially parallel to line A1, which is angularly offset from vertical axis V by angle $\beta$. Walls 66*a*, 56*c* may alternatively be angled to be substantially parallel to line A2, which is angularly offset from vertical axis V by angle $\theta$. Alternatively, wall 56*c* can be configured to include a V-shaped notch and the wall 66*a* can include a V-shaped projection to be received in notch of wall 56*c* or vice versa.

Referring to FIGS. 4 and 5, the piston member 74 includes a rear portion 76 and a front portion 78. The rear portion 76 includes a vertical rear wall 76*a* for contacting a high-force spring or biasing member 80. The spring 80 is disposed between the wall 76*a* and the second spring stop portion or support member 4*e* of the housing 4. Turning again to FIG. 4, the rear portion 76 further includes horizontal cutouts 76*b* that define a stop member 76*c*. The cutouts 76*b* and stop member 76*c* allow the piston member 74 to be slidably mounted to rails (not shown) in the housing and to allow the piston member 74 to slide longitudinally a predetermined distance so that the plunger member 63 can function as discussed below.

Referring to FIGS. 3 and 4, the front portion 78 of the piston member 74 includes two spaced apart arms 82. The arms 82 and front portion 78 define a cutout 84 that receives the pins 68 of the plunger member 63. The cutout 84 and pins 68 of the plunger member 63 are configured and dimensioned to allow the plunger member 63 to pivot with respect to the piston member 74, as discussed in detail below. In this embodiment, the plunger member 63 is pivotally connected to the piston member 74, however in another embodiment the plunger member 63 can be fixedly connected to the piston member 74 but be a resiliently deformable.

The front portion 78 of piston member 74 further includes a downwardly extending support portion 86 that includes a horizontal platform 88 with an upwardly extending pin 90. Referring to FIGS. 3 and 5, when the piston member 74 is assembled within the lighter, the platform 88 is disposed through the rear cutout 58 of trigger 25, and the pin 90 may be aligned with the pin 72 of the plunger member 63 so that the pins 72, 90 retain a plunger return spring 92 there between. The plunger member 63 contacts the bottom surface of upper wall 61 (as shown in FIG. 3) due to the return spring 92 that biases the plunger member upward toward an initial position.

Figure 3A:
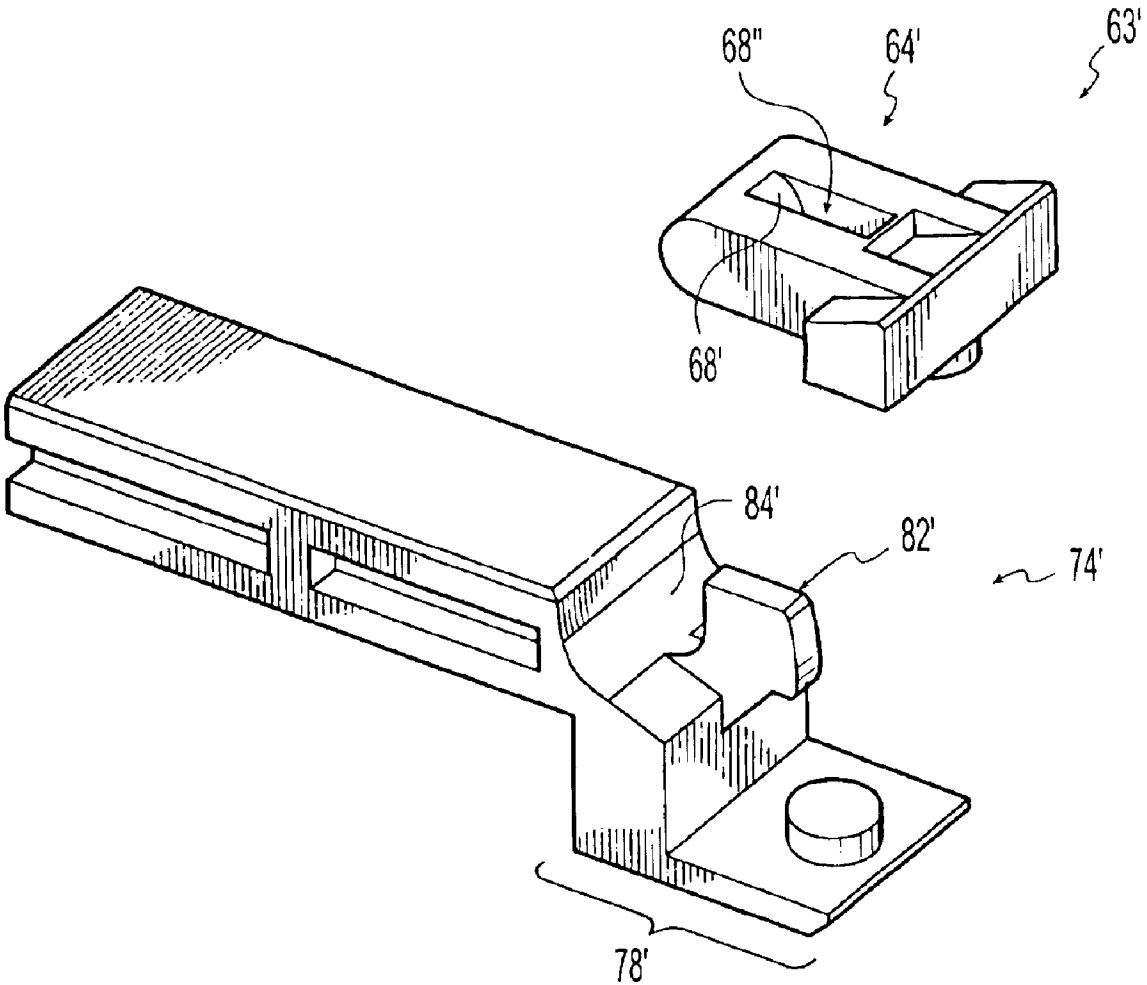
FIG. 3A is an enlarged, exploded, perspective view of another embodiment of the plunger member and a piston member for use with the lighter of FIG. 1.

Referring to FIG. 3A, a preferred embodiment of a plunger member 63' and a piston member 74' are shown for use with the lighter 2 of FIG. 1. The plunger member 63' is similar to plunger member 63 except the body portion 64' includes a single central pin portion 68' and a slot 68". The piston member 74' is similar to piston member 74 except the front portion 78' of the piston member 74' includes a single arm 82' for defining a cutout 84' for pivotally supporting the pin 68' of the plunger member 63'. When the plunger member 63' pivots downward the slot 68" receives the arm 82'.

Operation of the actuating member 25 will be discussed in detail below with reference to FIGS. 6–8. With reference to FIG. 9, according to a further aspect of the lighter 2, it may include a wand assembly 10, the details of which will now be discussed. The wand assembly 10 may be movably coupled to housing 4 and/or formed separately from housing 4. Wand assembly 10 may be pivoted between a first position or closed position, shown in FIGS. 1 and 10 and a second or open or fully-extended position, shown in FIG. 13. In the closed position, the wand assembly 10 is folded closely to housing 4 for convenient transportation and storage of lighter 2. In the fully-extended position, the wand assembly 10 extends outward and away from housing 4.

Figure 9:
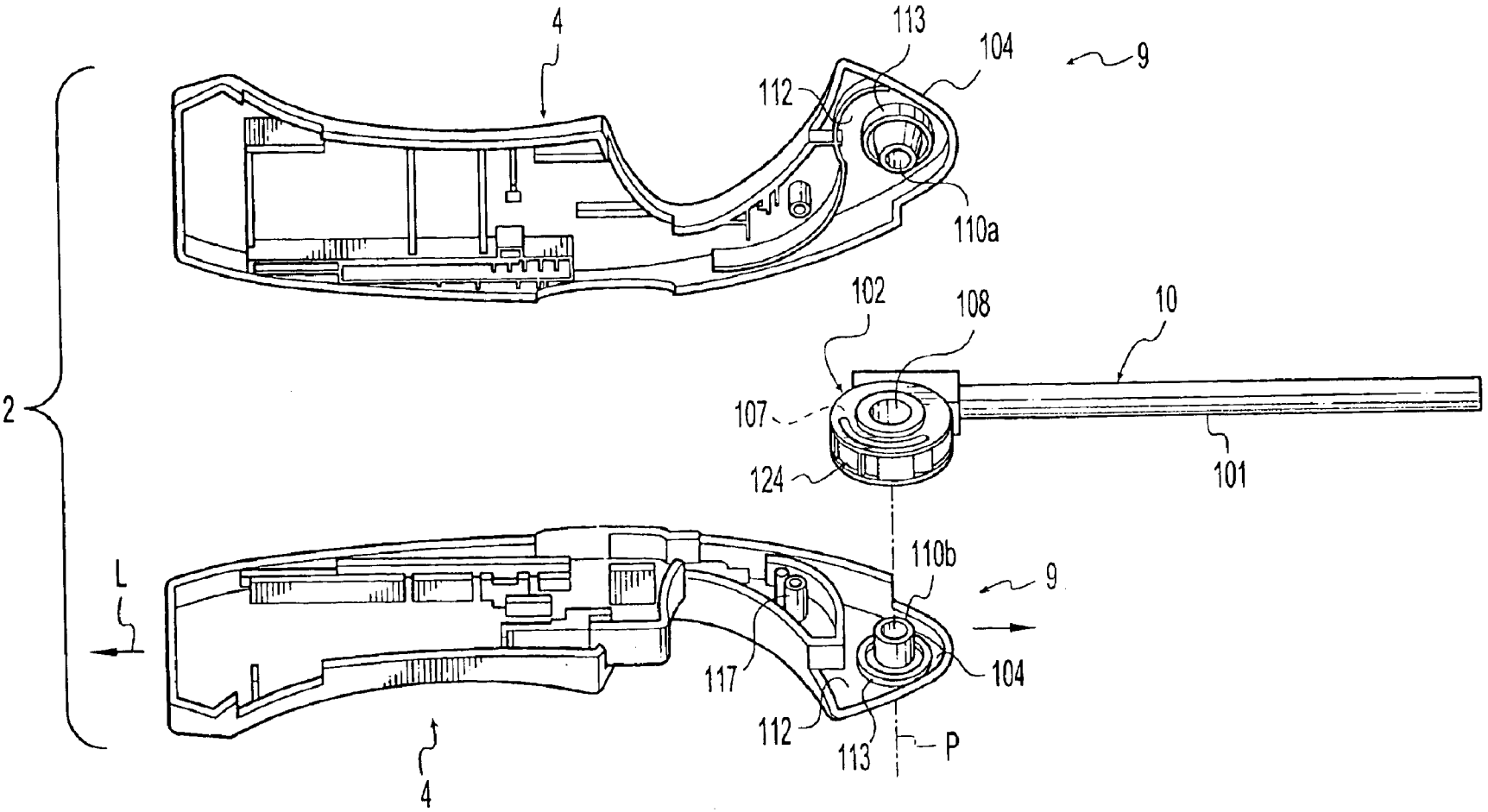
FIG. 9 is an exploded, partial, perspective view of the lighter of FIG. 1 showing the housing and the wand assembly separated.
Figure 9A:
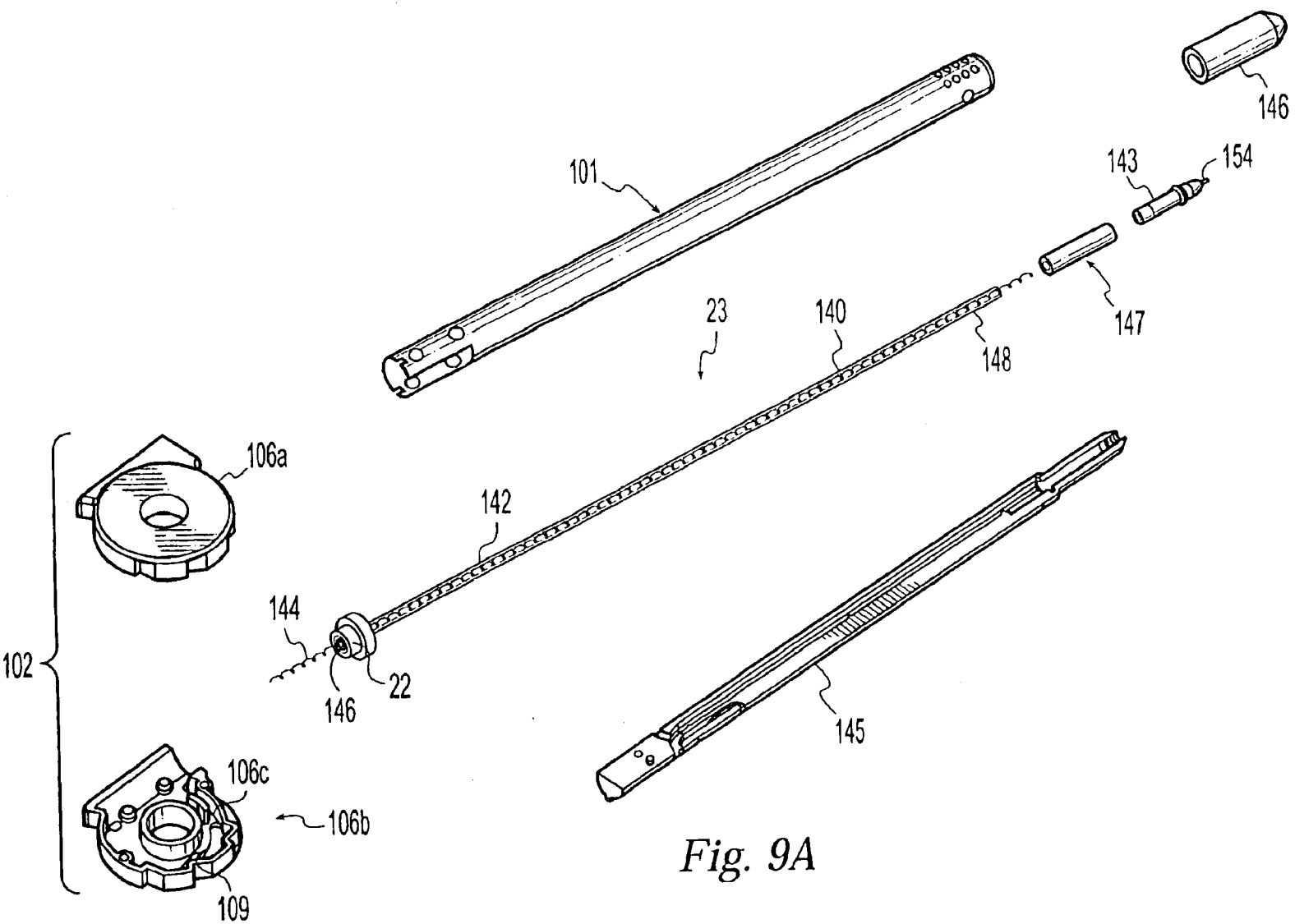
FIG. 9A is an exploded, partial, perspective view of various components of the wand assembly for use with the lighter of FIG. 1.

Referring to FIGS. 9 and 9A, wand assembly 10 includes wand 101 fixedly connected to a base member 102. The wand 101 is a cylindrical tube of metal that receives the conduit 23 (as shown in FIG. 1) and wire 28. The wand 101 also includes a tab 101*a* formed integrally therewith near the free end of the wand. Alternatively, a separate tab may be associated with wand.

Referring again to FIGS. 9 and 9A, base member 102 is receivable in a recess 104 formed in the second end 9 of housing 4. Recess 104 is located between the sides of housing 4, and therefore locates wand assembly 10 between these sides.

Base member 102 includes two body portions 106*a* and *b* and is generally cylindrical and defines a bore 108. According to the embodiment shown, body portions 106*a* and *b* define channels 106*c* so that when the body portions 106*a* and *b* are joined the channels 106*c* define a chamber 107 therein. One technique that can be used to join the base member pieces is ultrasonic welding. The present invention, however, is not limited to this configuration or construction of base member 102.

Figure 10:
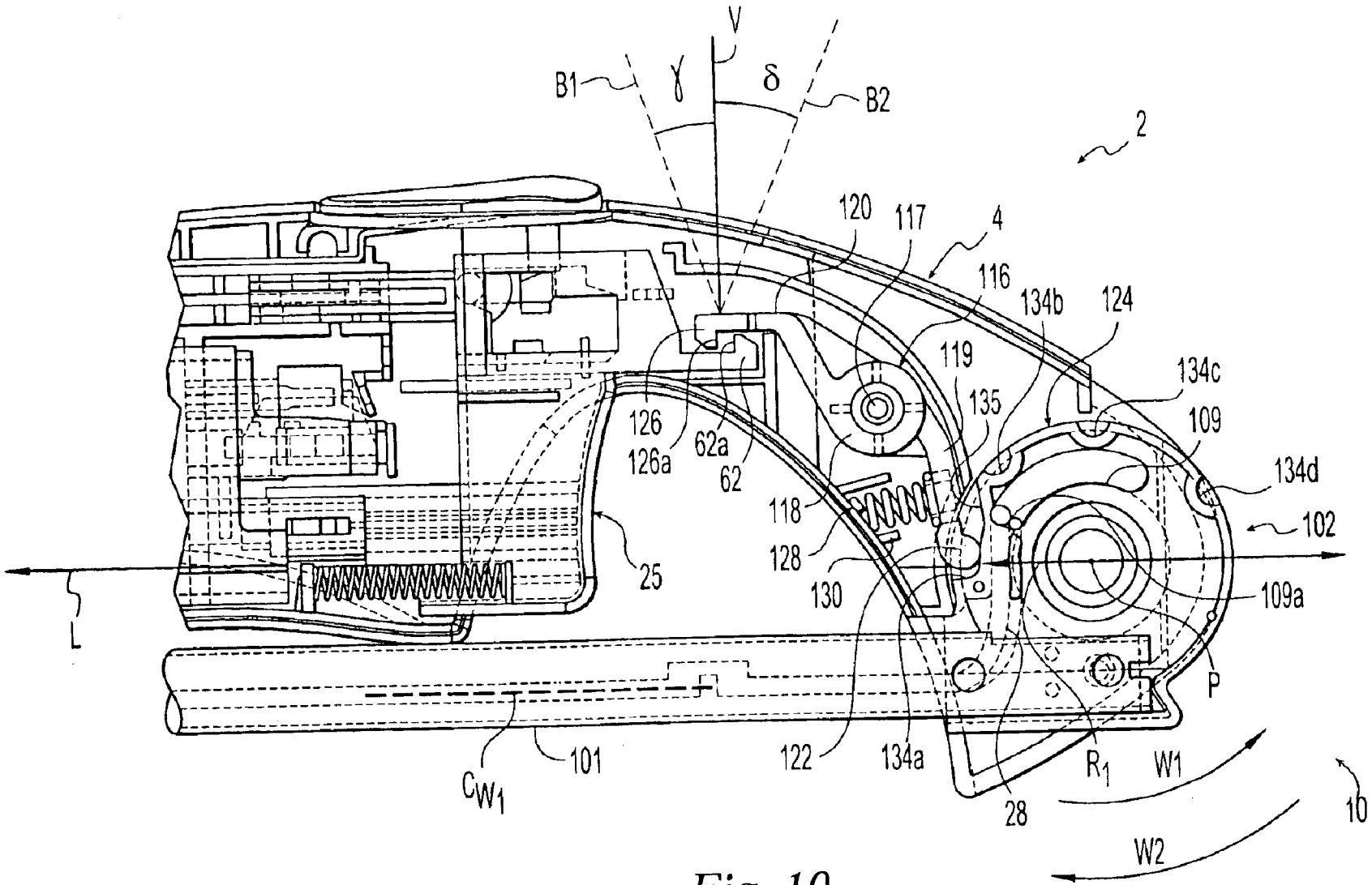
FIG. 10 is an enlarged, partial, side view of a front portion of the lighter of FIG. 1 showing the wand assembly in a closed position.

Body portion 106*b* defines an aperture 109 therein, as best seen in FIG. 10 aperture 109 is an arcuate slot, which extends through body portion 106*b* and is in communication with the channel 106*c* and chamber 107 (as shown in FIG. 9) formed therein. The function of the arcuate slot 109 will be discussed in detail below.

Referring again to FIG. 9, housing 4 includes a pair of axles 110*a* and 110*b* formed on an inner surface 112 thereof. Axle 110*a* is a male member and axle 110*b* is a female member. These axles 110*a,b* may be configured and dimensioned so that they snap-fit together when joined. Alternatively, axles 110*a,b* may be joined by ultrasonic welding or other methods of joining known to one of ordinary skill in the art. In another alternative, the axles 110*a,b* may be spaced apart. Once assembled, axles 110*a* and 110*b* extend into bore 108 to pivotally couple wand assembly 10 to housing 4. Axles 110 thus define a pivot axis P about which wand assembly 10 pivots. The pivot axis P is preferably transversely extending (i.e., extends from one side of the housing 4 to the other, not vertically extending from) and is perpendicular to a longitudinal axis L, however other orientations of pivot axis P are included within the present invention. Housing 4 may also includes spacers 113 formed on the inner surface 112 of housing 4, to support base member 102 in recess 104. Base member 102 may also include a pair of optional frictional members on opposite sides thereof. For example, a pair of rubber O-rings may be seated on opposite sides of base member and rest against spacers 113. The optional frictional members may be used to provide resistance against pivoting of wand assembly 10 about pivot axis P.

Referring back to FIG. 1, the lighter housing 4 further includes a vertical wall 4*f* at the front end 9. The base member 102 further includes a projection 106*d* extending generally radially therefrom. Cooperation between the wall 4*f* and the projection 106*d* prevents movement of the wand 101 in the direction W1 substantially beyond a fully-extended position, shown in FIG. 13. Furthermore, when wand assembly 10 is in the fully-extended extended position, a slight clearance may exist between vertical wall 4*f* and projection 106*d* of base member 102.

Referring to FIGS. 10–14, lighter 2 may be provided with a cam member 116 that releasably positions or retains wand assembly 10 at various positions from the closed position (shown in FIG. 10) to the fully-extended position (shown FIG. 13), and at various intermediate positions (shown in FIGS. 11 and 12) there between. Cam follower 116 also may prevent a user from moving, or more specifically sliding, trigger 25 sufficiently to ignite lighter 2 when wand assembly 10 is in the closed position of FIG. 10, and continues to prevent such sufficient movement of the trigger 25 until wand assembly 10 has been pivoted to a predetermined position, such as a position about 40° from closed, as discussed below. Such immobilization of trigger 25 may prevent the ignition of the lighter by preventing fuel release, or flame ignition. Flame ignition may be prevented, for example, by preventing creation of a spark.

Figure 15:
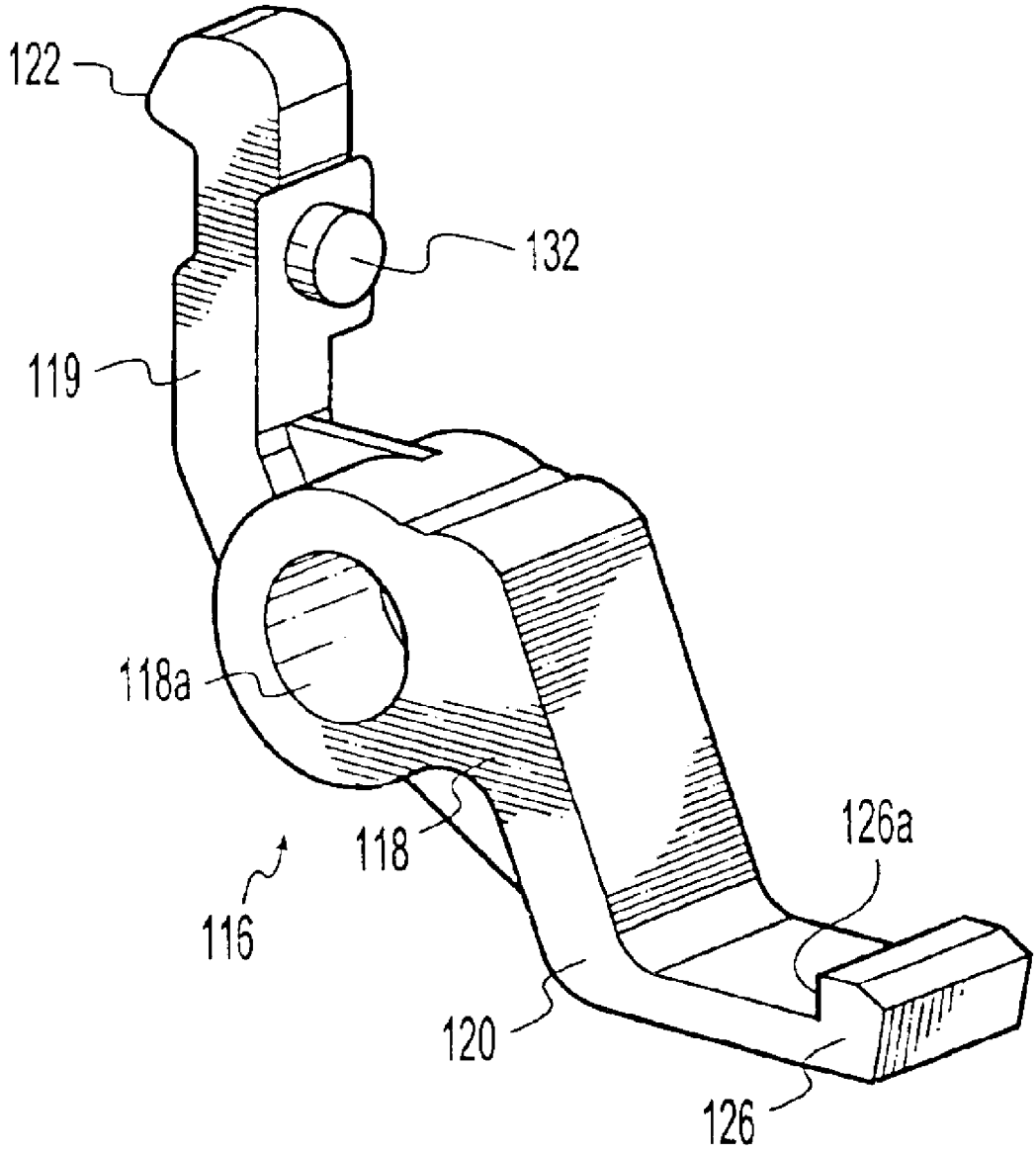
FIG. 15 is an enlarged, perspective view of a cam follower of the lighter of FIG. 1.

Referring to FIG. 15, cam follower 116 is rotatably mounted on a boss 117 (as best seen in FIG. 9) formed on housing 4. The cam follower 116 includes a hub 118 and first and second engaging portions 119, 120 extending from approximately opposite sides of the hub 118. Hub 118 includes a bore 118*a* for receiving boss 117. First portion 119 includes a follower end 122 for interacting with a camming surface 124 formed on base member 102 (see FIG. 9). Second portion 120 includes a second engaging surface 126*a* for contacting first engaging surface 62*a* (as shown in FIG. 10), which may be formed on trigger 25. While first and second surfaces 62*a*, 126*a* are shown as portions of hooks 62, 126, other forms of engaging surfaces known to one of ordinary skill in the art are also within the scope of the present invention. Hook 126 may alternatively engage with other elements of a lighter, such as a linking member, to prevent the creation a flame.

Referring again to FIG. 10, cam follower 116 is biased counter-clockwise by a biasing member 128, shown as a compression spring, such that follower end 122 contacts and follows camming surface 124. A seat 130 is formed on housing 4 and a lug 132 (shown in FIG. 15) is formed on first portion 119, to position biasing member 128 in place. The seat 130 and lug 132 may be formed on the opposite members in an alternative embodiment. In addition, biasing member 128, although shown as a coil spring, may alternatively be a torsion spring or a leaf spring, or any other type of biasing member known to be suitable by one of ordinary skill in the art. Follower end 124 may alternatively be biased against camming surface 124 by providing a cam follower 116 with resilient properties. For example, cam follower 116 may be a resilient member that is compressed in housing 2 such that follower end 122 is resiliently biased against camming surface 124.

Camming surface 124 is an undulating surface and includes a series of first engaging portions 134*a–d*, shown as detents 134*a–d*, First engaging portions 134*a–d* may engage a follower end 122 of the first engaging portion 119. Detents 134*a–d* are shown as indentations formed in base member 102, which may receive an outward protrusion on follower end 122 such that follower end 122 is displaced radially inward causing cam follower 116 to rotate clockwise about boss 117. In the embodiment shown, the first detent 134*a* is a sloped cutout larger than the remaining detents 134*b–d*, which are concave cutouts. The detent 134*a* includes a sloped surface portion 135 to provide a low pressure angle as follower end 122 rides along camming surface 124 within the first detent 134*a*. As a result of this low pressure angle, biasing member 128 is gradually compressed as base member 102 is rotated clockwise and follower end 122 moves from the first detent 134*a* toward the second detent 134*b*, thus providing a smooth and gradual feel to the user as the wand assembly 10 is pivoted away from the closed position. This low pressure angle also reduces wear and stresses on cam follower 116 and base member 102.

The present invention is not to be limited to the shape and configuration of detents 134*a–d* shown, and detents 134*a–d* may alternatively be, for example, bumps, ridges or protrusions formed on base member 102 that engage follower end 122 and displace it radially outward, causing cam follower to rotate counter-clockwise. The present invention is also not limited to the number and location of the detents shown. Furthermore, the present invention is also not limited to the shape and configuration of cam follower 116 and ends 122 and 126. The configurations of the cam follower 116, ends 122, 126 and detents 134*a–d* may change, for example, to vary the force necessary to move the wand assembly 10. The configurations of the cam follower 116, ends 122, 126 and detents 134*a–d* may also change, for example, to vary the force necessary to hold the wand assembly in any closed or extended position including the intermediate positions.

Still referring to FIG. 10, lighter 2 is shown with wand assembly 10 in the closed position. In this position, follower end 122 is biased into first detent 134*a*, and located at a first radial distance $R_1$ from pivot axis P. Because first detent 134*a* includes sloped surface portion 135, wand assembly 10 must be pivoted a predetermined distance, preferably about 40°, before hook 126 is disengaged from hook 62. When wand assembly 10 is in the closed position, or pivoted less than the predetermined distance, hook 126 is aligned with hook 62 of trigger 25 such that hook walls 62*a* and 126*a* will engage upon depression of trigger 25. Hooks 62, 126 may be spaced apart or otherwise configured so that trigger 25 may be partially depressed, but not depressed sufficiently to ignite lighter 2, or alternatively so that trigger 25 may not be depressed at all.

Hook walls 62*a* and 126*a* contact when hooks 62, 126 engage one another. Hook walls 62*a*, 126*a* are shown oriented substantially parallel to vertical axis V, which is perpendicular to longitudinal axis L and pivot axis P. This configuration of the hooks 62, 126 increases the force necessary to depress the trigger 25 sufficiently to ignite the lighter.

Hook walls 62*a*, 126*a* may alternatively be angled. For example, hook walls 62*a*, 126*a* may be angled to be substantially parallel to line B1, which is angularly offset from vertical axis V by angle γ, such that hooks 62, 126 interlock. Such a configuration of the hooks would increase the force necessary to depress the trigger 25 sufficiently to ignite the lighter. The force necessary in the interlocked configuration may be greater than the force necessary in the vertical wall configuration.

Hook walls 62*a*, 126*a* may alternatively be angled to be substantially parallel to line B2, which is angularly offset from vertical axis V by angle δ. With application of a predetermined force, such hooks may deflect and disengage. Such a configuration of the hooks would increase the force necessary to depress the trigger 25 sufficiently to ignite the lighter, but to a lesser extent than if the walls 62*a* and 126*a* were vertical or at an angle γ.

According to the embodiment shown in FIG. 10 of hooks 62 and 126, trigger 25 may be depressed sufficiently to ignite lighter 2 when wand assembly 10 is in the closed position, however a greater amount of force will be required to do so than when wand assembly 10 is pivoted to the extended position or one of the intermediate positions therebetween due to the interaction between hooks 62 and 126. The amount of additional force required to depress trigger 25 sufficiently to ignite lighter 2 when wand assembly 10 is in the closed position may vary, for example, by varying the angle of hook walls 62*a*, 126*a* and/or varying the materials used to form hooks 62, 126.

Wand assembly 10 provides resistance against unintentional pivoting when in the closed position, because pivoting of wand assembly 10 toward the extended position, or in first direction W1, would cause follower end 122 to ride along sloped surface 135 and compress biasing member 128. Thus, in order to pivot wand assembly 10 when wand assembly 10 is positioned in the closed position, a user must apply enough force to wand assembly 10 to cause follower end 122 to ride on sloped surface 135 and compress biasing member 128.

One of ordinary skill in the art will know and appreciate that the amount of force required may also be varied by selecting a biasing member 128 with a specific spring constant and/or modifying the geometry of camming surface 124. As a result of this feature, the wand assembly 10 is releasably retained in the closed position. Referring to FIG. 1, the lighter 2 may further include optional projections (not shown) within recess 4*f* of the housing 4 for releasably retaining the wand 101 in the closed position.

Figure 10A:
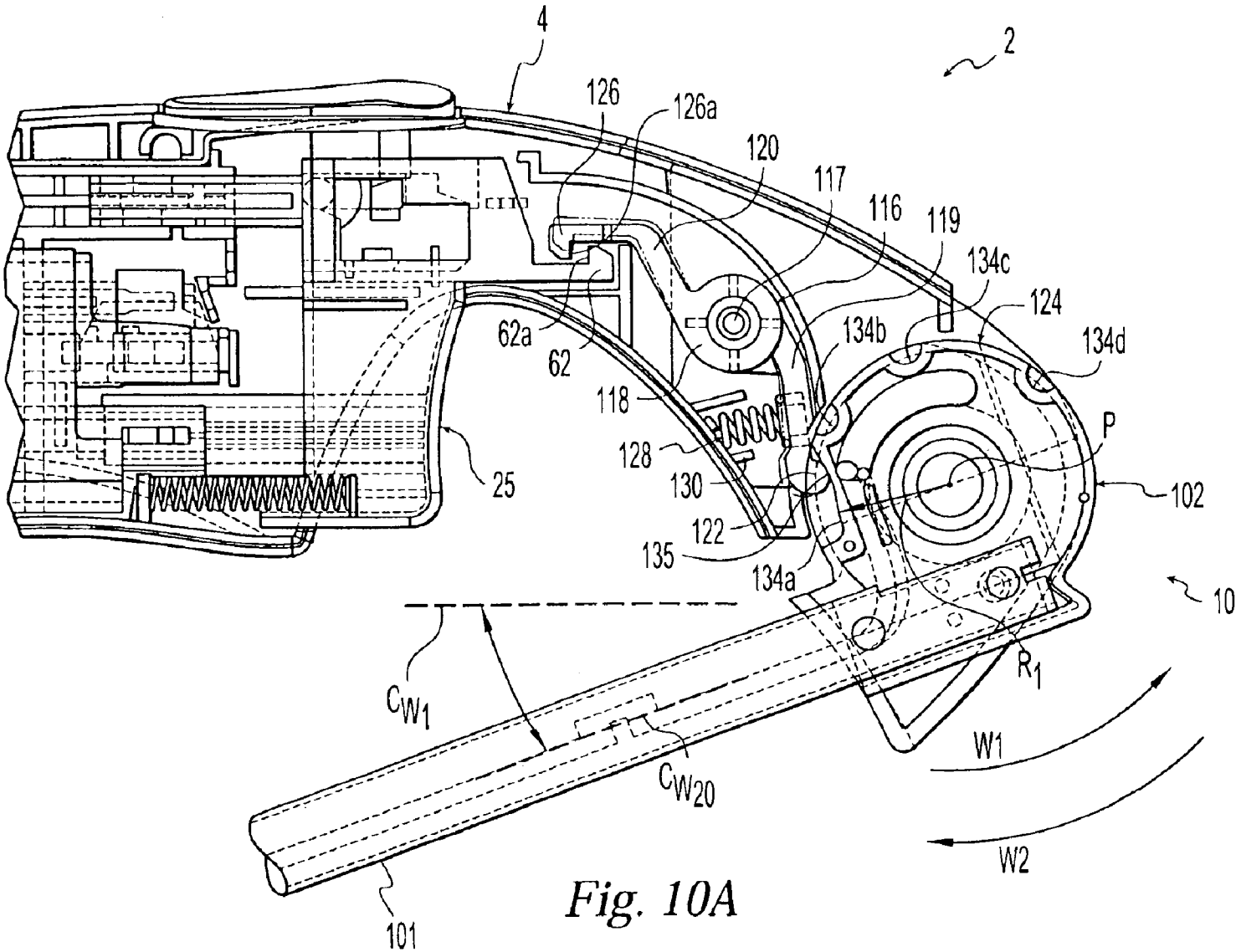
FIG. 10A is an enlarged, partial, side view of the front portion of the lighter of FIG. 10 showing the wand assembly partially-extended and pivoted by about 20°.
Figure 11:
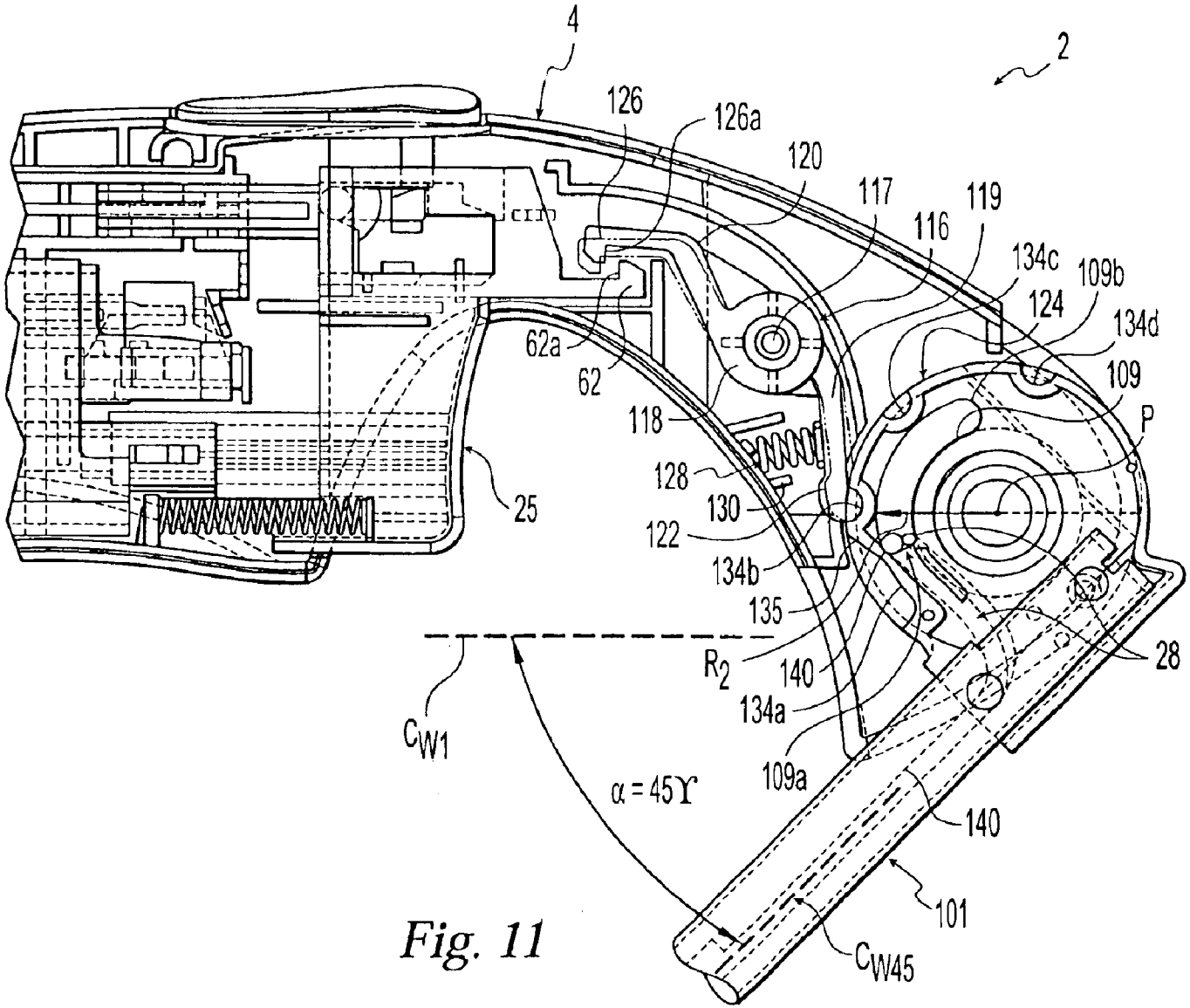
FIG. 11 is an enlarged, partial, side view of the front portion of the lighter of FIG. 10 showing the wand assembly partially-extended and pivoted by about 45°.
Figure 12:
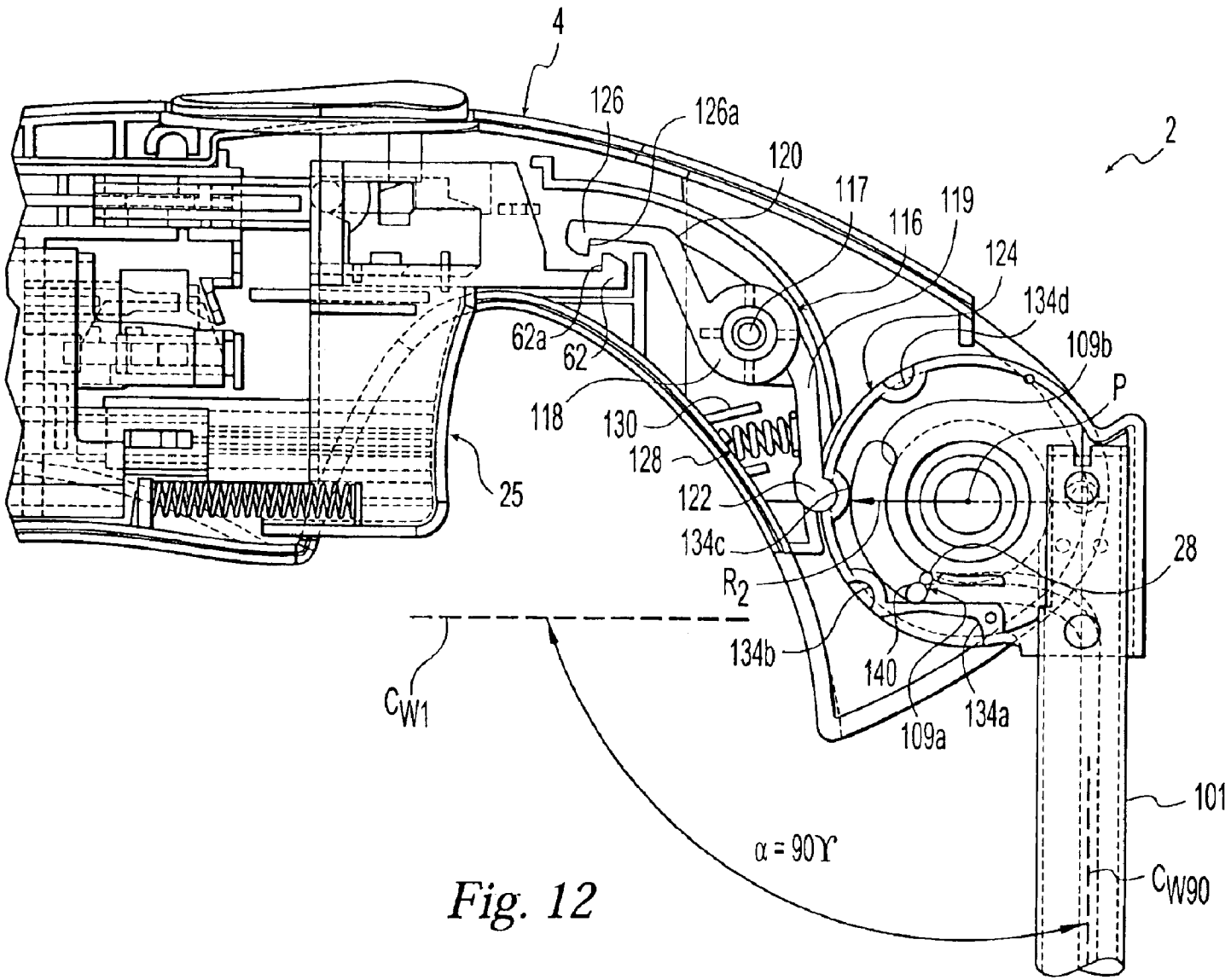
FIG. 12 is an enlarged, partial, side view of the front portion of the lighter of FIG. 10 showing the wand assembly partially-extended and pivoted by about 90°.

Referring to FIGS. 10A, 11 and 12, lighter 2 is shown with wand assembly 10 located in partially-extended or intermediate positions. In the initial position, as shown in FIG. 10, the wand assembly has a central axis $C_{W1}$, In the first intermediate position, as shown in FIG. 10A, wand assembly 10 is pivoted through a pivot angle of $\alpha$ of about 20°. The pivot angle $\alpha$ is defined between the wand 101 initial central axis $C_{W1}$ and the central axis $C_{W20}$ of the illustrated position with the follower end 122 (as shown in phantom) in the first detent 134*a*.

In the second intermediate position, as shown in FIG. 11, wand assembly 10 is pivoted through a pivot angle of $\alpha$ of about 45°. The pivot angle $\alpha$ is defined between the wand 101 initial central axis $C_{W1}$and the central axis $C_{W45}$ of the illustrated position with the follower end 122 in the second detent 134*b*.

In the third intermediate position, as shown in FIG. 12, wand assembly 10 is pivoted through a pivot angle of $\alpha$ of about 90°. The pivot angle $\alpha$ is defined between the wand 101 initial central axis $C_{W1}$ and the central axis $C_{W90}$ of the illustrated position with the follower end 122 in the third detent 134*c*.

Figure 14:
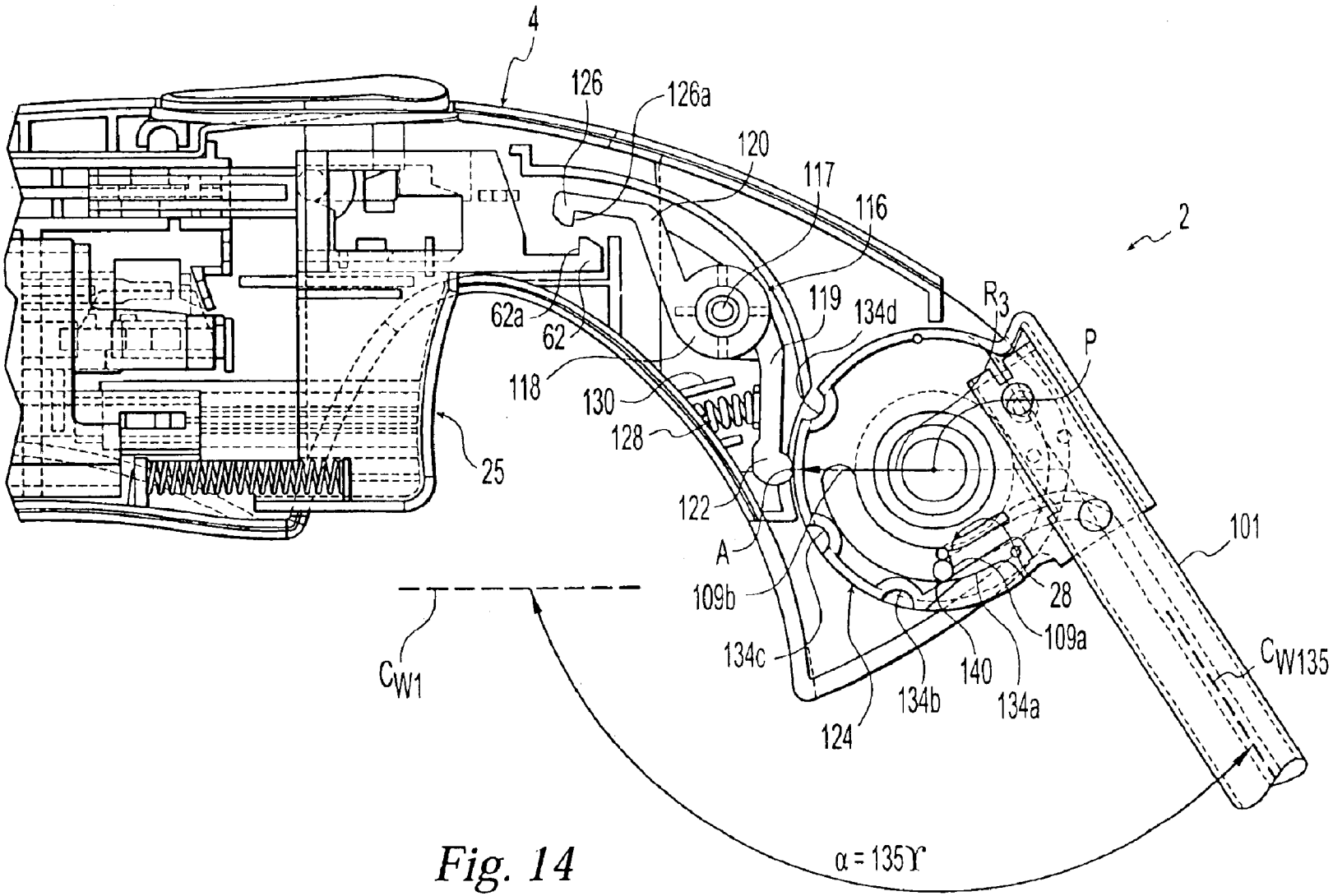
FIG. 14 is an enlarged, partial, side view of the front portion of the lighter of FIG. 10 showing the wand assembly partially-extended and pivoted by about 135°.

In the fourth intermediate position, as shown in FIG. 14, wand assembly 10 is pivoted through a pivot angle of $\alpha$ of about 135°. The pivot angle $\alpha$ is defined between the wand 101 initial central axis $C_{W1}$ and the central axis $C_{W135}$ of the illustrated position with the follower end 122 between the third detent 134*c* and the fourth detent 134*d*.

Figure 13:
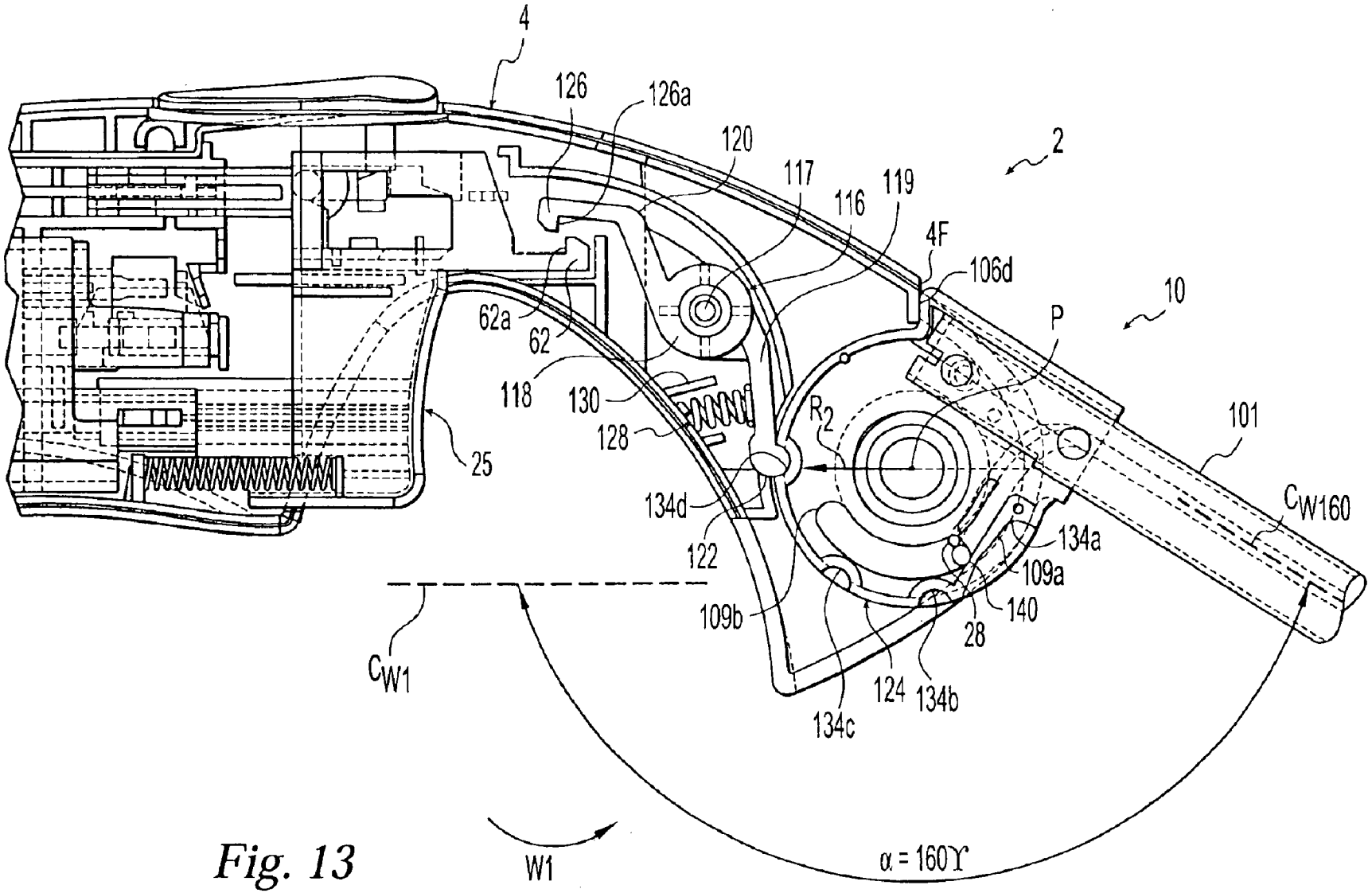
FIG. 13 is an enlarged, partial, side view of the front portion of the lighter of FIG. 10 showing the wand assembly fully-extended pivoted by about 160°.

In the fully-extended position, as shown in FIG. 13, wand assembly 10 is pivoted through a pivot angle of $\alpha$ of about 160°. The pivot angle $\alpha$ is defined between the wand 101 initial central axis $C_{W1}$ and the central axis $C_{W160}$ of the illustrated position with the follower end 122 in the fourth detent 134*d*.

Referring to FIG. 10A, the cam follower 116 is shown in solid lines in its initial position, and shown in phantom lines in its radially displaced position. With the wand 101 at an angle of 20° from its initial position, follower end 122 (as shown in phantom) is in contact with sloped surface 135 within detent 134*a* and cam follower 116 is slightly rotated about boss 117, however hook 126 (as shown in phantom) and hook 62 are sufficiently aligned to engage upon depression of trigger 25. Thus, in this position, the trigger 25 cannot be moved sufficiently to ignite lighter 2 without applying a force greater than the force sufficient to ignite the lighter in the remaining intermediate positions (shown in FIGS. 11–12 and 14) and the closed position (shown in FIG. 13).

Referring to FIGS. 11–13, in these positions the follower end 122 is disposed within the second, third and fourth detents 134*b*, 134*c*, 134*d*, respectively, which are all located at a second radial distance $R_2$ from pivot axis P. Second radial distance $R_2$ is greater than first radial distance $R_1$ (shown in FIG. 10) and, as a result, when wand assembly 10 is pivoted from the closed position, discussed above, to the intermediate and fully-extended positions, follower end 122 is displaced toward the first end 8 (shown in FIG. 1) of housing 4, causing cam follower 116 to rotate clockwise about boss 117 and rotate hook 126 out of alignment with hook 62. Thus, in these three positions, hook walls 62*a* and 126*a* will not engage upon full depression of trigger 25. In FIG. 11, the cam follower 116 is shown in phantom lines in its initial position, and shown in solid lines in its radially displaced position. In FIGS. 12–14, the cam follower 116 is shown in its other radially displaced positions.

Wand assembly 10 exhibits variable resistance against pivoting. When wand assembly 10 is in one or more high-wand-force positions, such as, for example, the closed position (shown in FIG. 10), extended position (shown in FIG. 13), and certain intermediate positions (shown in FIGS. 11–12) between the closed and extended positions, follower end 122 contacts one of the detents 134*a*–*d*, When in any of these high-wand-force positions, pivoting of wand assembly 10 causes first portion 119 to compress biasing member 128 as follower end 122 rides along camming surface 124 and is displaced radially outward by the second, third or fourth detents, 134*b*, 134*c*, 134*d*, respectively. The force necessary for wand movement from the closed position is less that the force necessary for wand movement from the positions shown in FIGS. 11–13 since the detent 134*a* has a sloped surface portion 135. As mentioned above, a user must therefore exert sufficient force on wand assembly 10 to compress biasing member 128 and move follower 122 out of the detent, in order to pivot wand assembly 10. Lighter 2 can thus be selectively and releasably positioned or retained and stabilized at whichever of the intermediate or extended positions is most suitable. For example, the intermediate positions may be suitable for lighting jarred candles, and the fully-extended position may be suitable for lighting a barbeque grill. One of ordinary skill in the art will know and appreciate that cam surface 124 may be provided with any number of detents 134*a*–*d* spaced apart at various intervals to provide a wand assembly 10 with any number and combination of different closed, intermediate, and fully-extended positions. One of ordinary skill in the art will also know and appreciate that any number of high-force and low-wand-force positions may be located between the closed and fully-extended positions. Furthermore, the closed position may be a high-wand-force position or a low-wand-force position, and the fully-extended position may also be a high-force position or a low-wand-force position.

Referring to FIG. 14, lighter 2 is shown with wand assembly 10 in a low-wand-force position. In the low-wand-force position shown, wand assembly 10 is partially-extended and located at an angle of about 135° from the closed position. Follower end 122 is biased against camming surface 124 between the third detent 134*c* and the fourth detent 134*d* at point A, and is located at a third radial distance $R_3$ from pivot axis. Third radial distance $R_3$ is the nominal radius of camming surface 124 and thus, follower end 122 is located at third radial distance $R_3$ from pivot axis P whenever follower end 122 is not aligned with one of the detents 134*a*–*d*, Third radial distance $R_3$ is larger than first radial distance $R_1$ and second radial distance $R_2$, and as a result, positions follower end 122 such that hook 126 is rotated out of engagement with hook 62. Thus, when follower end 122 contacts camming surface 124 between the detents 134*a*–*d*, trigger 25 may be depressed to ignite the lighter. As discussed above, trigger 25 is therefore only immobilized sufficiently to prevent ignition of lighter 2 when wand assembly 10 is in or within about 40° of the closed position. In an alternative embodiment, this angle may vary.

Still referring to FIG. 14, wand assembly 10 is shown in a low-wand-force position, where follower end 122 contacts cam surface 124 between detents 134*c* and *d*. Follower end 122 is thus out of contact with detents 134*c* and *d*. In this position, less force is required to pivot wand assembly 10 than when in a high-wand-force position with follower end 122 received in detents 134*a–d*, When in a low-wand-force position, wand assembly 10 still provides some resistance against pivoting because biasing member 128 is at its maximum state of compression and therefore biases follower end 122 against camming surface 124, and creates frictional forces between follower end 122 and camming surface 124 upon pivoting of wand assembly 10. Thus, when wand assembly 10 is in a low-wand-force position, a user must only apply a low force sufficient to overcome these frictional forces in order to pivot wand assembly 10. The high-wand-force position requires more force to pivot wand assembly 10 than the low-wand-force position because the user must provide additional force to further compress biasing member 128 and move the follower 122 out of the detents 134*a–d*, The wand assembly 10 is similarly in low-wand-force positions when the follower 122 is located between detents 134*a* and *b* and detents 134*b* and *c*.

The geometry of the detents 134 and the follower end 122 may be varied to increase or decrease the amount of force required to pivot wand assembly 10 when in a high-wand-force position. For example, the detents may be relatively deep and of a size and shape that closely matches follower end 122, thus requiring a large increase in force when in a high-wand-force position. Alternatively, the detents may be relatively shallow and oversized with respect to follower end 122 to provide a small increase in force when in a high-wand-force position.

Referring to FIGS. 10 and 13, movement of the wand 101 in a second direction W2 opposite from the first direction W1 allows the wand 101 to be moved toward the closed position. The wand 101 acts as discussed above when moved toward the closed position, in that it is releasably retained in the intermediate positions (shown in FIGS. 11 and 12) during movement.

Referring again to FIG. 9A, one embodiment of a conduit 23 for use with lighter 2 of FIG. 1 is shown. Conduit 23 includes a flexible tube 140 defining a channel 142 for fluidly connecting fuel supply unit 11 to nozzle 143. Flexibly tube 140 thus transports fuel F (as shown in FIG. 1) from the fuel supply unit 11 to nozzle 143. A suitable material for flexible tube 140 is plastic. An un-insulated, electrically conductive wire 144 is disposed in channel 142, and extends from a first end 146 of tube 140 to a second end 148 of tube 140. A suitable material for electrically conductive wire 144 is copper or the like. In this embodiment, the wire 144 may be at least partially coiled. The coils may be more closely packed in some sections than other sections. In an alternative embodiment, the wire 144 may not be coiled. Fuel connector 22 is coupled to first end 146 of tube 140. Nozzle 143 is connected to second end 148 of tube 140 by nozzle connector 147. Wire 144 thus acts as an electrical conductor to pass an electrical charge to nozzle 143 to generate a spark to ignite the fuel. The wire 144 may also reinforce flexible tube 140 to provide resistance to kinking.

The conduit 23, connector 147 and nozzle 143 are supported within a pair of guide and insulator members 145, one being shown. One the pair of members 145 are positioned around these components an isolator 146 is disposed over the end of the members 145. Then the wand 101 is disposed thereon.

Figure 16A:
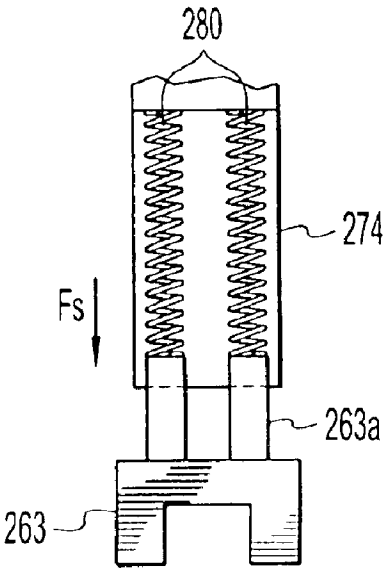
FIG. 16A is a schematic, top view of a portion of the piston member, plunger member and high-force spring of the lighter shown in FIG. 16.
Figure 16:
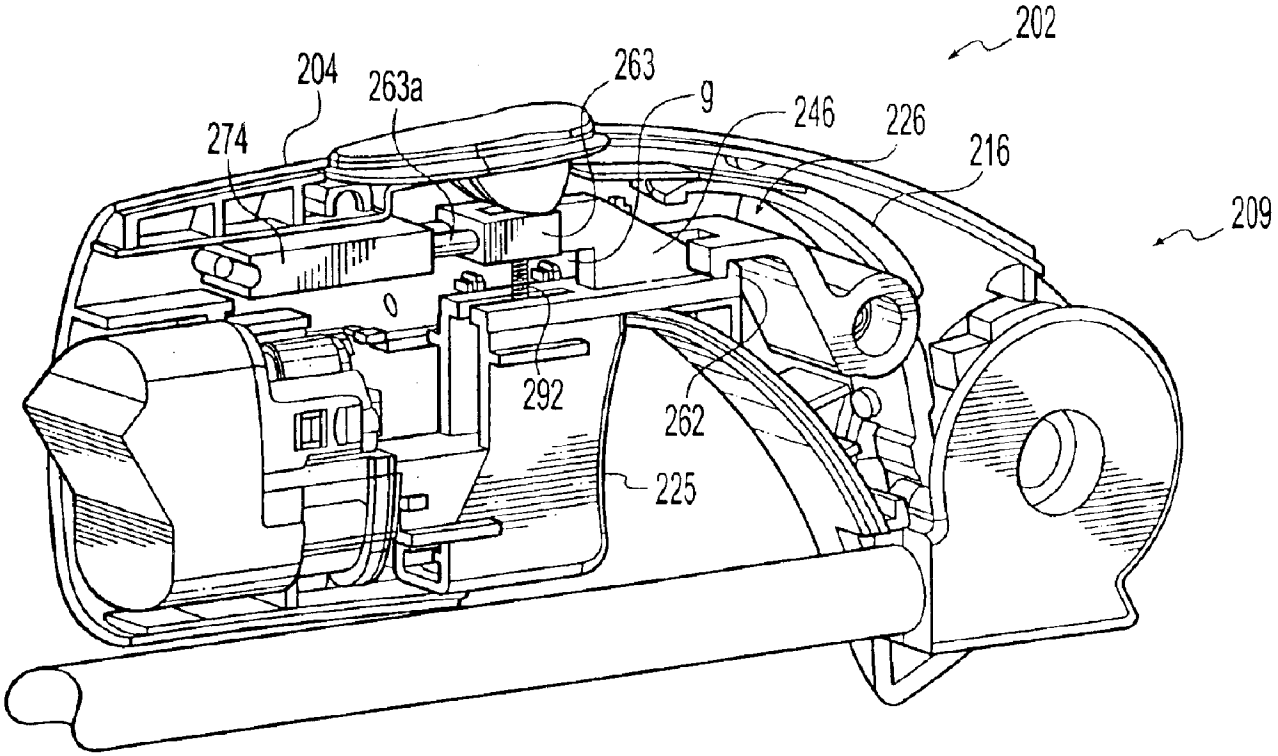
FIG. 16 is a cut-away, partial, side view of a second embodiment of the lighter of the present invention, wherein the trigger and latch member are in initial states and the plunger member is in a high-actuation-force position.

As shown in FIGS. 1–1B and 16, the tube 140 is supported within bore 20*b* of retainer 20 and joined to fuel connector 22 so that wire 144 extends through fuel connector 22 and is in electrical contact with electrode 15*b*. The second end 148 of tube 140 is connected to nozzle 143 located adjacent the tip 152 of wand 101. Tube 140 thus conveys fuel F from the fuel supply unit 11 to the nozzle 143 at tip 152 of wand assembly 10 via channel 142. Nozzle 143 may optionally include a diffuser 154, preferably in the form of a coil spring.

Referring to FIGS. 1 and 11, conduit 23 and wire 28 run from the inside of housing 4, through at least a portion of wand assembly 10. Wire 28 is electrically connected adjacent to the end of metal wand 101 coupled to base member 102. Wire 28 may be at least partially coiled around tube 140. The conduit 23 extends to the nozzle 143. To better facilitate pivoting of wand assembly 10 with respect to housing 4, the conduit 23 and wire 28 extend through an aperture 109 in base member 102, and through the chamber 107 (as shown in FIG. 9) within base member 102. Aperture 109 is preferably spaced apart from pivot axis P. Thus, as wand assembly 10 pivots with respect to housing 4, conduit 23 and wire 28 slide within arcuate slot 109 from end 109*a* to end 109*b*. The length of conduit 23 and wire 28 also allow the wand 101 to pivot.

Once the wand assembly 10 is moved to the partially-extended or fully-extended positions, the lighter 2 may be operated in two different modes. Referring to FIG. 5, each mode is designed to resist undesired operation by unintended users in different ways. The first-operative mode or high-actuation-force mode (i.e., the high-force mode) and the second mode of operation or low-actuation-force mode (i.e., the low-force mode) are configured so that one mode or the other may be used. The high-force mode of lighter 2 provides resistance to undesirable operation of the lighter by unintended users based primarily on the physical differences, and, more particularly, the strength characteristics of unintended users versus some intended users. In this mode, a user applies a high-actuation or high-operative force to the trigger 25 in order to operate the lighter. Optionally, the force which is necessary to operate the lighter 2 in this mode may be greater than unintended users can apply, but within the range which some intended users may apply.

The low-force mode of lighter 2 provides resistance to undesirable operation of the lighter by unintended users based more on the cognitive abilities of intended users than the high-force mode. More specifically, the second mode provides resistance due to a combination of cognitive abilities and physical differences, more particularly the size characteristics and dexterity between intended users and unintended users.

The low-force mode may rely on the user operating two components of the lighter to change the force, from the high-actuation force to the low-actuation force, which is required to be applied to the trigger to operate the lighter. The low-force mode may rely on a user repositioning a plunger member 63 from a high-actuation-force position to a low-actuation-force position. The user may move the plunger member 63 by depressing a latch member 34. After moving the plunger member, the user may operate the lighter by applying less force to the trigger. The low-force mode may rely on a combination of the physical and cognitive differences between intended and unintended users such as by modifying the shape, size or position of the latch member in relation to the trigger, or alternatively, or in addition to, modifying the force and distance required to activate the latch member and the trigger. Requiring the trigger and latch member to be operated in a particular sequence also may be used to achieve the desired level of resistance to unintended operation.

Referring to FIG. 5, one embodiment of a lighter 2 having a high-force mode and a low-force mode will be described. The lighter of FIGS. 3 and 5 has a movable plunger member 63, operatively associated with latch member 34.

In an initial or rest position in the high-force mode, as shown in FIG. 5, the plunger member 63, and more particularly portions 66 are disposed within portion 56*b* of cutout 56 defined in trigger 25. The wall 66*a* of plunger member 63 contacts vertical wall 56*c* of slot 56 and is thus in a high-actuation-force position. When a user attempts to actuate trigger 25, vertical wall 66*c* applies a force to vertical wall 66*a* which applies a force to piston member 74, which thru wall 76*a* moves to compress spring 80. Spring 80 applies a spring force $F_S$ which opposes movement of the trigger 25. In the initial position, the spring 80 is uncompressed and has a length has a length of D1.

In this embodiment, the length D1 is substantially equal to the space between support 4*d* and piston member 74 end wall 76*a*. In another embodiment, the length D1 can be greater than this space so that the spring 80 is compressed and pre-loaded when installed or the length D1 can be less than this space.

To actuate the lighter in this high-force mode, i.e., when the portions 66 are disposed in slot portion 56*b*, a user applies at least a first trigger force $F_{T1}$ to the trigger 25 which is substantially equal to or greater than the sum of a spring force $F_S$, and all additional opposing forces $F_{OP}$. (not shown). The spring force $F_S$ may comprise the force necessary to compress the spring 80. The opposing forces $F_{OP}$ may comprise the forces applied by the various other elements and assemblies which are moved and activated in order to operate the lighter, such as the spring force from the return spring 30 (see FIG. 1B) in piezoelectric unit 26, the force to compress spring 53, and the frictional forces caused by the movements of the actuating member, and any other forces due to springs and biasing members which are part of or added to the actuating member or actuating assembly, fuel container, or which are overcome to actuate the lighter. The particular forces $F_{OP}$ opposing operation of the lighter would depend upon the configuration and design of the lighter and thus will change from one lighter design to a different lighter design. In this mode, if the force applied to the trigger is less than a first trigger force $F_{T1}$, ignition of the lighter does not occur.

Figure 6:
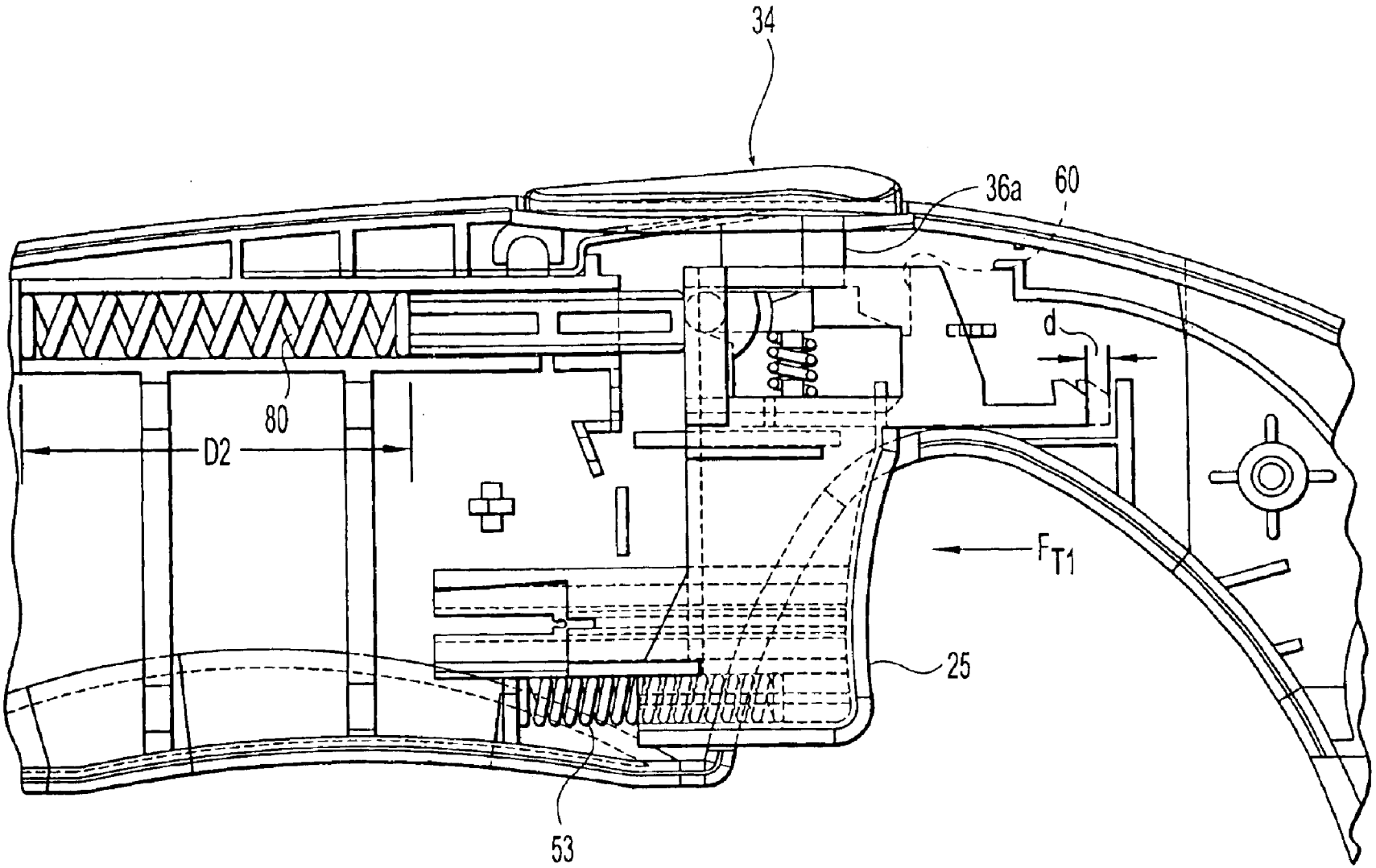
FIG. 6 is an enlarged, partial, side view of the lighter of FIG. 1, where the plunger member is in the high-actuation-force position and the trigger is in a depressed position.

As shown in FIG. 6, when a user applies a force to the trigger 25 at least substantially equal to or greater than the first trigger force $F_{T1}$, the trigger 25 moves the distance d, and the plunger member 63 and piston member 74 compress spring 80. This movement of the trigger 25, with reference to FIG. 1B, causes the upper and lower portions 26*a,b* of the piezoelectric unit 26 to compress together, thereby causing the cam member 32 on the upper portion 26*a* to move, which moves the valve actuator 14 to act on jet and valve assembly 15 to move valve stem 15*a* forward to release the fuel F from compartment 12*a*. When the cam member 32 contacts the valve actuator 14 electrical communication occurs between the piezoelectric unit 26 and the wire 144 (as shown in FIG. 9A). Further depression of the trigger 25 causes a hammer (not shown) within the piezoelectric unit to strike a piezoelectric element (not shown), also within the piezoelectric unit. Striking the piezoelectric element or crystal, produces an electrical impulse that is conducted along wire 28 (as shown in FIG. 1) to wand 101 to the tab to create a spark gap with nozzle 143. A spark also travels from the cam member 32 to valve actuator 14, then to valve stem 15*a* and then to jet 15*a* then electrode 15*b* and wire 144 and to connector 150, and nozzle 143. An electrical arc is generated across the gap between the nozzle 143 and the wand 101, thus igniting the escaping fuel.

In the high-actuation-force mode when the trigger 25 is depressed, the spring 80 has a length D2 (as shown in FIG. 6) less than the length D1 (as shown in FIG. 5). During this mode of operation, the latch member 34 remains substantially in the original position and boss 36*a* does not hinder trigger 25 movement due to its location and forward movement in slot 60.

When the trigger 25 is released, the return spring 30 (as shown in FIG. 1B) within the piezoelectric mechanism 26 and the springs 53 and 80 move or assist in moving the piston member 74, plunger member 63 and trigger 25 into their initial, at rest, positions. Spring 16 (as shown in FIG. 1B) biases valve actuator 14 to close jet and valve assembly 15 and shut off the supply of fuel. This extinguishes the flame emitted by the lighter. As a result, upon release of the trigger 25, the lighter automatically returns to the initial state, where the plunger member 63 remains in the high-actuation-force position (as shown in FIG. 5), which requires a high-actuation-force to actuate the trigger.

The lighter may be designed so that a user would have to possess a predetermined strength level in order to ignite the lighter in the high-actuation-force mode. The lighter optionally may be configured so that a user may ignite the lighter in the high-actuation-force mode with a single motion or a single finger.

Figure 7:
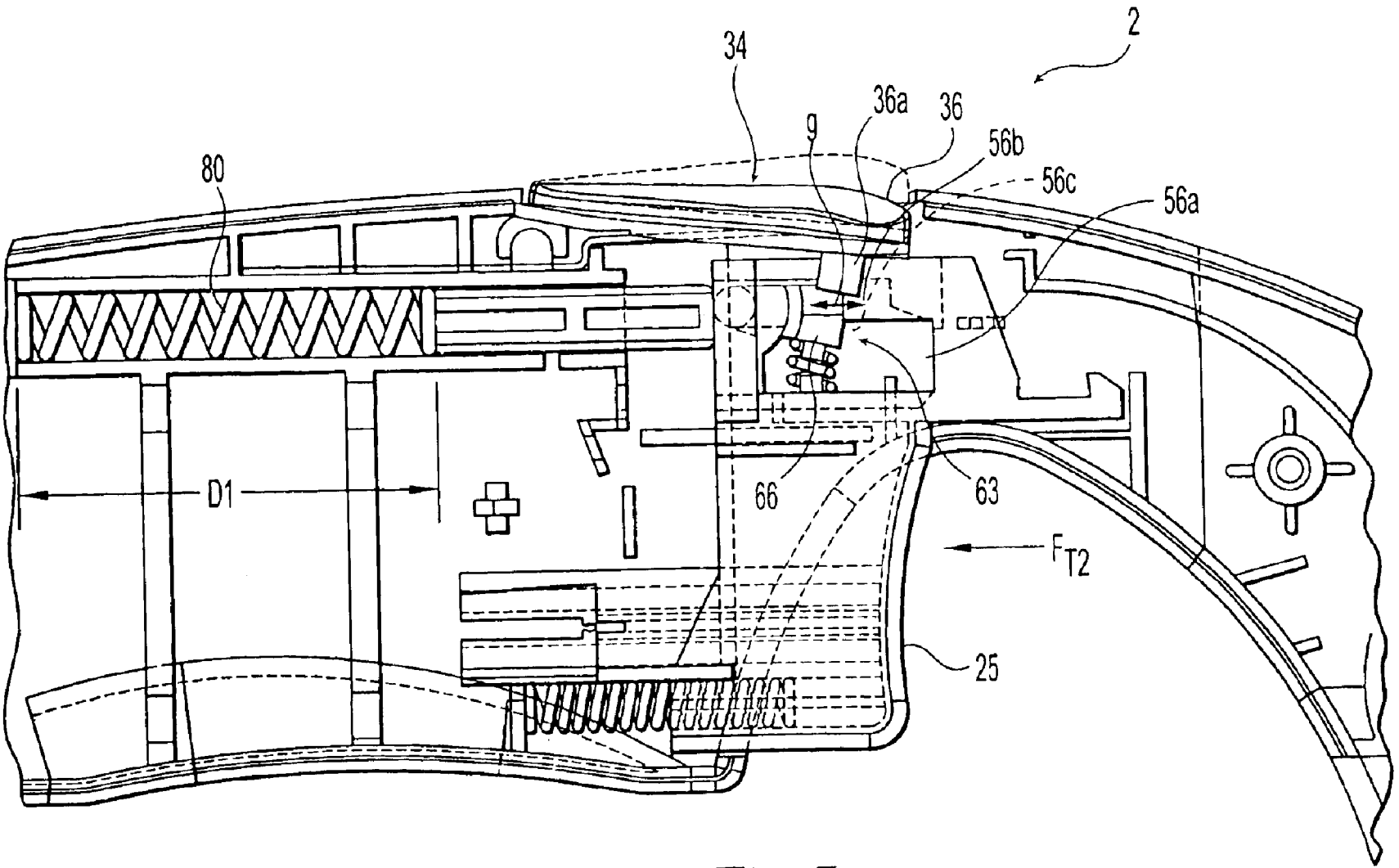
FIG. 7 is an enlarged, partial, side view of the lighter of FIG. 1, where the latch member is depressed, the plunger member is in a low-actuation-force position and the trigger is in the initial position.

Alternatively, if the intended user does not wish to use the lighter by applying a high first trigger force $F_{T1}$ (i.e., the high-actuation-force) to the trigger, the intended user may operate the lighter 2 in the low actuation-force mode (i.e., the low-force mode), as depicted in FIG. 7. This mode of operation comprises multiple actuation movements, and in the embodiment shown, the user applies two motions to move two components of the lighter for actuation. If the pivotal wand assembly 10 (as shown in FIG. 1) and the cam follower 116 are incorporated into the lighter, operation of the lighter in the low-actuation-force mode may include three motions, including moving the wand assembly to an extended position.

In the lighter of FIG. 7, the low-force mode includes repositioning the plunger member 63 downward such that spring 80 does not oppose motion of the trigger 25 to the same extent as in the high-force mode. In the low-force mode, a force substantially equal to or greater than second trigger force $F_{T2}$ (i.e., a low-actuation-force) is applied to the trigger 25 to ignite the lighter in conjunction with depressing the latch member. In this mode of operation, the second trigger force $F_{T2}$ is preferably less, and optionally significantly less, than the first trigger force $F_{T1}$.

As shown in FIG. 7, to operate the lighter 2 in the low-force mode of this embodiment includes depressing the free end 36 of the latch member 34 from the initial position (shown in phantom) toward the trigger 25 to a depressed position. Due to the operative association between the latch member 34 and the plunger member 63, downward movement of the latch member 34 moves boss 36*a* which in turn moves front end of the plunger member 63 downward. When the latch member 34 and plunger member 63 are in their depressed positions, the recess 70 (as shown in FIG. 3) receives boss 36*a* of latch member and recess 70 provides a horizontal contact surface for the boss in this position.

The latch member may be partially or fully depressed with different results. Depending on the configuration of the lighter components, if latch member is partially depressed, the wall 66*a* may be in contact with or adjacent the vertical wall 56*c*. If the latch member 34 is depressed so that the wall 66*a* is in contact with or adjacent the vertical wall 56*c* of the trigger 25, the lighter 2 is still in the high-force mode. If the latch member 34 is depressed so that the wall 66*a* is equal to or below wall 56*c* the lighter can slip into the low-force mode or is in the low-force mode. In some configurations, the lighter may be designed so that when the latch member 34 is fully depressed, the plunger member 63 is completely out of contact with (e.g., below) upper portion 46 (as shown in FIG. 4) of the trigger 25.

The force applied to the trigger in order to activate the lighter in the low-force mode, i.e., second trigger force $F_{T2}$, at least has to overcome the opposing forces $F_{OP}$ as discussed above to actuate the lighter. In addition, if the plunger member 63 contacts the trigger 25, the second trigger force must also overcome the friction forces generated by this contact during movement of the actuating member. The user, however, may not have to overcome the additional spring force $F_S$ (as shown in FIG. 5) applied by spring 80 depending on whether the user partially or fully depresses the latch member. If partially depressed, the mode of the lighter will depend on whether vertical wall 66*a* is contacting the vertical wall 56*c* or the trigger 25. In case the vertical wall 66*a* contacts the vertical wall 56*c,* the user may still have to overcome the high spring forces due to the extensions 66 still being within the slot portion 56*b*.

Figure 8:
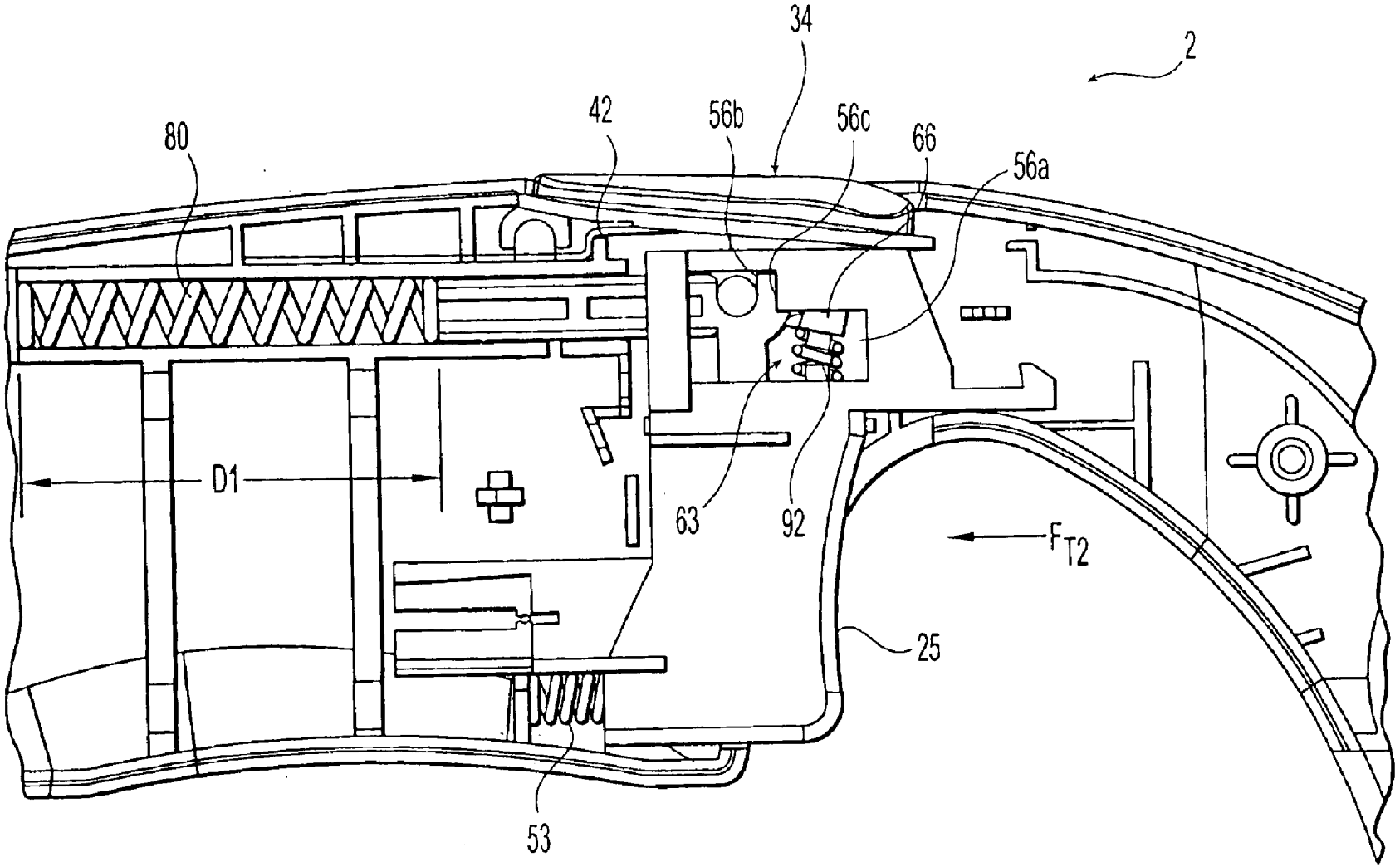
FIG. 8 is an enlarged, partial, side view of the lighter of FIG. 1, where the latch member is depressed, the plunger member is in the low-actuation-force position and the trigger is in the depressed position.

Referring to FIG. 8, in the case of the member 63 contacts the upper surface of the slot portion 56*a* forces due to contact will have to be overcome. If fully depressed, the user may not have to overcome any spring forces since the wall 66*a* is out contact with wall 56*c*. As a result, the second trigger force $F_{T2}$ required for the low-force mode is less than the first trigger force $F_{T1}$, required for the high-force mode. If the lighter is designed so that full depression of the latch member 34 moves the plunger member 63 out of contact with the trigger member 25, the spring force $F_S$ (shown in FIG. 5) may be substantially zero. Thus, a predetermined actuation force without forces other than the spring force $F_S$ may be substantially zero. The user, however, will have to apply a force sufficient to overcome the other forces in the lighter to ignite the lighter.

In the low-force mode in the lighter as shown in FIG. 8, as the trigger 25 is pressed gap g (shown in FIG. 7) decreases. In addition, as shown in FIG. 8, the spring 80 is not compressed and has its original length D1, piston 74 remains in its original position, spring 53 has been compressed and trigger 25 moves with respect to extensions 66. This allows the lighter to be ignited in the low-force mode. When the trigger 25 and latch member 34 are released, the spring 30 within the piezoelectric mechanism and the return spring 53 move or assist in moving the trigger 25 into its initial position. In addition, the leaf spring 42 and spring 92 move the latch member 34 and the plunger member 63 back to their initial positions. Thus, the lighter automatically returns to the initial position, where the plunger member 63 is in a high-actuation-force position and the lighter requires a high-actuation force to operate.

Preferably, in order to perform the low-force mode, the user has to possess a predetermined level of dexterity and cognitive skills so that depression of the latch member 34 and movement of the trigger 25 are carried out in the correct sequence. In the low-force mode, a user may use a thumb to press latch member 34 and a different finger to apply the trigger force. The lighter may be designed so that the trigger force preferably is applied after the latch member 34 is depressed so that a proper sequence is carried out to operate the lighter. Alternatively, another sequence can be used for actuation, and the present invention is not limited to the sequences disclosed but also includes such alternatives as contemplated by one of ordinary skill in the art. For example, the sequence can be pulling the trigger partially, depressing the latch member, and then pulling the trigger the rest of the way. The lighter in the low-force mode also may rely on the physical differences between intended and unintended users, for example, by controlling the spacing of the trigger and the latch member, or adjusting the operation forces, or shape and size of the latch member, trigger or lighter.

In order to make the lighter so that it is not excessively difficult for some intended users to actuate, the high-actuation force $F_{T1}$ preferably should not be greater than a predetermined value. It is contemplated that for the lighter of FIG. 5, the preferred value for $F_{T1}$ is less than about 10 kg and greater than about 5 kg, and more preferably less than about 8.5 kg and greater than about 6.5 kg. It is believed that such a range of force would not substantially negatively affect use by some intended users, and yet would provide the desired resistance to operation by unintended users. These values are exemplary and the operative force in the high-force mode may be more or less than the above ranges.

One of ordinary skill in the art can readily appreciate that various factors can increase or decrease the high-actuation force which an intended user can comfortably apply to the trigger. These factors may include, for example, the leverage to pull or actuate the trigger provided by the lighter design, the friction and spring coefficients of the lighter components, the trigger configuration, the complexity of the trigger actuation motion, the location, size and shape of the components, intended speed of activation, and the characteristics of the intended user. For example, the location and/or relationship between the trigger and the latch member and whether the intended user has large or small hands.

The design of the internal assemblies, for example the configuration of the actuating assembly, the configuration of any linking mechanism, as discussed below, the number of springs and forces generated by the springs all affect the force which a user applies to the trigger in order to operate the lighter. For example, the force requirements for a trigger which moves along a linear actuation path may not equal the force requirements to move a trigger along a non-linear actuation path. Actuation may require that a user move the trigger along multiple paths which may make actuation more difficult. While the embodiments disclosed have shown the preferred trigger with a linear actuation path, one of ordinary skill in the art can readily appreciate that non-linear actuation paths are contemplated by the present invention.

In the illustrated embodiment, in FIG. 7, the second trigger force $F_{T2}$ for the low-force mode is less than the first trigger force, preferably, but not necessarily, by at least about 2 kg. Preferably in the illustrated embodiment in FIG. 7, the low-actuation force $F_{T2}$ is less than about 5 kg but greater than about 1 kg, and more preferably greater than about 3.0 kg. These values are exemplary, as discussed above, and the present invention is not limited to these values as the particular desirable values will depend upon the numerous lighter design factors outlined above and the desired level of resistance to operation by unintended users.

One feature of the lighter 2 is that in the high-force mode multiple actuating operations may be performed so long as the user provides the necessary actuation force. Another feature of the lighter 2 is that in the low-force mode multiple actuating operations may be performed so long as the user depresses the latch member and provides the necessary actuation force and motions required to ignite the lighter. In particular, if the lighter does not operate on the first attempt, the user may re-attempt to produce a flame by actuating the trigger again in the low-force mode if the user continues to depress the latch member.

In FIGS. 16 and 16A, an alternative embodiment is shown as lighter 202. Lighter 202 is similar to the lighter 2 shown in FIGS. 1–4. Lighter 202 includes a trigger 225 with an upper rib portion 246 that is longitudinally extending. The trigger 225 further includes engaging portions 226 on either side of the rib portion 246 that cooperate with engaging portions 126 on cam follower 216. The lighter 202 further includes a plunger member 263 (as shown in FIG. 16A) slidably associated with a piston member 274. The plunger member 262 includes a U-shaped front portion and rearwardly extending cylindrical members 262*a* that receive two high-actuation-force spring 280. The springs 280 extends into the piston member 274. The springs 280 bias the plunger member 262 toward front end 209 of the lighter. The piston member 274 is pivotally coupled to the housing 204 and is biased upward by a spring 292.

In the high-actuation-force position or initial position, as shown in FIGS. 16 and 16A, the piston member 274 and plunger member 263 are aligned with the upper rib portion 246 so that if the trigger 225 is depressed in this mode, the springs 280 exerts spring force $F_S$ on the plunger member 263. This force must be overcome to ignite the lighter.

Figure 17:
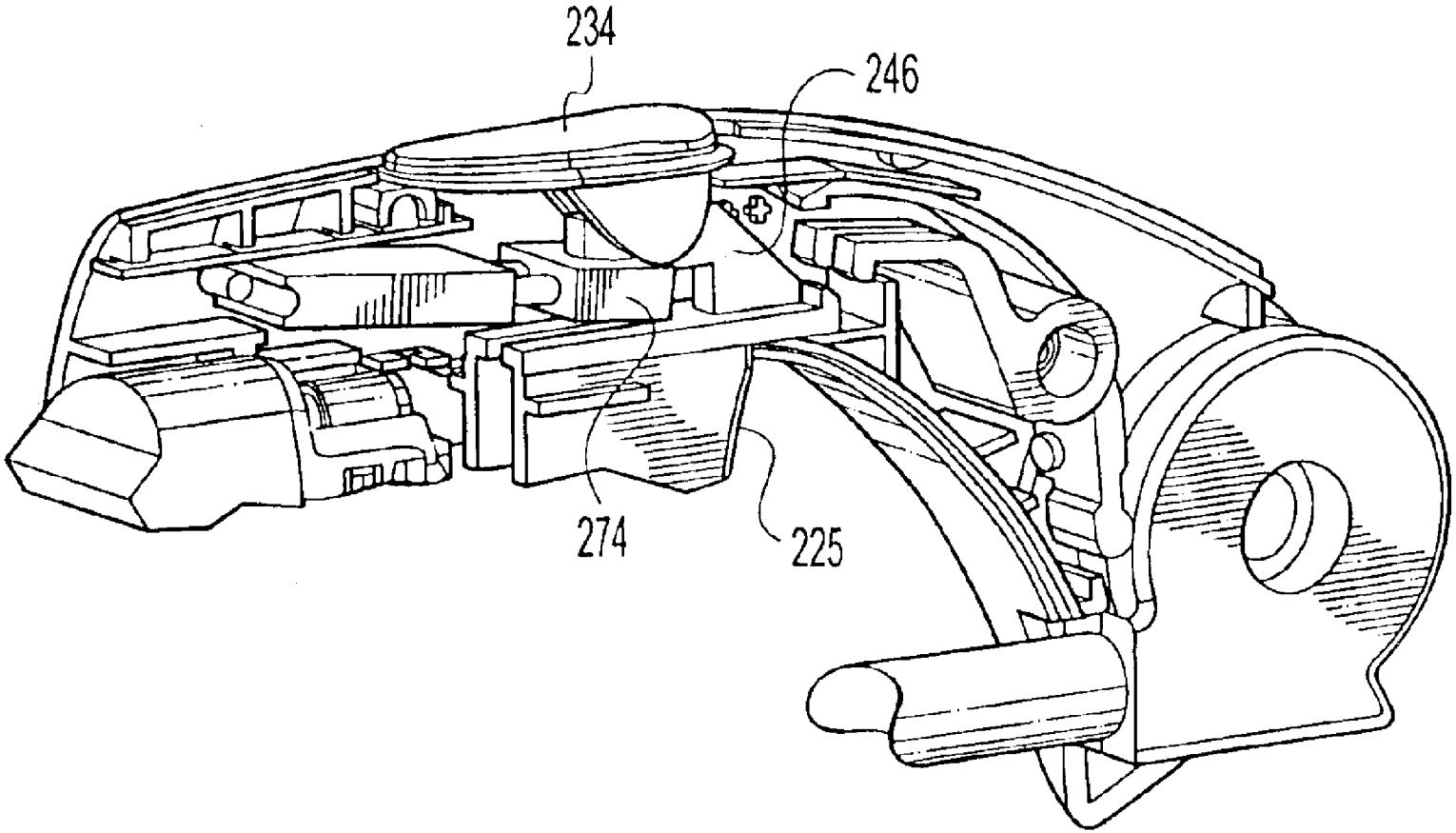
FIG. 17 is a cut-away, partial, perspective view of the lighter of FIG. 16, wherein the lighter is in the latch member is depressed and the plunger member is in a low-actuation-force position.

In the low-actuation-force position or low-force mode, as shown in FIG. 17, latch member 234 is moved downward which moves the front end of the piston member 274 and consequently plunger member 263 (as shown in FIG. 16A) downward so that plunger member 263 enters gap g (shown in FIG. 16). Thus, when the trigger 225 is depressed the upper rib portion 246 moves toward rear end 208 of the lighter without opposition from springs 280 (as shown in FIG. 16A). Upon releasing the latch member 234 and the trigger 225, the trigger returns to its initial position due to the return spring in the piezoelectric and a spring similar to spring 53 (in FIG. 1). In addition, the piston member 274 and plunger member 263 return to their initial positions due to spring 292 (shown in FIG. 16). An additional latch spring, as discussed above with respect to lighter 2 of FIG. 1 may also be included to aid in returning latch member 234 to its initial position. Thus, in the low-actuation-force position, a lower trigger force than in the high-actuation-force position is necessary to ignite the lighter because springs 280 only significantly oppose motion of trigger 225, when upper rib portion 246 abuts plunger member 263 in the high-actuation-force position. In the low-actuation-force position, friction forces and other forces, discussed above, may oppose trigger motion. The lighter 202*c* an be modified in another embodiment to include any number of springs 280 such as a single such spring.

Figure 18:
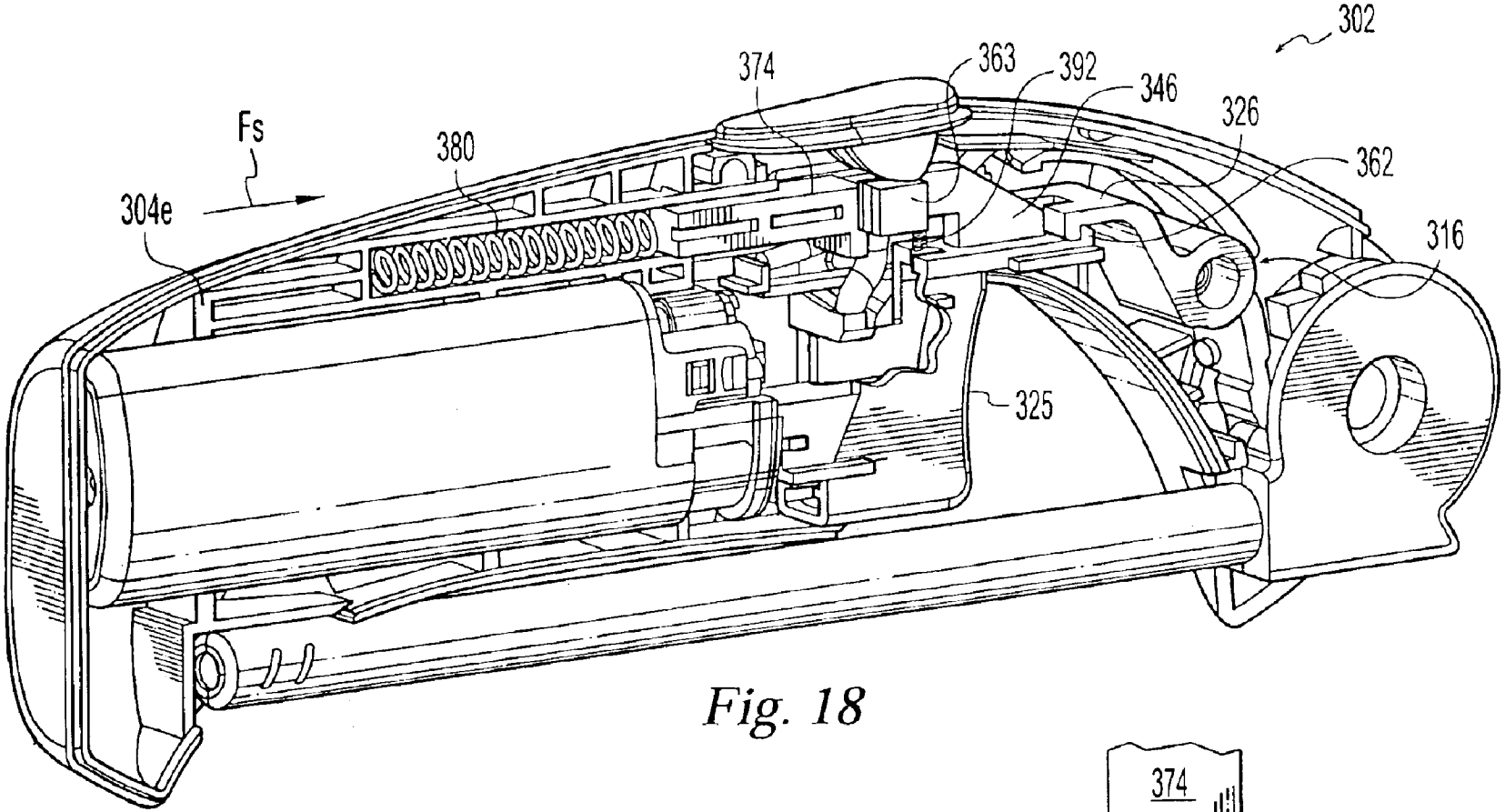
FIG. 18 is a cut-away, partial, perspective view of a third embodiment of the lighter of the present invention, wherein the lighter is in an initial state and the plunger member is in a high-actuation-force position.
Figure 18A:
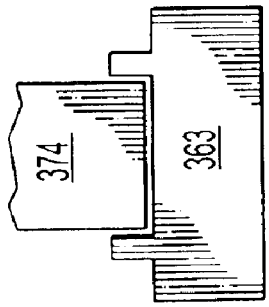
FIG. 18A is a schematic, top view of a portion of the piston member and plunger member of the lighter shown in FIG. 18.

FIG. 18 shows an alternative embodiment lighter 302. Lighter 302 is similar to the lighter 202 shown in FIGS. 17–18. Lighter 302 includes a trigger 325 with an upper rib portion 346 that is longitudinally extending. The trigger 325 further includes engaging portions 362 on either side of the rib portion 346 that cooperate with engaging portions 326 on cam follower 316.

As shown in FIG. 19A, the lighter 302 further includes a substantially U-shaped plunger member 363 and a piston member 374. The plunger member 363 is slidably connected to the piston member 374. A high-actuation-force spring 380 is disposed between the piston member 374 and housing support member 304*e*. The piston member 374 is slidably coupled to the housing 304. The plunger member is biased upward by a spring 392.

In the high-actuation-force position or initial position, as shown in FIG. 18, the plunger member 363 is aligned with the upper rib portion 346 so that if the trigger 325 is depressed in this mode, the plunger member 363 and piston member 374 move rearward to compress biasing member 380 that exerts spring force $F_S$ on the piston member 374, plunger member 363, and trigger 325. This force must be overcome to ignite the lighter.

Figure 19:
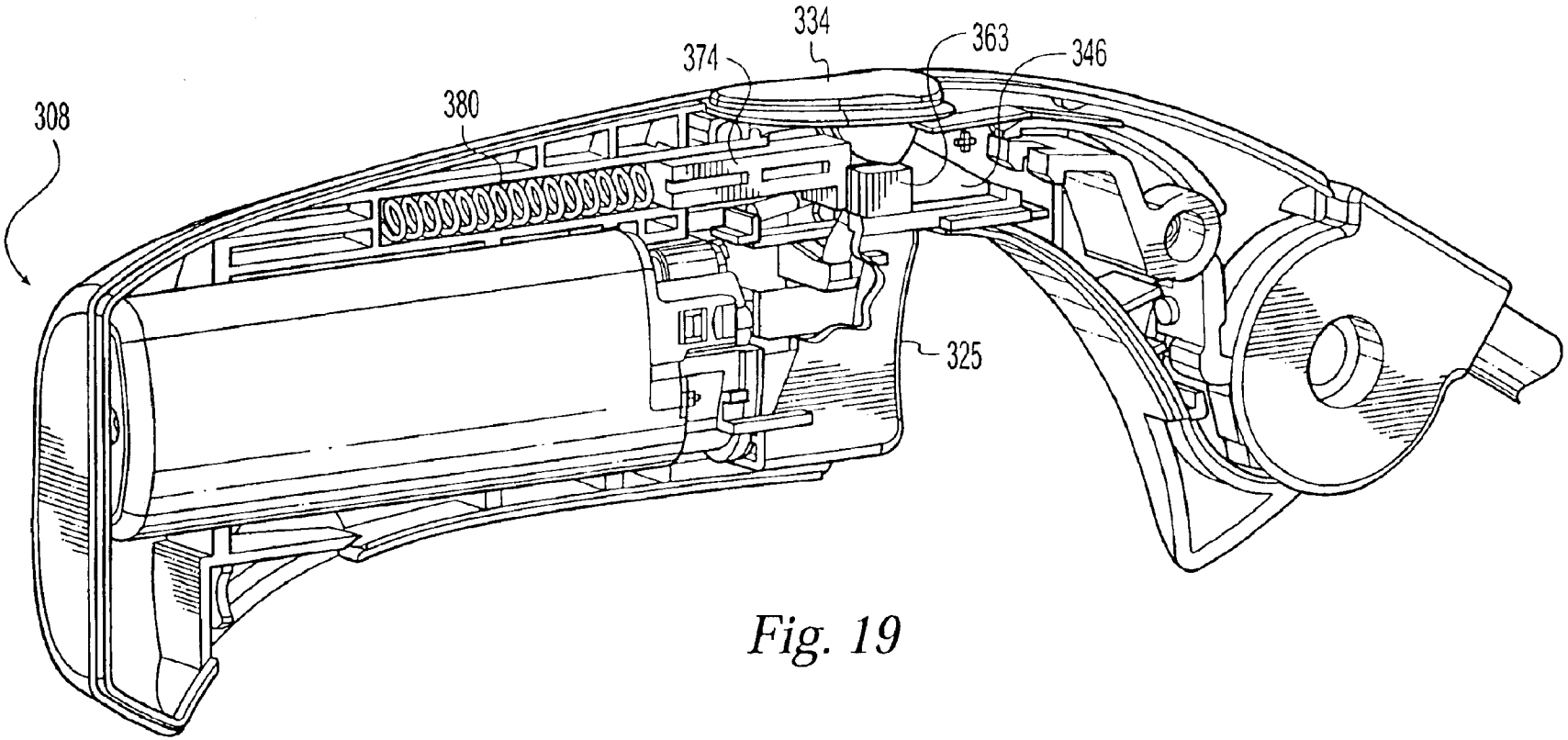
FIG. 19 is a cut-away, partial, perspective view of the lighter of FIG. 18, wherein the lighter is in the latch member is depressed and the plunger member is in a low-actuation-force position.

In the low-actuation-force position or low-force mode, as shown in FIG. 19, latch member 334 is moved downward which moves the plunger member 363 downward on the front of the piston member 374 so that when the trigger 325 is depressed the upper rib portion 346 moves toward rear end 308 of the lighter over plunger member 363. As a result, rib portion 346 does not move piston member 374 and biasing member 380 does not oppose the movement of the trigger 325.

Upon releasing the latch member 334, the latch member 334 and plunger member 363 return to their initial positions due to spring 392 (shown in FIG. 18). An additional latch spring, as discussed above with respect to lighter 2 of FIG. 1 may also be included to aid in returning latch member 334 to its initial position. Thus, in the low-actuation-force position, a lower trigger force than in the high-actuation force position is necessary to ignite the lighter because spring 380 only significantly opposes motion of trigger 325 when upper rib portion 346 abuts plunger member 363. In the low-actuation-force position, friction forces and other forces, discussed above, may oppose trigger motion.

Figure 20:
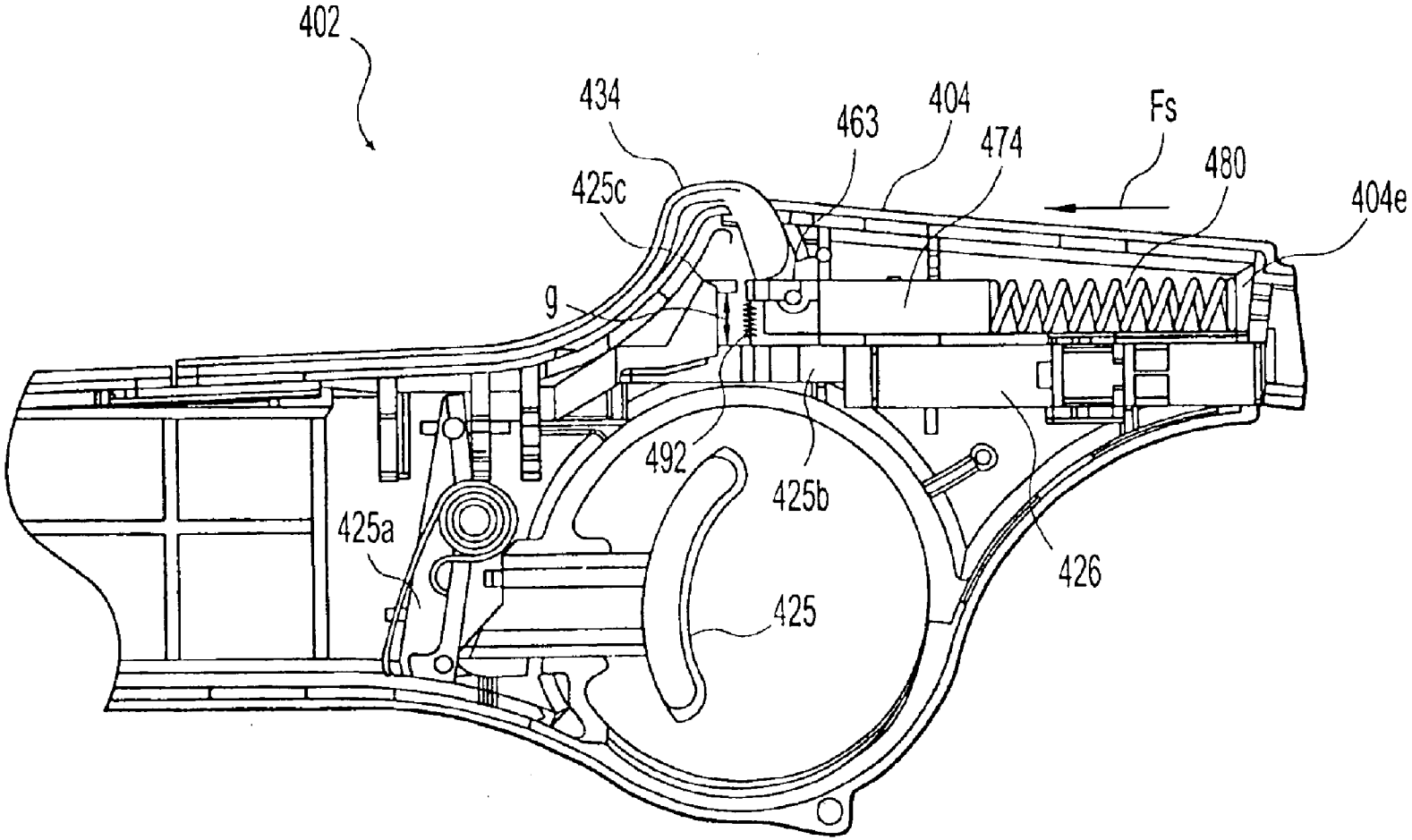
FIG. 20 is a cut-away, partial, side view of a fourth embodiment of the lighter of the present invention, wherein the trigger and latch member are in initial states and the plunger member is in a high-actuation-force position.

FIG. 20 shows an alternative embodiment lighter 402. Lighter 402 is similar to the lighter 2 shown in FIG. 1. Lighter 402 includes a stationary wand and an actuating assembly that includes a trigger 425 slidably connected to the housing 404. The actuating assembly further includes a pivoting member 425*a* and a linking rod 425*b*. The linking rod 425*b* has an upper rib portion 425*c* that defines a gap g. The actuating assembly is further described in U.S. patent application Ser. No. 09/704,688. In the lighter 402, the ignition assembly 426 is located forward of the trigger 425.

The lighter 402 further includes a dual-mode assembly that includes a plunger member 463 configured like plunger member 63 in FIG. 3 and a piston member 474 configured like piston member 74 in FIG. 3. The plunger member 463 is pivotally coupled to the piston member 474. A high-actuation-force spring 480 is disposed between the piston member 474 and support member 404*e*. The piston member 474 is slidably coupled to the housing 404 and the plunger member 463 is biased upward by a spring 492.

In the high-actuation-force position or initial position, as shown in FIG. 20, the plunger member 463 is aligned with the upper rib portion 425*c* of the linking rod 425*b* so that if the trigger 425 is depressed in this mode, the pivoting member 425*a* moves linking rod 425*b* forward to contact the plunger member 463. Consequently, the plunger member 463 and piston member 474 move rearward to compress biasing member 480, and biasing member 480 exerts spring force $F_S$ on the piston member 474, plunger member 463, linking rod 425*b*, pivoting member 425*a*, and trigger 425. This force must be overcome to ignite the lighter.

Figure 21:
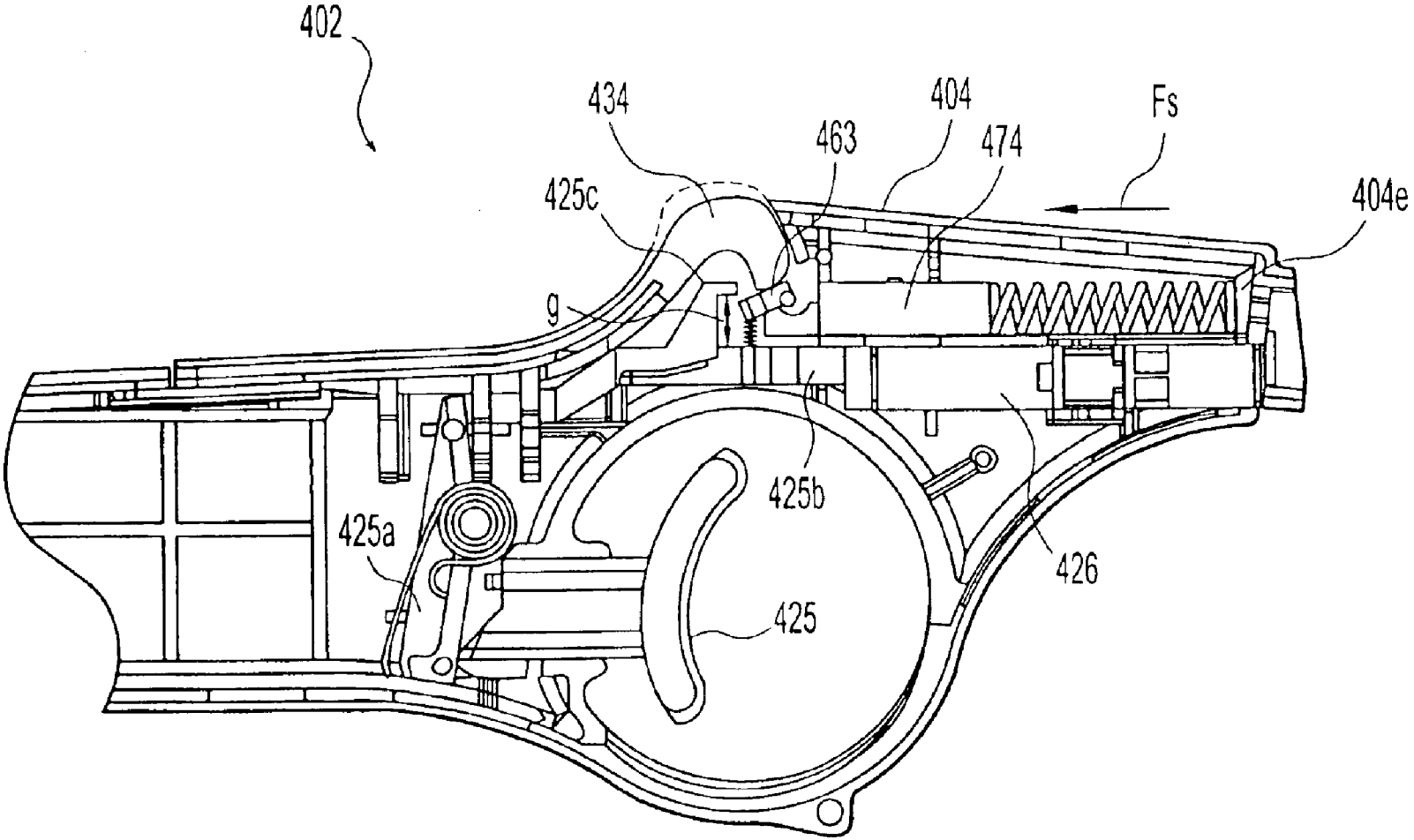
FIG. 21 is a cut-away, partial, side view of the lighter of FIG. 20, wherein the lighter is in the latch member is depressed and the plunger member is in a low-actuation-force position.

In the low-actuation-force position or low-force mode, as shown in FIG. 21, latch member 434 is moved downward from its initial position (shown in phantom) which moves the plunger member 463 downward on the front of the piston member 474 so that when the trigger 425 is depressed the upper rib portion 425*c* of the linking rod 425*b* moves forward without opposition from biasing member 480, since rib portion 425*c* does not move piston member 474 and plunger member 463 is received by gap g (as shown in FIG. 20). Upon releasing the latch member 434, the latch member 434 and plunger member 463 return to their initial positions due to spring 492 (shown in FIG. 20). Thus, in the low-actuation-force position, a lower trigger force than in the high-actuation-force position is necessary to ignite the lighter because spring 480 only opposes motion of trigger 425 when upper rib portion 425*c* abuts plunger member 463.

Figure 22:
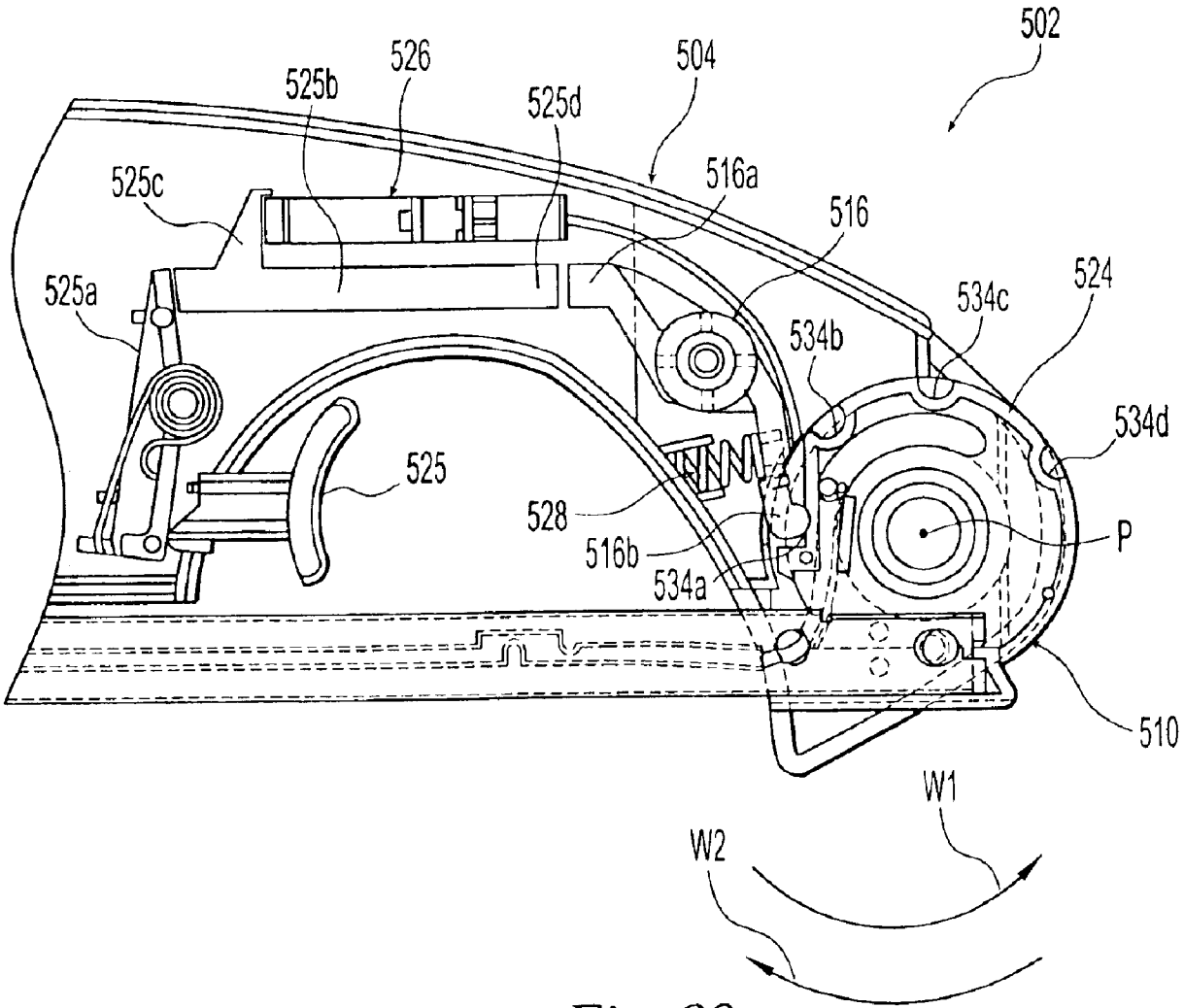
FIG. 22 is a cut-away, partial, side view of a fifth embodiment of the lighter of the present invention, wherein the wand assembly is in a closed position.

FIG. 22 shows an alternative embodiment of lighter 502. Lighter 502 is similar to the lighter 2 shown in FIG. 1. Lighter 502 includes an actuating assembly that includes a trigger 525 slidably connected to the housing 504. The actuating assembly further includes a pivoting member 525*a* and a linking rod 525*b*. The linking rod 525*b* has an upper rib portion 525*c* and an engaging end 525*d*. The actuating assembly is further described in U.S. patent application Ser. No. 09/704,688. In the lighter 502, the ignition assembly 526 is located forward of the trigger 525.

The lighter 502 further includes wand assembly 510 configured like wand assembly 10 of FIGS. 9–14, and a cam follower 516 with an engaging end 516*a* and a follower end 522 and configured similar to cam follower 116 of FIGS. 9–15. Similar to lighter 2 of FIGS. 9–14, wand assembly 510 includes a camming surface 524 and detents 534*a–d*.

When wand assembly 510 is in or about the closed position, as shown, follower end 522 of cam follower 516 is received in first detent 534*a*, and end 516*a* of cam follower 516 is aligned with engaging end 525*d* of linking rod 525*b*. Thus, cam follower 516 prevents linking rod 525*b* and trigger 525 from sliding sufficiently to ignite the lighter 502. In the lighter 502, the cam follower 516 may rotate counter-clockwise as the wand assembly is extended.

In various intermediate and fully-extended positions of wand assembly 510, discussed above in reference to lighter 2, cam follower 516 rotates such that end 516*a* is out of alignment with engaging end 525*d* of linking rod 525*b*. In this position, cam follower 516 allows linking rod 525*b* and trigger to move sufficiently to compress ignition assembly 526 and ignite lighter.

Figure 23:
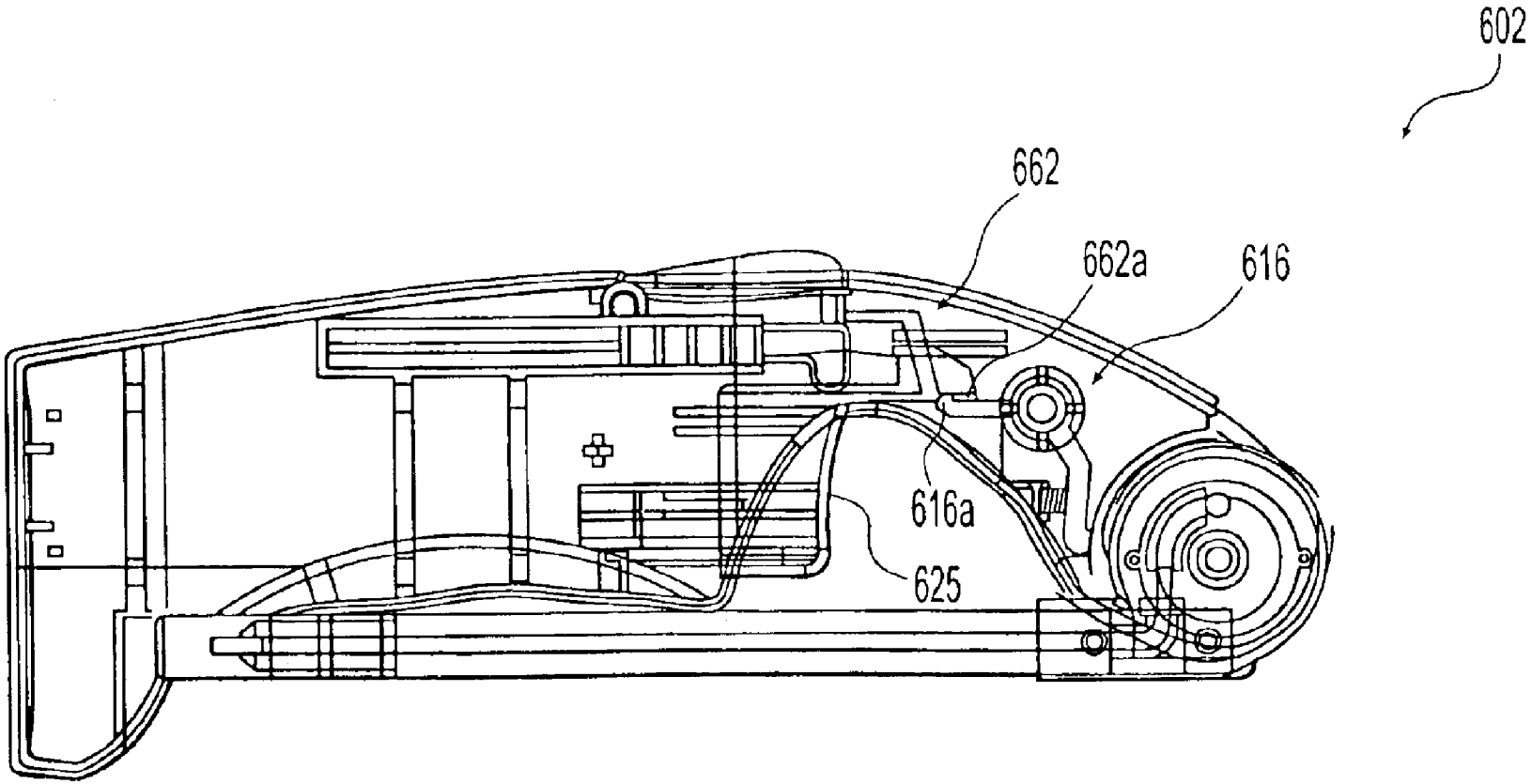
FIG. 23 is a cut-away, partial, side view of a sixth embodiment of the lighter of the present invention, wherein the wand assembly is in a closed position.

FIG. 23 shows an alternative embodiment of lighter 602. Lighter 602 is similar to the lighter 2 shown in FIG. 1. Lighter 602 includes a trigger 625 with an engaging portion 662 that includes a bore 662*a*. The lighter 602 further includes a cam follower 616 that includes a portion with an engaging portion 616*a*. In the closed, and various intermediate positions, as discussed above with respect to lighter 2, the cam follower 616 is configured and dimensioned so that engaging portion 616*a* engages bore 662*a* to prevent trigger 625 from sliding sufficiently to ignite the lighter 602.

Figure 24:
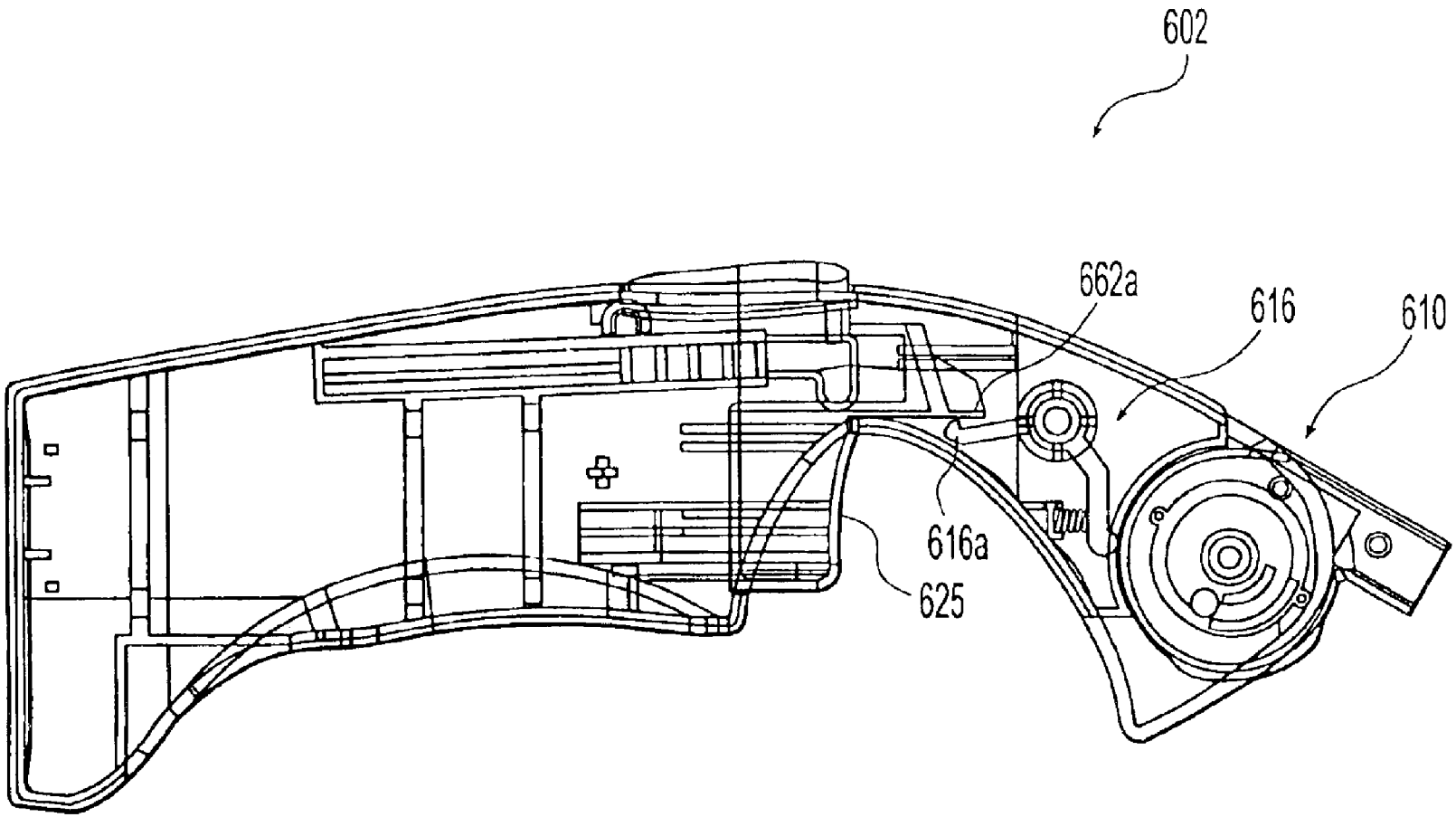
FIG. 24 is a cut-away, partial, side view of the lighter of FIG. 23 the present invention, wherein the wand assembly is in an extended position.

In various intermediate and fully-extended positions (such as shown in FIG. 24) of wand assembly 610, discussed above in reference to lighter 2, cam follower 616 rotates counter-clockwise such that end 616*a* is out of bore 662. In this position, cam follower 616 allows trigger 625 to move sufficiently to ignite the lighter.

Figure 25:
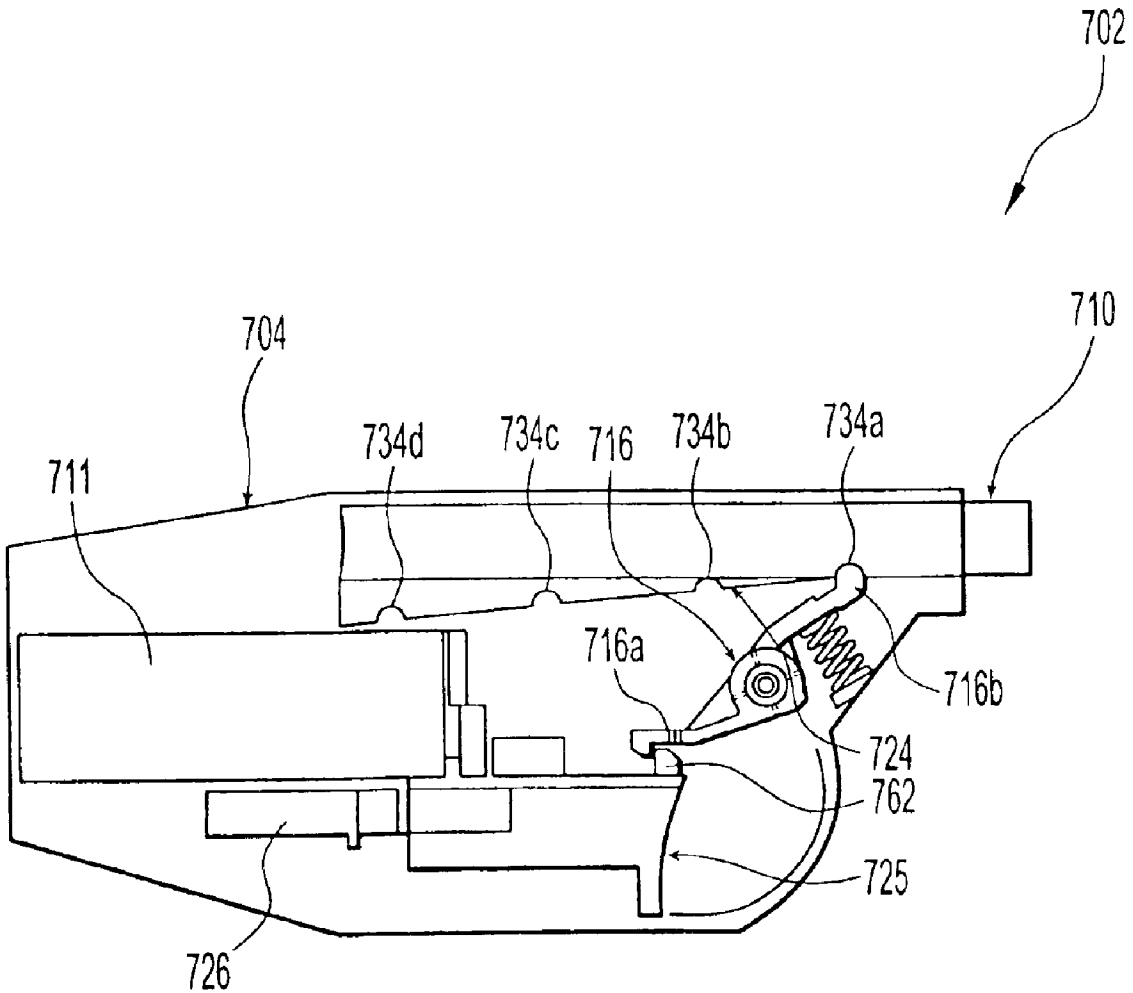
FIG. 25 is a cut-away, side view of a seventh embodiment of the lighter of the present invention, wherein the wand assembly is in a closed position.

FIG. 25 shows an alternative embodiment of lighter 702. Lighter 702 is similar to the lighter 2 shown in FIG. 1. Lighter 702 includes an actuating assembly that includes a trigger 725 slidably connected to the housing 704. The lighter 702 further includes wand assembly 710 that is slidable with respect to housing 704. Similar to lighter 2 of FIGS. 9–14, wand assembly 710 includes a camming surface 724 and detents 734*a–d*. Lighter 702 also includes a cam follower 716 with an engaging end 716*a* and a follower end 716*b*. Cam follower 716 is configured similar to cam follower 116 of FIGS. 9–15.

When wand assembly 710 is in the closed position, shown in FIG. 25, follower end 716*b* of cam follower 716 is received in first detent 734*a*, and engaging end 716*a* of cam follower 716 is aligned with engaging portion 762 of trigger 725. Thus, when wand assembly 710 is in the closed position, cam follower 716 prevents trigger 725 from sliding sufficiently to ignite the lighter 702. Ignition occurs when the piezoelectric unit 72*b* is activated and fuel is released from fuel unit 711. In the lighter 702, the cam follower 716 may rotate clockwise as the wand assembly is extended.

Figure 26:
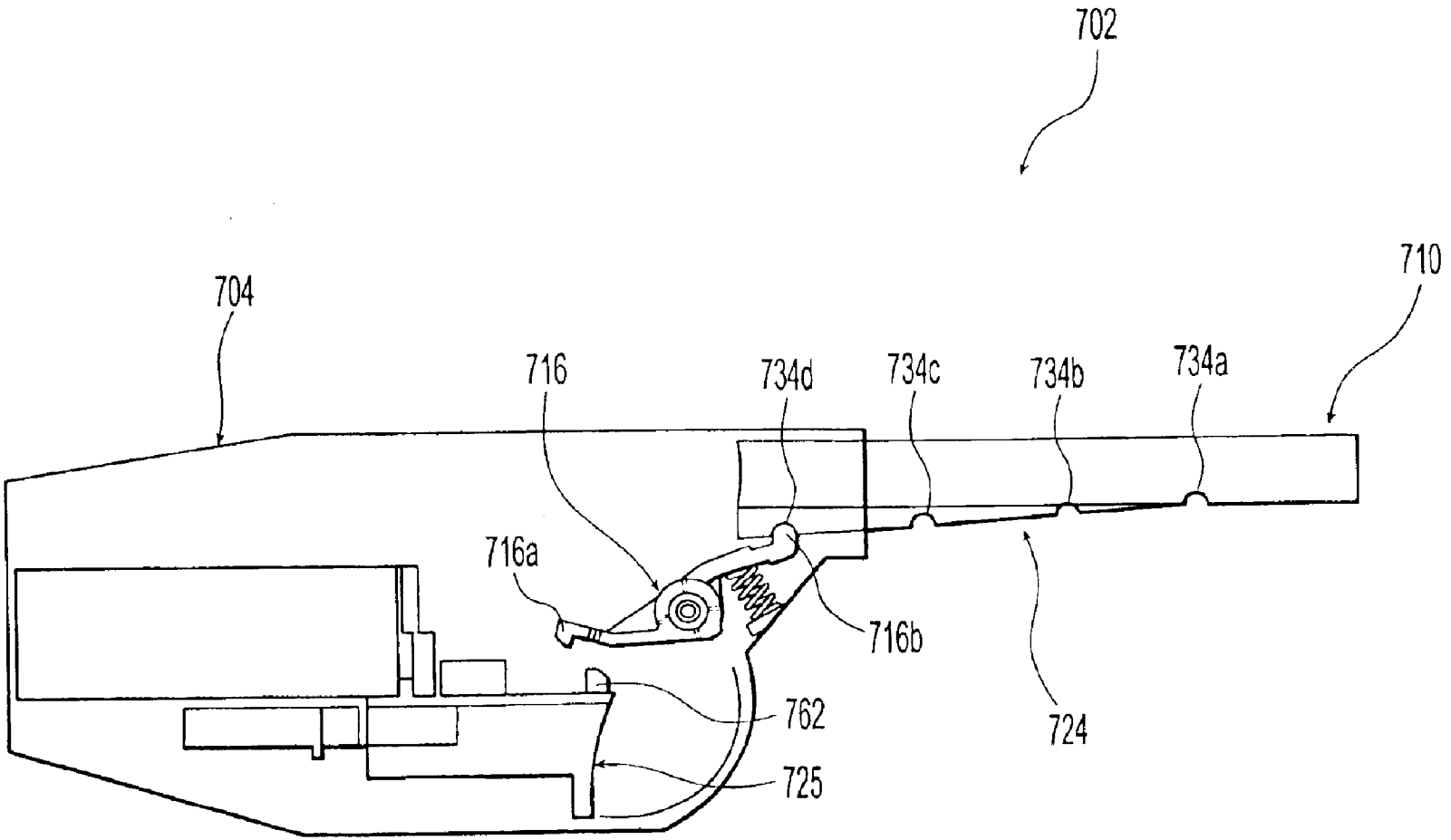
FIG. 26 is a cut-away, side view of the lighter of FIG. 25 of the present invention, wherein the wand assembly is in an extended position.

In various intermediate positions and the fully-extended position of wand assembly 710 (shown in FIG. 26), cam follower 716 is rotated such that follower end 716*b* is within detents 734*b–d* and engaging end 716*a* is out of alignment with engaging portion 762 of trigger 725. In these positions of wand assembly 710, cam follower 716 allows trigger 725 to move sufficiently to compress the ignition assembly 726 and ignite the lighter 702. As discussed above, when the follower end 716*a* is within detents 734*a–d* the wand assembly 710 is in a high-wand-force position. Lighter 702 can be configured so that in various intermediate positions of wand assembly 710, the trigger 725 cannot move sufficiently to ignite lighter 702.

Figure 27:
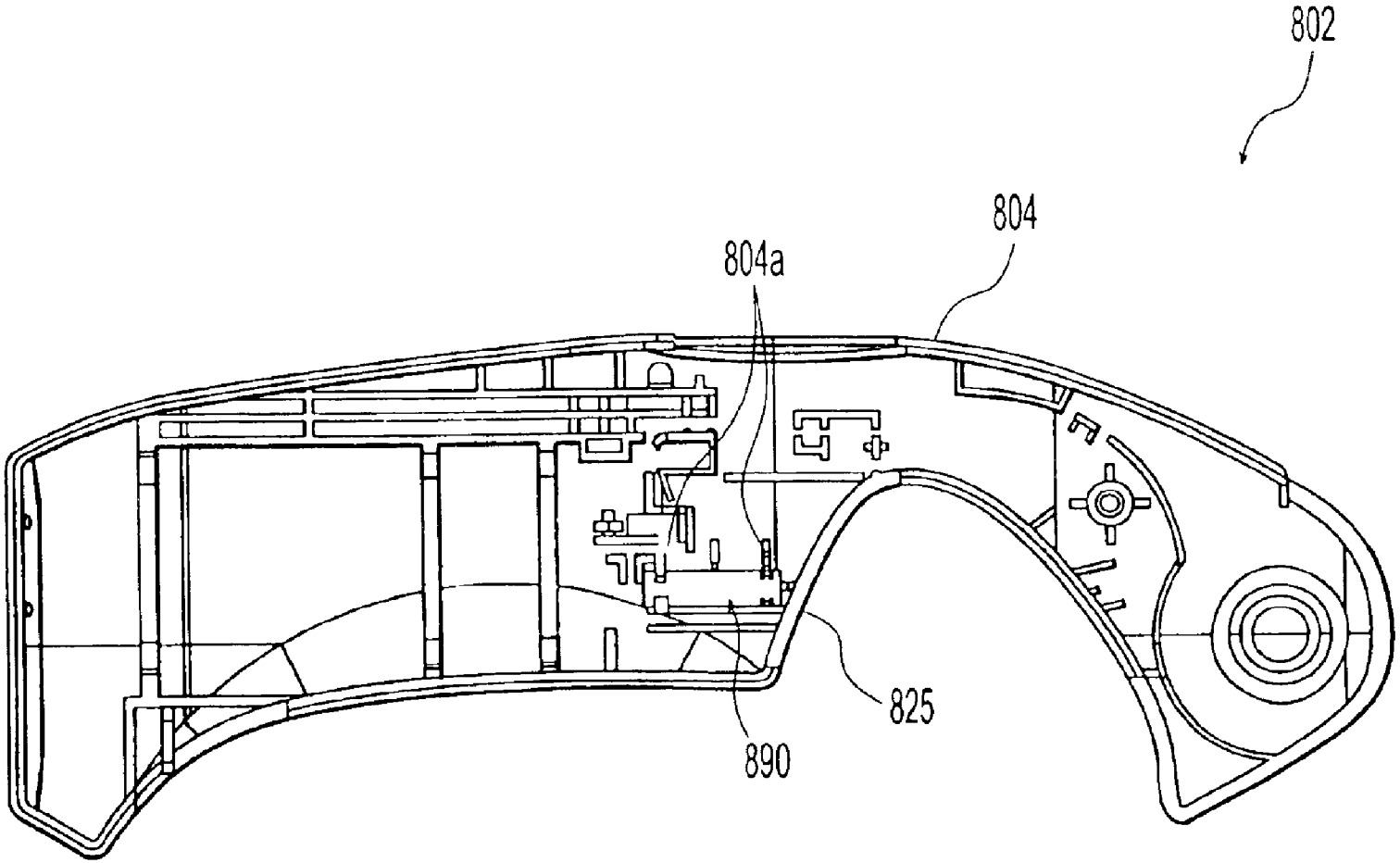
FIG. 27 is a cut-away, partial, side view of an eighth embodiment of the lighter of the present invention, wherein the housing includes a conductive strip.

FIG. 27 shows an alternative embodiment of lighter 802. Lighter 802 is similar to the lighter 2 shown in FIG. 1. Lighter 802 includes a housing 804 with support members 804*a* for releasably retaining a conductive strip or member 890 in the housing 804. Prior to joining the strip 890 to housing 809, wire 28 (as shown in FIG. 1B) is disposed with an uninsulated end in electrical contact with the strip 890. The uninsulated end may be disposed between the strip 890 and housing 804. Strip 890 thus retains the wire 28 in this location within the housing 804.

A trigger 825 similar to trigger 25, discussed above, is coupled to the piezoelectric 826 and includes an electrical conductor 892 electrically connected to electrode 29 (as shown in FIG. 1A) of piezoelectric.

Figure 28:
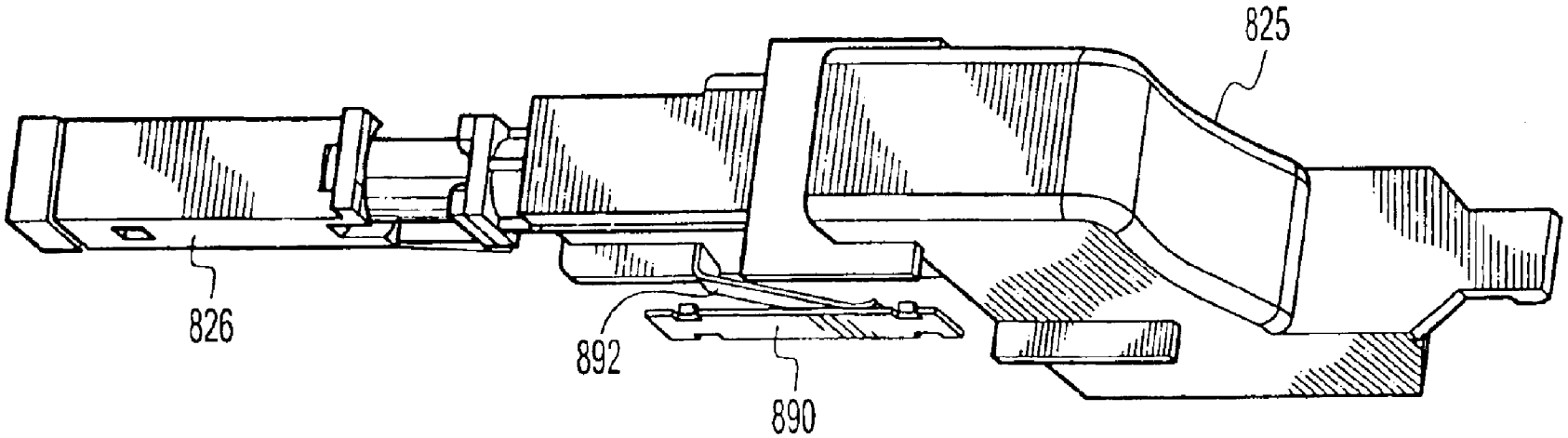
FIG. 28 is a perspective view of the trigger, an electrical contact and the conductive strip of FIG. 27.

Referring to FIGS. 27 and 28, when installed, the electrical conductor 892 is slidable along conductive strip 890 and strip 890 and conductor 892 electrically connects the wire 28 to electrode 29 (as shown in FIGS. 1A and 1B).

Figure 29:
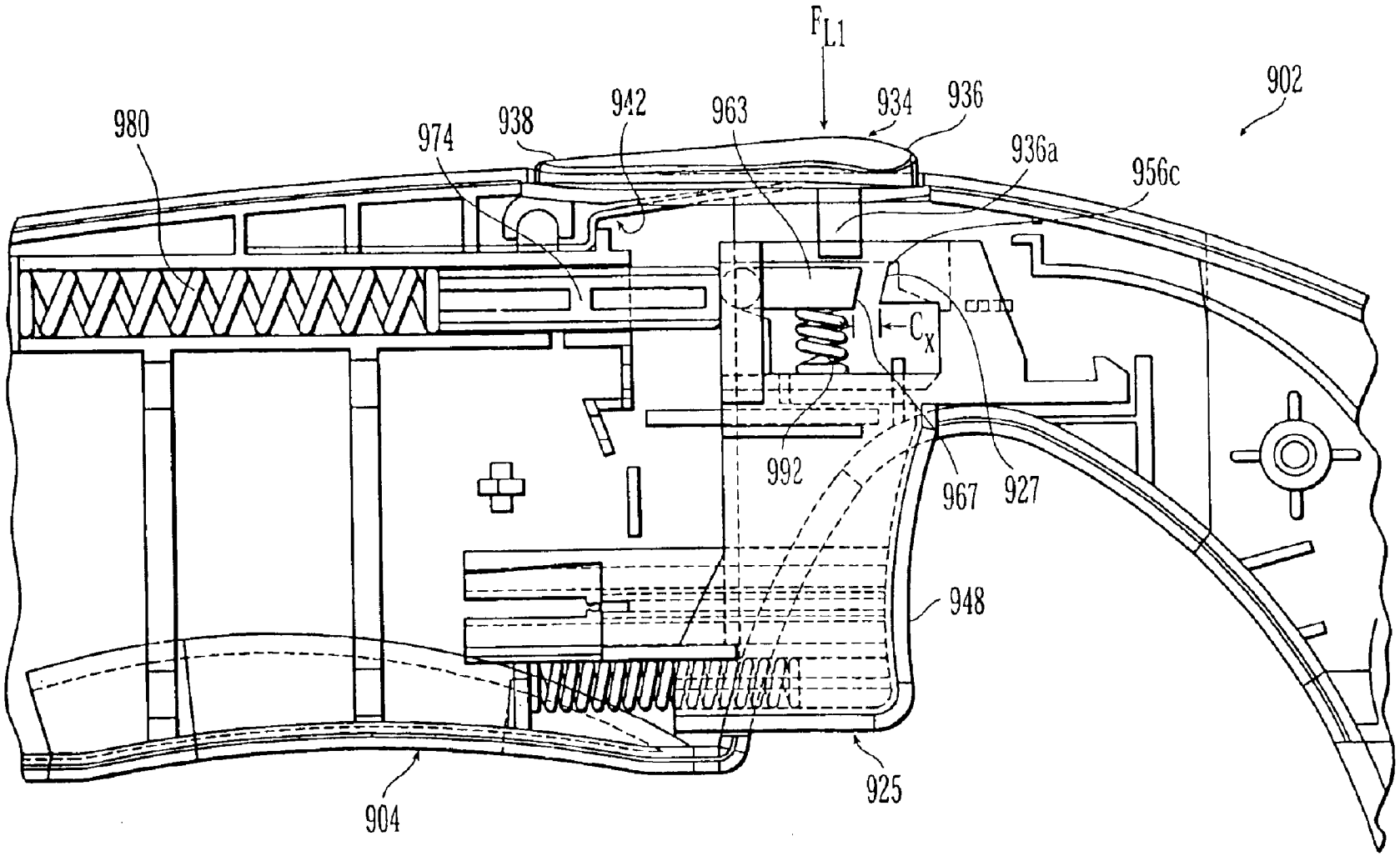
FIG. 29 is an enlarged, partial, side view of a ninth embodiment of the present invention, where the plunger member is in the high-actuation-force position and the trigger is in an initial position.
Figure 29A:
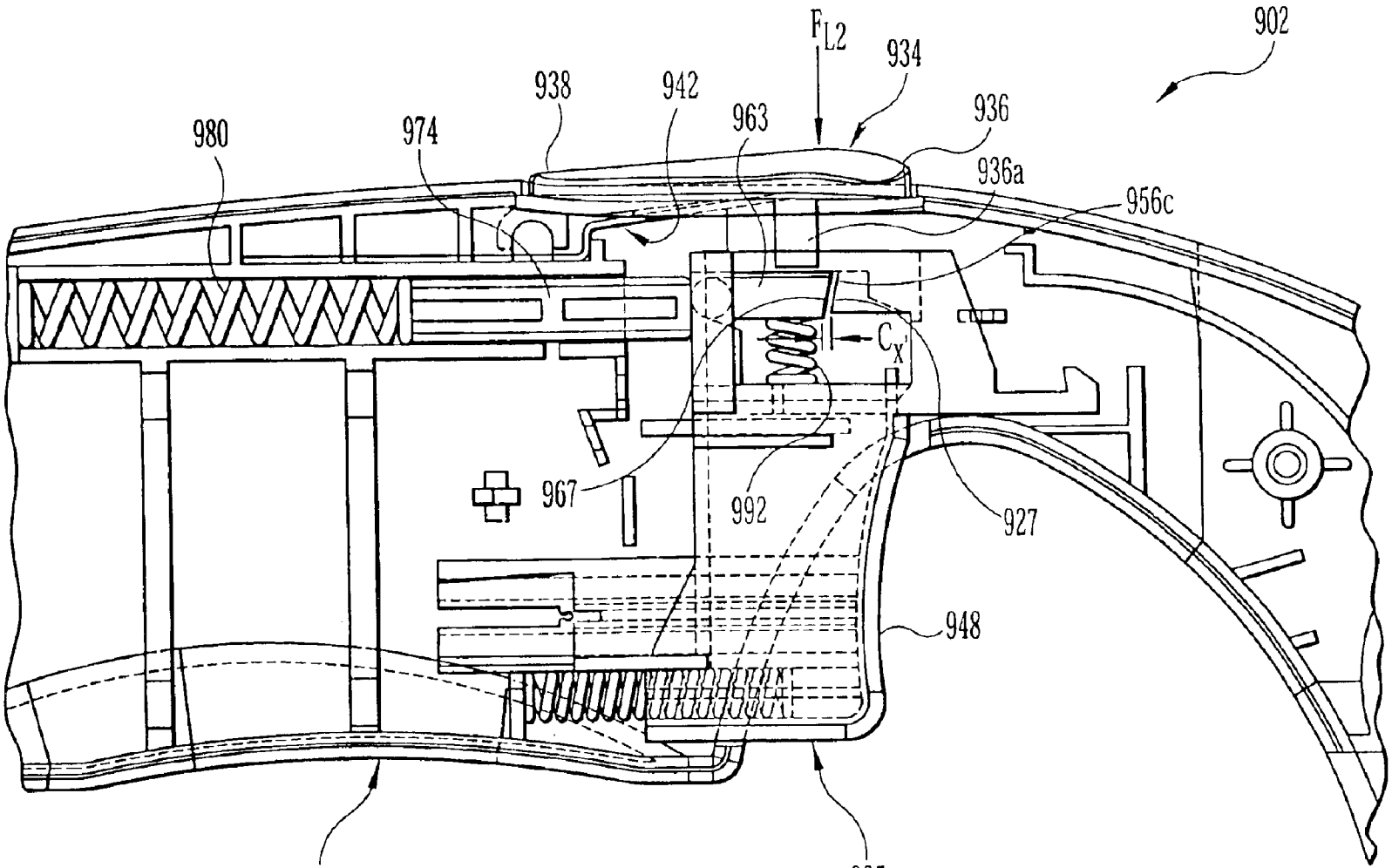
FIG. 29A is an enlarged, partial, side view of the lighter of FIG. 29, where the plunger member is in the high-actuation-force position and the trigger is in a depressed position.

Referring to FIGS. 29 and 29A, an alternative embodiment of lighter 2 is shown. Lighter 902 is substantially similar to lighter 2, shown in FIGS. 1–4, with only the differences described herein in detail. Lighter 902 is configured and dimensioned such that the amount of force required to press latch 934 varies depending on the sequence of operation of latch 934 and trigger 925. More specifically, the amount of force required to press latch 934 may increase if the user presses trigger 925 before pressing latch 934. Referring to FIG. 29, lighter 902 is shown in a high-force mode with trigger 925 in an initial position. In this mode, if a user presses latch 934 before pressing trigger 925, a first latch force $F_{L1}$ is required to press latch 934 and switch lighter 902 from the high-force mode to the low-force mode. Referring to FIG. 29A, if a user presses trigger 925 before attempting to press latch 934, a second latch force $F_{L2}$ (which may be, and preferably is, greater than first latch force $F_{L1}$) is required to press latch 934 and switch lighter 902 from the high-force mode to the low-force mode. Thus, if a user attempts to press trigger 925 while lighter 902 is in the high-force mode, and subsequently attempts to press latch 934 to switch lighter 902 to the low-force mode, latch force $F_L$ will increase and may prevent pressing of latch 934.

One illustrative example of a structure that provides this variation in latch force $F_L$ is shown in FIGS. 29 and 29A. As shown therein, a first engagement surface 967 may be associated with latch member 934, and a second engagement surface 927 may be associated with a portion of trigger 925 (e.g., with wall 956*c*). For illustrative purposes only, first engagement surface 967 is shown as an inclined surface formed on plunger member 963, and second engagement surface 927 is shown as a matching inclined surface formed on trigger 925, although other configurations are possible. For example, first engagement surface 967 may be formed on latch member 934 or piston member 974, and second engagement surface 927 may be formed on housing 904.

When lighter 902 is in the high-force mode and trigger 925 is in the initial position, as shown in FIG. 29, first engagement surface 967 and second engagement surface 927 are configured such that, if a user attempts to press latch 934 to switch lighter 902 to the low-force position, the resultant movement of plunger 963 will cause substantially no engagement between the first engagement surface 967 and the second engagement surface 927. Thus, in this state, the latch force $F_{L1}$ required to press latch 934 and switch lighter 902 to the low-force mode need only be sufficient to overcome the forces of spring 992, optional leaf spring 942, and any incidental frictional forces. In the lighter of FIG. 29, the first engagement surface 967 and the second engagement surface 927 are separated by a distance X, which is sufficient that latch 934 can be moved to the low-force position with first latch force $F_{L1}$.

If the user presses trigger 925 before pressing latch 934, as shown in FIG. 29A, the distance between first engagement surface 967 and second engagement surface 927 decreases (this decreased distance is indicated as X'). As a result, first engagement surface 967 may engage second engagement surface 927 when the user presses latch 934. This engagement provides resistance to pressing of latch 934 in addition to the resistance provided by spring 992, optional leaf spring 942, and any incidental frictional forces, and as a result, latch force $F_{L2}$ is greater than latch force $F_{L1}$. More specifically, interaction between first engagement surface 967 and second engagement surface 927 (e.g., sliding between the matching inclined surfaces) caused by pressing of latch 934, may cause plunger member 963 to move toward piston member 974 and compress spring 980. This compression of spring 980 provides additional resistance to movement of latch 934. Alternatively or additionally, interaction between first engagement surface 967 and second engagement surface 927 may cause trigger 925 and/or latch 934 to move against the users finger, and also provide additional resistance to movement of latch 934.

One of ordinary skill in the art will know and appreciate that lighter 902 may be configured such that trigger 925 may be partially pressed before causing first engagement surface 967 and second engagement surface 927 to engage one another (e.g., the distance X may be large enough that partial depression of trigger 925 does not cause first engagement surface 967 to contact second engagement surface 927 upon initial pressing of latch 934). In this case, a user may move trigger 925 a predetermined distance before pressing latch 934, and the force required to press latch 934 and switch lighter 902 to the low-force mode will remain first latch force $F_{L1}$; however upon moving trigger 925 a distance greater than the predetermined distance, the force required to press latch 934 will increase to second latch force $F_{L2}$.

Figure 30:
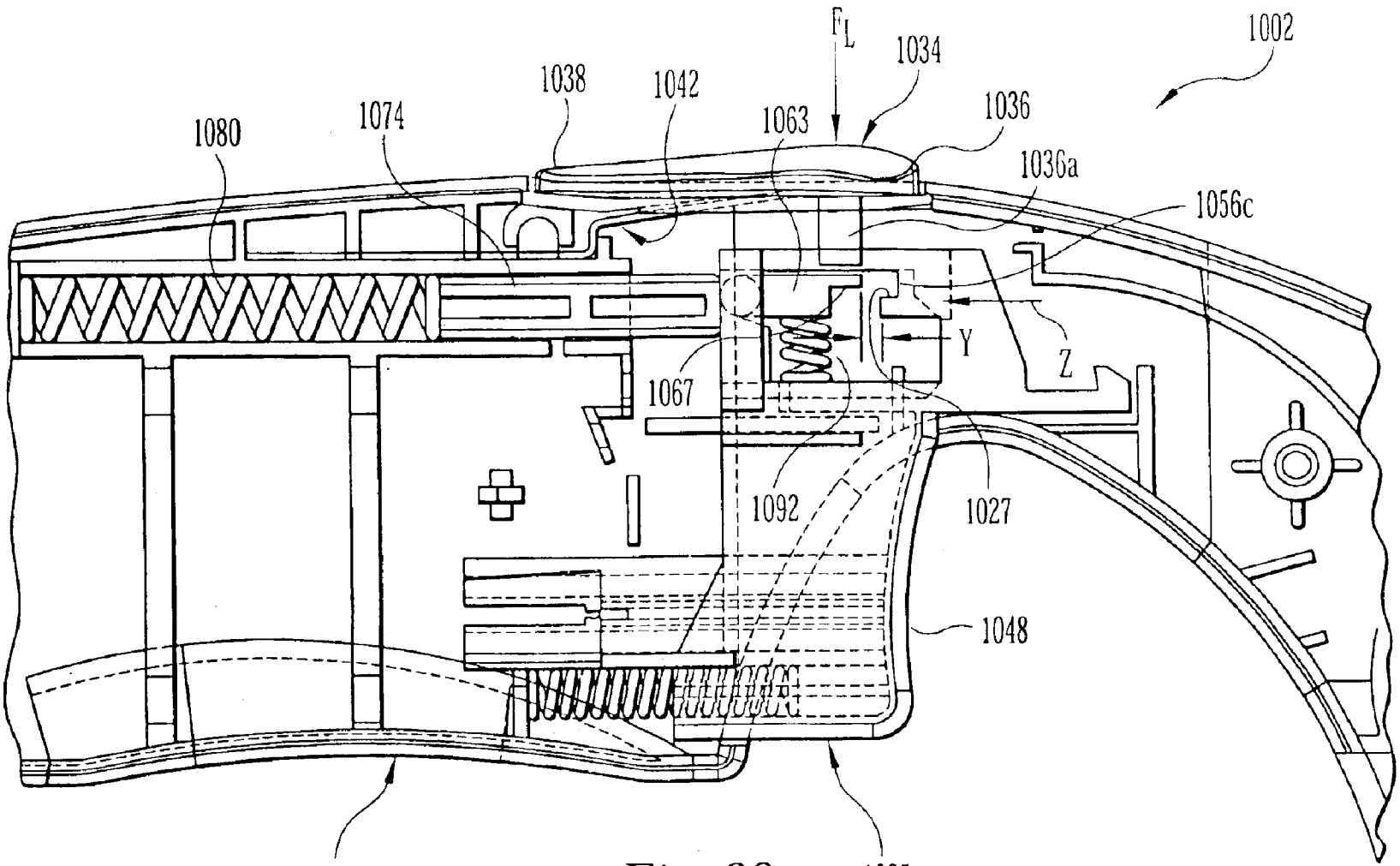
FIG. 30 is an enlarged, partial, side view of a tenth embodiment of the present invention, where the plunger member is in the high-actuation-force position and the trigger is in an initial position.
Figure 30A:
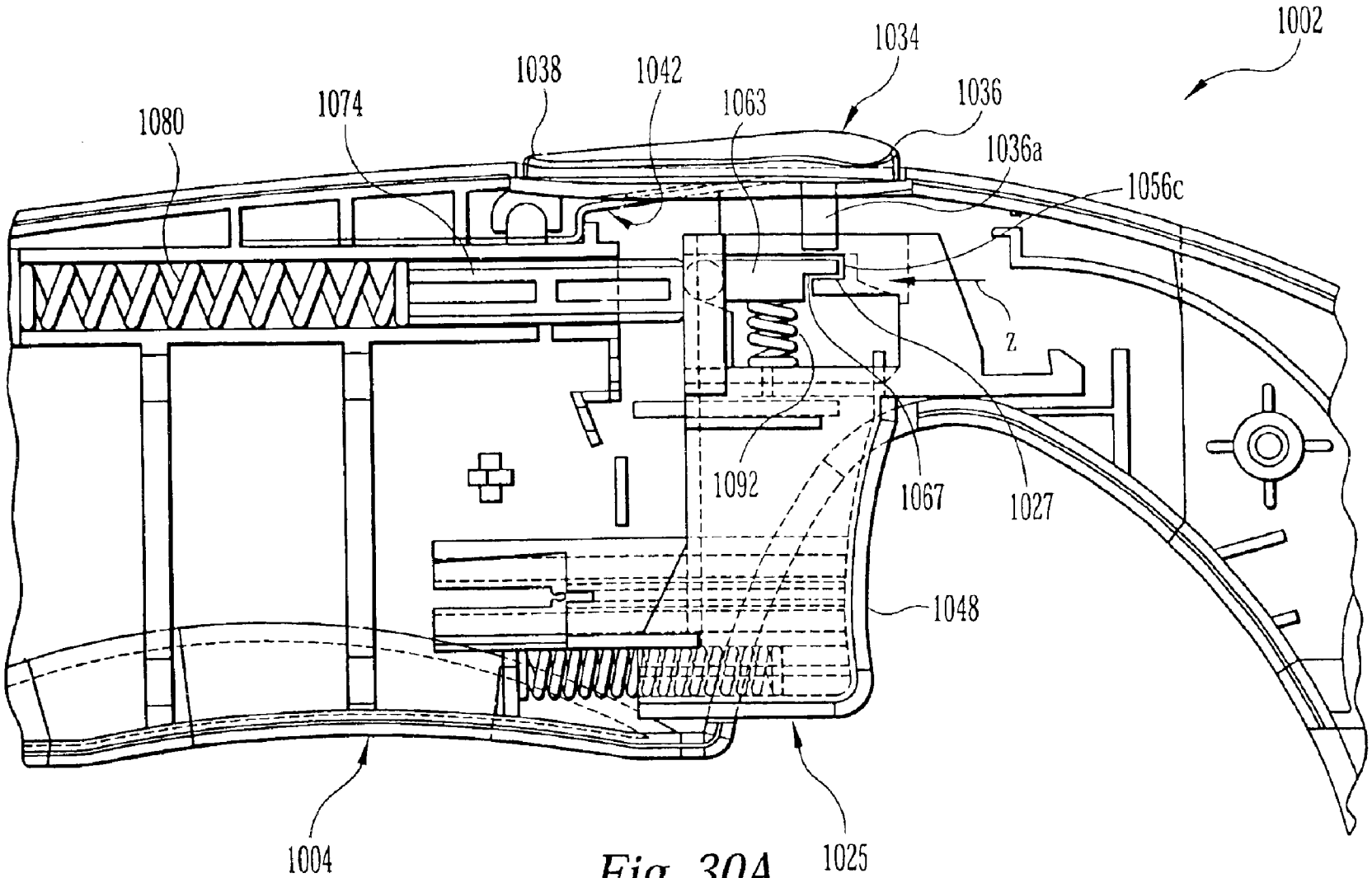
FIG. 30A is an enlarged, partial, side view of the lighter of FIG. 30, where the plunger member is in the high-actuation-force position and the trigger is in a depressed position.

Referring to FIGS. 30 and 30A, a variation of lighter 902 is shown as lighter 1002. Lighter 1002 is substantially similar to lighter 902, except that the user may be substantially prevented from pressing latch 1034 if trigger 1025 is pressed before pressing latch 1034. Thus, if a user presses trigger 1025 while lighter 1002 is in the high-force mode, and subsequently attempts to press latch 1034 to switch lighter 1002 to the low-force mode, first engagement surface 1067 will engage second engagement surface 1027 to substantially prevent or block movement of latch 1034 to the low-force position. This may be accomplished by, for example, forming first engagement surface 1067 and second engagement surface 1027 as surfaces or ledges that overlap or abut when trigger 1025 is pressed before latch 1034. As shown in FIGS. 30 and 30A, a slight gap may exist between the first and second engagement surfaces 1067, 1027, such that the first and second engagement surfaces 1067, 1027 engage only upon movement of latch 1034 a predetermined distance after movement of trigger 1029 a predetermined distance. Alternatively, there may be substantially no gap between first and second engagement surfaces 1027, 1067 such that these surfaces are in contact prior to movement of latch 1034 a predetermined distance.

In the illustrative embodiment shown in FIGS. 30 and 30A, first and second engagement surfaces 1067, 1027 are shown substantially parallel to one another, however first and second engagement surfaces 1067, 1027 may alternatively be angled with respect to one another. Furthermore, while first and second engagement surfaces 1067, 1027 are shown as substantially horizontal surfaces (e.g., substantially parallel with respect to the direction of movement Z of actuating member 1025), they may alternatively be slightly angled surfaces (e.g., angled with respect to direction Z). In one illustrative embodiment, first engagement surface 1067 and/or second engagement surface 1027 may be angled by about 5° with respect to direction Z, however other angles are possible. One of ordinary skill in the art will appreciate that first engagement surface 1067 and second engagement surface 1027 are not limited to the configurations shown and other configurations are possible. For example, first engagement surface 1067 may be formed on piston member 1074, and second engagement surface 1027 may be formed on housing 1004. Furthermore, first engagement surface 1067 and/or second engagement surface 1027 may be hook-shaped or any other engaging shape known to one skilled in the art.

When lighter 1002 is in the high-force mode and trigger 1025 is in the initial position, as shown in FIG. 30, first engagement surface 1067 and second engagement surface 1027 are separated by a distance Y. Distance Y is sufficient that, if a user attempts to press latch 1034 to switch lighter 1002 to the low-force position, the resultant movement of plunger 1063 will cause substantially no engagement between the first engagement surface 1067 and the second engagement surface 1027. Thus, in this state, the user may press latch 1034 to switch lighter 1002 to the low-force mode so long as a latch force $F_L$ sufficient to overcome the forces of spring 1092, optional leaf spring 1042, and any incidental frictional forces is applied.

If the user presses trigger 1025 before pressing latch 1034, as shown in FIG. 30A, the first engagement surface 1067 overlaps the second engagement surface 1027. As a result, first engagement surface 1067 abuts second engagement surface 1027 when the user presses latch 1034. This substantially prevents or blocks pressing of latch 1034. To press latch 1034 when first engagement surface 1067 abuts second engagement surface 1027, the user would have to provide enough force to break or deform one or more components of lighter 1002. Thus, according to this embodiment, a user is substantially prevented from moving latch 1034 to the low-force mode if trigger 1025 is pressed before latch 1034 is pressed.

One of ordinary skill in the art will know and appreciate that lighter 1002 may be configured such that trigger 1025 may be partially pressed before causing first engagement surface 1067 and second engagement surface 1027 to engage one another. In this case, a user may move trigger 1025 a predetermined distance before pressing latch 1034, and may still be able to press latch 1034 and switch lighter 1002 to the low-force mode; however upon moving trigger 1025 a distance larger than the predetermined distance, the first and second engagement surfaces 1067, 1027 will engage to substantially prevent or block movement of latch 1034.

Figure 31:
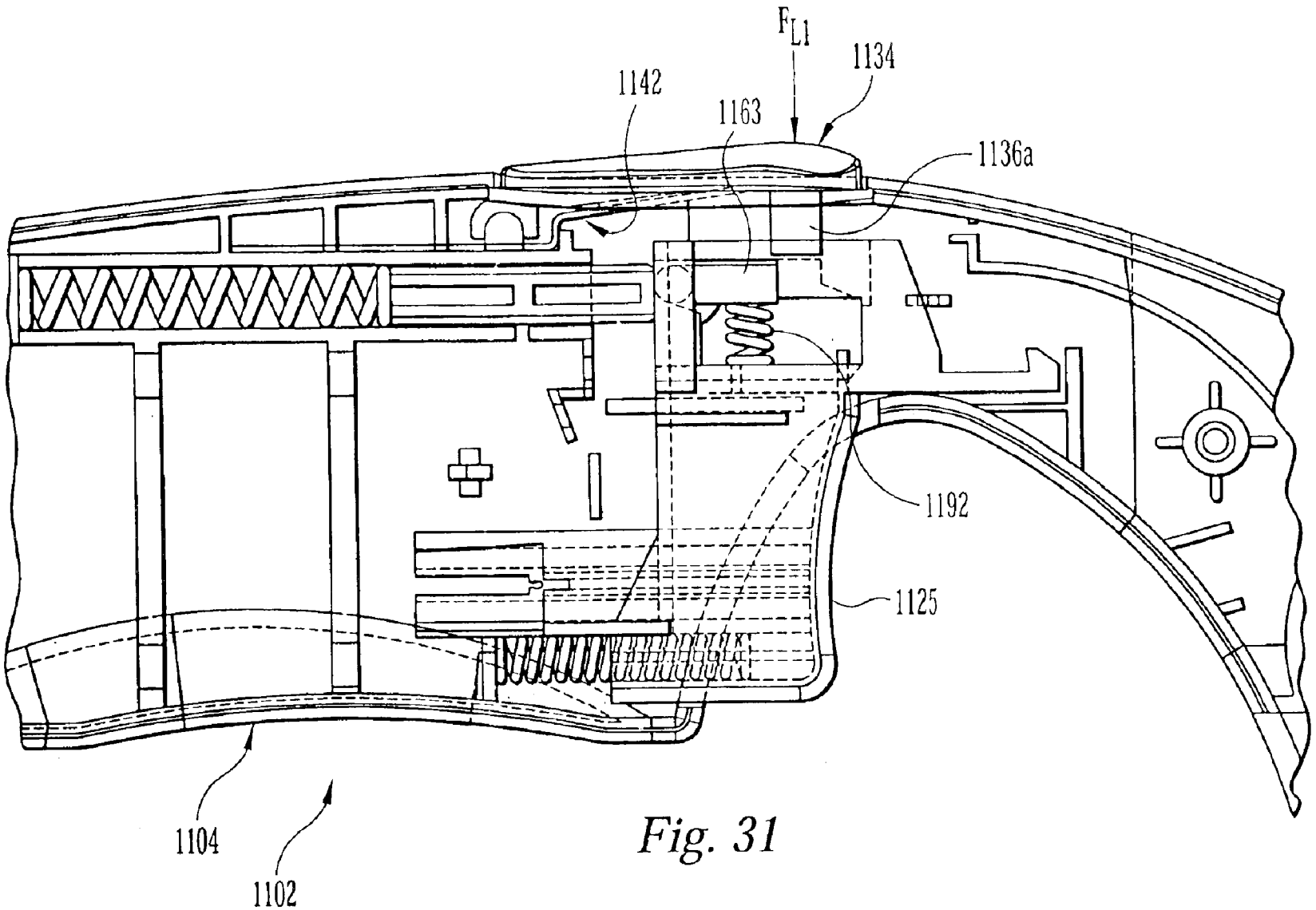
FIG. 31 is an enlarged, partial, side view of an eleventh embodiment of the present invention, where the trigger is in an initial position.
Figure 31A:
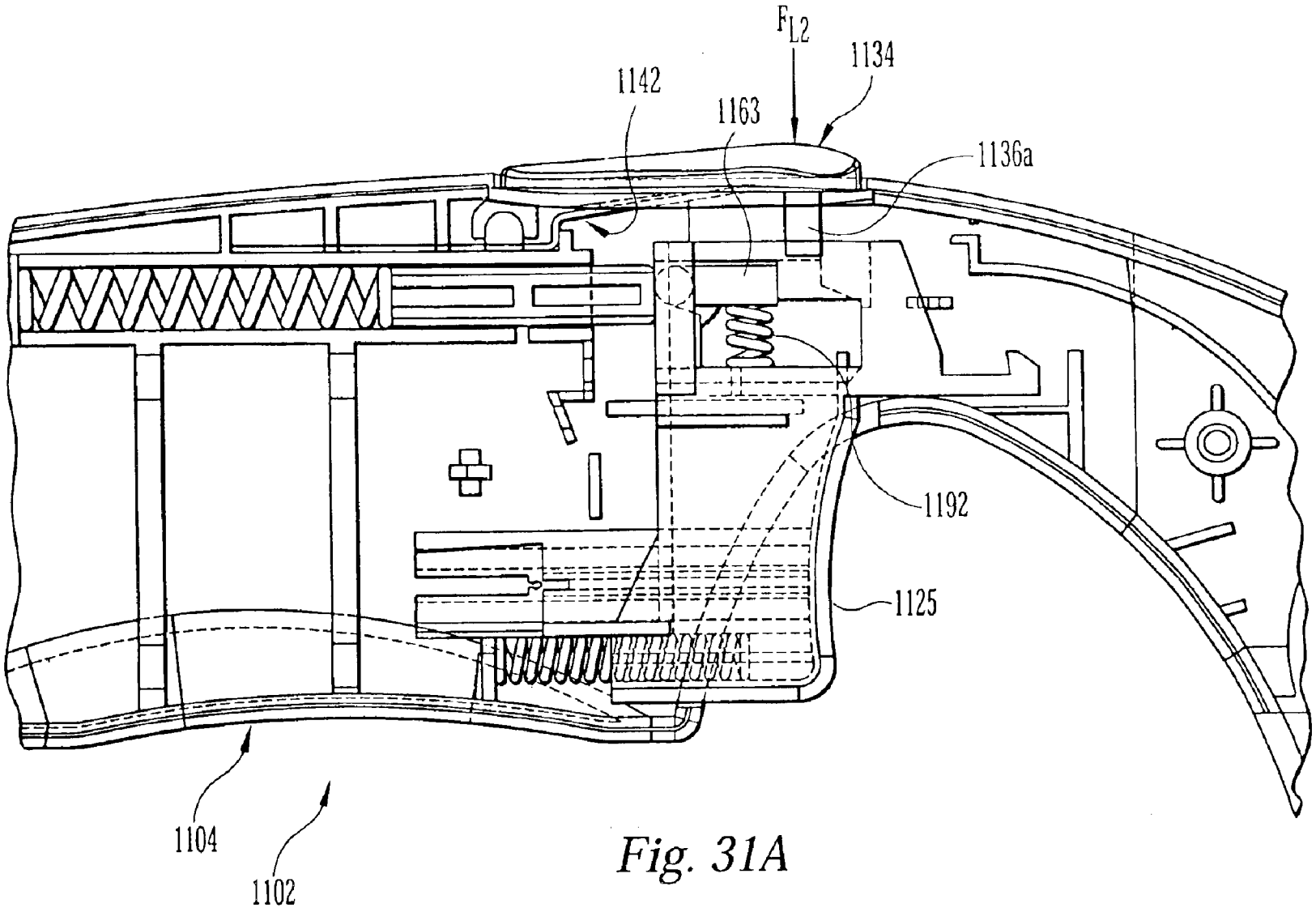
FIG. 31A is an enlarged, partial, side view of the lighter of FIG. 31, where the trigger is in a depressed position.

Referring to FIGS. 31 and 31A, another variation of lighter 902 is shown as lighter 1102. In this embodiment, movement of trigger 1125 a predetermined distance before movement of latch 1134 may disable the function of latch 1134 (i.e., latch 1134 may still be moved from the first latch position to the second latch position, but this movement will not effectuate the function of latch 1134 (e.g., to switch the lighter from a high-force mode to a low-force mode)). This may be accomplished, for example, by configuring latch 1134 and/or plunger 1164 such that latch 1134 becomes substantially disassociated from plunger 1164 upon movement of trigger 1125 a predetermined distance before pressing latch 1134. More specifically, as shown in FIG. 31, when trigger 1125 is in the initial position (i.e., non-depressed position), boss 1136*a* and plunger 1164 are at least partially aligned with one another (e.g., have a slight overlap), such that pressing latch 1134 may impart movement to plunger 1164 from the high-force position (shown) to the low-force position (not shown). In the state shown in FIG. 31, the latch force $F_{L1}$ required to press latch 1134 and switch lighter 1102 to the low-force mode need only be sufficient to overcome the forces of spring 1192, optional leaf spring 1142, and any incidental frictional forces. As shown in FIG. 31A, however, when trigger 1125 is moved a predetermined distance before pressing latch 1134, boss 1136*a* and plunger 1164 are shifted out of alignment (e.g., there is no overlap), and as a result, pressing latch 1134 will not move plunger 1164 from the high-force position to the low-force position. In the state shown in FIG. 31A, the latch force $F_{L2}$ required to press latch 1134 need only be sufficient to overcome the forces of optional leaf spring 1142 and any incidental frictional forces, however, as discussed above, movement of latch 1134 will not switch lighter 1102 to the low-force mode. One of ordinary skill in the art will know and understand that lighter 1102 is not limited to the structures shown and described, and that any number of configurations may be implemented to disable the function of latch 1134 upon movement of trigger 1125 a predetermined amount before pressing latch 1134.

One of ordinary skill in the art will recognize that lighters 902, 1002, 1102 are not limited to the structures shown and described, and that any number of structures may be implemented to vary the latch force. One of ordinary skill in the art will recognize that latch 934, 1034, 1134 is not limited to a "dual-mode" latch, as described herein, and alternatively or additionally may control other functions of the lighter.

While various descriptions of the present invention are described above, it should be understood that the various features of each embodiment may be used singly or in any combination thereof. Therefore, this invention is not to be limited to only the specific embodiments depicted herein. Further, it should be understood that variations and modifications within the spirit and scope of the invention may occur to those skilled in the art to which the invention pertains. For example, insulated wire 28 (shown in FIG. 1B) may be replaced by an at least partially helically coiled spring concentrically disposed outside of conduit 23; in which case, the helically coiled spring is preferably at least partially insulated to prevent undesirable arcing from the spring to other components of the lighter. As another example, the wand assembly may alternatively be configured to pivot about a different axis with respect to housing or moreover, to move or slide with respect to housing. As yet another example, in all of the embodiments, the latch member can be used with or without a separate biasing member for returning the latch member to its initial position after depression. When a separate biasing member is not used, it is recommended that the latch member by resiliently deformable. This modification may require additional modifications, as known by those of ordinary skill in the art, to complete the electrical communication between the piezoelectric unit and the nozzle.

Furthermore, although in the presently discussed embodiments the low-force mode relies on the user operating two components (e.g., a trigger and latch), in an alternative embodiment, the low-force mode may rely on the user operating further additional components (e.g., a trigger and two latches; or a trigger, a latch, and a gas-release button).

As another example, the plunger member in any of the embodiments above may be configured and located so that a finger actuation portion of the plunger member is outside of the housing and the remainder of the plunger member is within the housing. Thus, the plunger member may be moved from the high-actuation-force position to the low-actuation force position by a user contacting the finger actuation portion of the plunger member. In such an embodiment, the lighter may not include a latch member.

In another example, the lighter 2 (in FIGS. 1) can lack spring 53. In such an embodiment, the plunger member 63 can be configured to include a projection and the housing 4 or another component can interact with the projection so that in the high-force mode the spring 80 is allowed to be compressed to resist lighter ignition. When the trigger is released after ignition in the high-force mode, the spring 80 returns it to its initial position. In the low-force mode, however, interaction with the projection prevents compression of the high-force spring to the same extent as in the high-force mode so that less force is necessary to ignite the lighter. In such a lighter, the trigger can be returned to the initial position after depression with the aid of the return spring in the piezoelectric unit.

Furthermore, the lighter may include the dual-mode aspect of the lighter, the pivoting wand assembly aspect of the lighter, cam follower aspect of the lighter, and the conduit aspect of the lighter discussed above, separately or in any combination. As a result, the features of the lighter 2 can be used alone or in combination with one another or other known features.

Accordingly, all expedient modifications readily attainable by one versed in the art from the disclosure set forth herein which are within the scope and spirit of the present invention are to be included as further embodiments of the present invention. Moreover, the features of the embodiments may be combined with additional cognitive effects such as a more complex trigger actuation path to make actuation of the lighter more difficult. The scope of the present invention is accordingly defined as set forth in the appended claims.

We claim:

1. A lighter comprising:

a housing having a nozzle, said housing further including a fuel supply in communication with a valve adapted for movement to selectively release fuel to the nozzle;

an ignition mechanism capable of creating a spark proximate the nozzle to ignite the released fuel;

an actuating member movable from an initial position to a secondary position for performing at least one step in releasing the fuel and igniting the released fuel; and a latch moveable between a first latch position and a second latch position, wherein the user applies a first actuating force to the actuating member to perform the at least one step in release the fuel and igniting the released fuel when the latch is positioned in the first latch position, and a second actuating force to the actuating member to perform the at least one step in releasing the fuel and igniting the released fuel when the latch is positioned in the second latch position, the first actuating force being greater than the second actuating force; and wherein a first latch force is required to move the latch from the first latch position to the second latch position when the user moves the actuating member before moving the latch and a second latch force is required to move the latch from the first latch position to the second latch position when the user moves the latch before moving the actuating member; the first latch force being greater than the second latch force.

2. The lighter of claim 1, wherein movement of the actuating member from the initial position to the secondary position simultaneously releases the fuel from the supply of fuel and activates the ignition mechanism.

3. The lighter of claim 1, further comprising a valve actuator configured and adapted to control the movement of the valve.

4. The lighter of claim 1, wherein movement of the actuating member a predetermined amount before substantial movement of the latch prevents movement of the latch from the first latch position to the second latch position.

5. The lighter of claim 1, further comprising a first engagement surface associated with the latch and a second engagement surface associated with the actuating member, the first and second engagement surfaces being normally disengaged with respect to one another; wherein movement of the actuating member a predetermined distance before substantial movement of the latch causes the first engagement surface to engage the second engagement surface.

6. The lighter of claim 5, wherein the first engagement surface and the second engagement surface are substantially parallel overlapping surfaces.

7. The lighter of claim 5, further comprising a plunger member associated with the latch, wherein the first engagement surface is formed on the plunger member.

8. The lighter of claim 7, wherein the actuating member comprises a trigger, and the second engagement surface is formed on the trigger.

9. The lighter of claim 1, further comprising a first engagement surface directly or indirectly, associated with the latch and a second engagement surface, directly or indirectly, associated with the actuating member; wherein movement of the actuating member a predetermined amount before substantial movement of the latch causes the first engagement surface to contact the second engagement surface.

10. The lighter of claim 9, wherein the first and second engagement surfaces are inclined surfaces.

11. The lighter of claim 9, wherein the first and second engagement surfaces are sized and configured not to contact one another when the user moves the latch from the first latch position to the second latch position before moving the actuating member a predetermined distance.

12. The lighter of claim 11, wherein the first and second engagement surfaces are sized and configured to contact one another when the user moves the actuating member a predetermined distance before moving the latch from the first latch position to the second latch position such that subsequent movement of the latch from the first latch position to the second latch position entails overcoming frictional forces between the first and second engagement surfaces.

13. The lighter of claim 1, further comprising:

a first engagement surface associated with the latch; and a second engagement surface associated with the actuating member and normally disengaged from the first engagement surface;

wherein movement of the actuating member a predetermined distance before substantial movement of the latch causes the first engagement surface to engage the second engagement surface.

14. The lighter of claim 13, wherein the first engagement surface and the second engagement surface are substantially parallel overlapping surfaces.

15. The lighter of claim 13, further comprising a plunger member associated with the latch, wherein the first engagement surface is formed on the plunger member.

16. The lighter of claim 15, wherein the actuating member comprises a trigger, and the second engagement surface is formed on the trigger.

17. A lighter comprising:

a housing having a nozzle, said housing further including a fuel supply in communication with a valve adapted for movement to selectively release fuel to the nozzle;

an ignition mechanism capable of creating a spark proximate the nozzle to ignite the release fuel;

an actuating member operatively associated with a first engagement surface, the actuating member being movable from an initial position to a secondary position, wherein movement of the actuating member from the initial position to the secondary position simultaneously releases the fuel from the supply of fuel and activates the ignition mechanism; and a latch operatively associated with a second engagement surface, the latch being moveable between a first latch position, wherein the first and second engagement surfaces do not contact one another, and a second latch position, wherein the first and second engagement surfaces are in contact with one another, the actuating member being configured so that a user applies a first actuating force to the actuating member to release and ignite the fuel when the latch is positioned in the first latch position, and a second actuating force to the actuating member to release and ignite the fuel when the latch is positioned in the second latch position, the first actuating force being greater than the second actuating force; and wherein a first latch force is required to move the latch from the first latch position to the second latch position when the user moves the actuating member before pressing the latch and a second latch force is required to move the latch from the first latch position to the second latch position when the user presses the latch before moving the actuating member; the first latch force being greater than the second latch force.

* * * * *